US008524433B2

(12) United States Patent
Doi et al.

(10) Patent No.: US 8,524,433 B2
(45) Date of Patent: Sep. 3, 2013

(54) ELECTROPHOTOGRAPHIC PHOTOCONDUCTOR, PROCESS CARTRIDGE, AND IMAGE FORMING APPARATUS

(75) Inventors: Takatsugu Doi, Kanagawa (JP); Wataru Yamada, Kanagawa (JP); Yuko Iwadate, Kanagawa (JP); Katsumi Nukada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 242 days.

(21) Appl. No.: 12/917,697

(22) Filed: Nov. 2, 2010

(65) Prior Publication Data

US 2011/0318677 A1 Dec. 29, 2011

(30) Foreign Application Priority Data

Jun. 28, 2010 (JP) ..... 2010-146975

(51) Int. Cl.
*G03G 5/04* (2006.01)

(52) U.S. Cl.
USPC ..... 430/66; 430/56; 430/57.3; 430/58.75

(58) Field of Classification Search
USPC ..... 430/56–60
See application file for complete search history.

(56) References Cited

U.S. PATENT DOCUMENTS

| | | | | |
|---|---|---|---|---|
| 5,043,237 | A * | 8/1991 | Blanchet-Fincher et al. | 430/56 |
| 5,411,827 | A | 5/1995 | Tamura et al. | |
| 5,456,989 | A | 10/1995 | Nogami et al. | |
| 5,496,671 | A | 3/1996 | Tamura et al. | |
| 2002/0119382 | A1 | 8/2002 | Nakata et al. | |
| 2004/0063014 | A1 * | 4/2004 | Yoshimura et al. | 430/59.6 |
| 2009/0162763 | A1 * | 6/2009 | Li et al. | 430/58.2 |

FOREIGN PATENT DOCUMENTS

| | | |
|---|---|---|
| JP | A-62-251757 | 11/1987 |
| JP | A-5-40360 | 2/1993 |
| JP | A-5-331238 | 12/1993 |
| JP | A-6-250430 | 9/1994 |
| JP | A-7-72640 | 3/1995 |
| JP | A-9-12630 | 1/1997 |
| JP | A-2000-19749 | 1/2000 |
| JP | A-2000-206715 | 7/2000 |
| JP | A-2001-175016 | 6/2001 |
| JP | A-2004-12986 | 1/2004 |
| JP | A-2006-84711 | 3/2006 |

* cited by examiner

*Primary Examiner* — Mark F Huff
*Assistant Examiner* — Rashid Alam
(74) *Attorney, Agent, or Firm* — Oliff & Berridge, PLC.

(57) ABSTRACT

An electrophotographic photoconductor includes a conductive substrate and an outermost surface layer formed on the conductive substrate and containing a binder resin and a copolymer derived from a reactive monomer having charge transport property and a reactive monomer having no charge transport property, the copolymer having a side chain with 4 or more carbon atoms in a constitutional unit derived from the reactive monomer having no charge transport property.

12 Claims, 5 Drawing Sheets

ELECTROPHOTOGRAPHIC PHOTOCONDUCTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2010-146975 filed Jun. 28, 2010.

BACKGROUND (i) Technical Field

The present invention relates to an electrophotographic photoconductor, a process cartridge, and an image forming apparatus.

(ii) Related Art

In electrophotographic image forming apparatuses, the surface of an electrophotographic photoconductor is charged with a predetermined polarity and potential using a charging device; charge erasing is selectively performed on the surface of the charged electrophotographic photoconductor using image exposure to form an electrostatic latent image; a toner is attached to the electrostatic latent image using a developing device to develop the latent image into a toner image; and the toner image is transferred to a recording medium using a transfer unit so that an image-formed product is output.

SUMMARY

According to an aspect of the invention, there is provided an electrophotographic photoconductor including a conductive substrate and an outermost surface layer formed on the conductive substrate and containing a binder resin and a copolymer derived from a reactive monomer having charge transport property and a reactive monomer having no charge transport property, the copolymer having a side chain with 4 or more carbon atoms in a constitutional unit derived from the reactive monomer having no charge transport property.

BRIEF DESCRIPTION OF THE DRAWINGS

Exemplary embodiments of the present invention will be described in detail based on the following figures, wherein.

DETAILED DESCRIPTION

Figure 1:
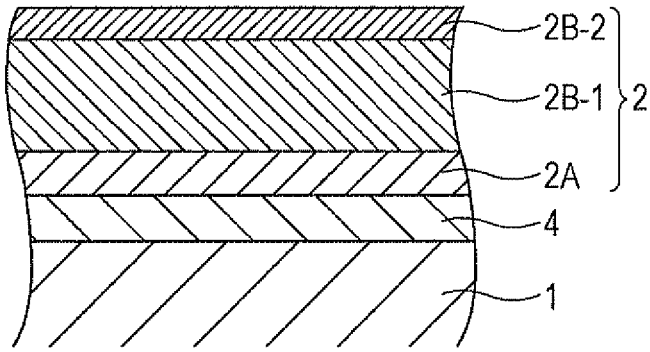
FIG. 1 is a partial sectional view schematically showing an example of a layer structure of an electrophotographic photoconductor according to this exemplary embodiment.

Exemplary embodiments of the invention will now be specifically described.

<Electrophotographic Photoconductor>

An electrophotographic photoconductor (hereinafter may be simply referred to as "photoconductor") according to this exemplary embodiment includes a conductive substrate and a photosensitive layer that is formed on the conductive substrate as an outermost surface layer and contains a copolymer (a) (hereinafter may be referred to as "copolymer") derived from a reactive monomer having charge transport property and a reactive monomer having no charge transport property and a binder resin (b), the copolymer (a) having a side chain with 4 or more carbon atoms in a constitutional unit derived from the reactive monomer having no charge transport property.

For example, the mechanical strength is increased by using a polymeric charge transport material obtained by polymerizing a charge transport material in advance. In the case where a polymeric charge transport material is used, its strength as a material tends to be higher than in the case where a low-molecular-weight charge transport material is used. However, when a polymeric charge transport material is mixed with other binder resins to further increase the strength, such a material has poor compatibility with binder resins and thus it is difficult to prepare a photoconductor. Moreover, this poor compatibility decreases the mechanical strength and deteriorates electrical characteristics.

As a result of extensive studies, the inventors of the present invention found the following. A photoconductor with high mechanical strength provides a stable image that is not influenced by the environment even after the repeated use, by using a polymeric charge transport material and a binder resin, the polymeric charge transport material being composed of a reactive monomer having charge transport property and a reactive monomer having no charge transport property. Herein, a reactive monomer having a side chain with 4 or more carbon atoms in a constitutional unit derived from the reactive monomer having no charge transport property is used. This mechanism is not clearly understood, but is assumed to be as follows.

That is, by using a reactive monomer having charge transport property and a reactive monomer having no charge transport property that constitute a polymeric charge transport material, the molecules of a polymeric charge transport material and a binder resin become entangled and thus the compatibility is improved. Consequently, a photosensitive layer in which the separation between the polymeric charge transport material and the binder resin is suppressed is formed. Herein, a reactive monomer having a side chain with 4 or more carbon atoms in a constitutional unit derived from the reactive monomer having no charge transport property is used. As a result, high mechanical strength achieved by using the polymeric charge transport material is sufficiently exhibited. It is also supposed that the charge transport material is uniformly dispersed in the photosensitive layer, whereby the factor responsible for inhibiting charge transport is suppressed and good electrical characteristics are achieved.

In the case where a polymeric charge transport material is prepared in advance, the residue of a polymerization initiator is removed in a purifying step and thus better electrical characteristics tend to be imparted, compared with the case where a charge transport material is polymerized on a base. Furthermore, in the case where a charge transport material is polymerized on a base, distortion in a photosensitive layer is easily caused and the electrical characteristics are easily deteriorated. However, in the case where a polymeric charge transport material is used, the distortion in a photosensitive layer is suppressed and thus better electrical characteristics may be obtained.

The photoconductor according to this exemplary embodiment is effective against a phenomenon in which a discharge product formed in large amounts when a charging member (particularly a contact charging member) is used on the surface of a photoconductor is attached to the surface, and the discharge product causes image deletion and white streaks in a high temperature and humidity environment or a low temperature and humidity environment. Regarding the effect that suppresses the phenomenon in which image deletion and white streaks are caused in a high temperature and humidity environment or a low temperature and humidity environment, it is supposed that the dispersibility of a charge transport material in a coating solution used when the outermost surface layer of the photoconductor is formed is improved, whereby an outermost surface layer containing a charge transport material uniformly dispersed therein is formed. Therefore, even if a discharge product generated from a charging member is attached to the surface of the photoconductor, local deterioration of the surface is suppressed.

[Structure of Photoconductor]

The photoconductor according to this exemplary embodiment includes a conductive base and a photosensitive layer formed on the conductive base as an outermost surface layer. The photosensitive layer of the outermost surface layer contains a binder resin and a copolymer derived from a reactive monomer having charge transport property and a reactive monomer having no charge transport property, the copolymer having a side chain with 4 or more carbon atoms in a constitutional unit derived from the reactive monomer having no charge transport property. The layer structure of the photoconductor is not particularly limited as long as the photoconductor has the above-described configuration.

The photosensitive layer according to this exemplary embodiment may be a function-integrated photosensitive layer having both charge transport property and charge generation property or a function-separated photosensitive layer containing a charge transport layer and a charge generation layer. Other layers such as an undercoat layer may be further formed.

The structure of the photoconductor according to this exemplary embodiment will now be described with reference to FIGS. 1 to 3, but the exemplary embodiment is not limited by FIGS. 1 to 3.

FIG. 1 is a schematic view showing an example of a layer structure of a photoconductor according to this exemplary embodiment. In FIG. 1, 1 denotes a base, 2 denotes a photosensitive layer, 2A denotes a charge generation layer, 2B-1 and 2B-2 denote charge transport layers, and 4 denotes an undercoat layer.

The photoconductor shown in FIG. 1 has a layer structure in which the undercoat layer 4, the charge generation layer 2A, the charge transport layer 2B-1, and the charge transport layer 2B-2 are layered on the base 1 in that order. The photosensitive layer 2 includes three layers of the charge generation layer 2A and the charge transport layers 2B-1 and 2B-2 (first exemplary embodiment).

In the photoconductor shown in FIG. 1, the charge transport layer 2B-2 is an outermost surface layer, and the charge transport layer 2B-2 includes at least the copolymer (a) and the binder resin (b).

Figure 2:
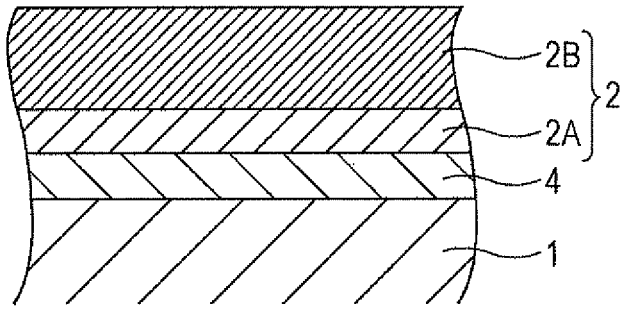
FIG. 2 is a partial sectional view schematically showing another example of a layer structure of an electrophotographic photoconductor according to this exemplary embodiment.

FIG. 2 is a schematic view showing another example of a layer structure of a photoconductor according to this exemplary embodiment. The reference numerals shown in FIG. 2 are the same as those shown in FIG. 1.

The photoconductor shown in FIG. 2 has a layer structure in which the undercoat layer 4, the charge generation layer 2A, and the charge transport layer 2B are layered on the base 1 in that order. The photosensitive layer 2 includes two layers of the charge generation layer 2A and the charge transport layer 2B (second exemplary embodiment).

In the photoconductor shown in FIG. 2, the charge transport layer 2B is an outermost surface layer, and the charge transport layer 2B includes at least the copolymer (a) and the binder resin (b).

Figure 3:
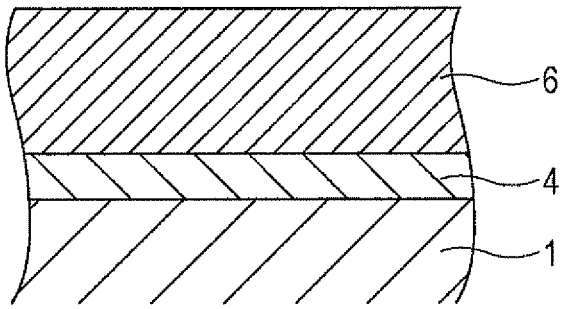
FIG. 3 is a partial sectional view schematically showing still another example of a layer structure of an electrophotographic photoconductor according to this exemplary embodiment.

FIG. 3 is a schematic view showing still another example of a layer structure of a photoconductor according to this exemplary embodiment. In FIG. 3, 6 denotes a function-integrated photosensitive layer, and other reference numerals shown in FIG. 3 are the same as those shown in FIG. 1.

The photoconductor shown in FIG. 3 has a layer structure in which the undercoat layer 4 and the photosensitive layer 6 are layered on the base 1 in that order. The photosensitive layer 6 is a layer having both functions of the charge generation layer 2A and the charge transport layer 2B shown in FIG. 2 (third exemplary embodiment).

In the photoconductor shown in FIG. 3, the function-integrated photosensitive layer 6 is an outermost surface layer, and the photosensitive layer 6 includes at least the copolymer (a) and the binder resin (b).

The above-described first to third exemplary embodiments will now be described as examples of the photoconductors according to this exemplary embodiment.

(First Exemplary Embodiment)

As shown in FIG. 1, the photoconductor according to the first exemplary embodiment has a layer structure in which the undercoat layer 4, the charge generation layer 2A, the charge transport layer 2B-1, and the charge transport layer 2B-2 are layered on the base 1 in that order. The charge transport layer 2B-2 is an outermost surface layer.

Charge Transport Layer 2B-2

First, the charge transport layer 2B-2 that is an outermost surface layer will be described.

The outermost surface layer (charge transport layer 2B-2 in the first exemplary embodiment) according to this exemplary embodiment contains a binder resin and a copolymer derived from a reactive monomer having charge transport property and a reactive monomer having no charge transport property. The copolymer has a side chain with 4 or more carbon atoms in a constitutional unit derived from the reactive monomer having no charge transport property. The outermost surface layer may include other materials.

(Reactive Monomer Having Charge Transport Property)

A reactive group in the reactive monomer having charge transport property may be, for example, at least one selected from an acrylic group, a methacrylic group, a styryl group, and the derivatives thereof.

In this exemplary embodiment, the "reactive monomer having charge transport property" is a monomer having a charge mobility of $1\times10^{-10}$ $cm^2/V\cdot s$ or more at a field intensity of 10 V/μm measured by a time-of-flight (TOF) technique, and the "reactive monomer having no charge transport property" is a monomer having a charge mobility of less than $1\times10^{-10}$ $cm^2/V\cdot s$ under the conditions described above.

An example of the reactive monomer having charge transport property and used in this exemplary embodiment includes a monomer represented by general formula (3-1) below.

General formula (3-1)

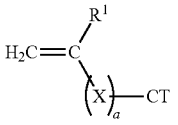

In general formula (3-1), $R^1$ represents hydrogen or an alkyl group having 1 to 4 carbon atoms, X represents a divalent organic group having 1 to 10 carbon atoms, a is 0 or 1, and CT represents an organic group having a charge transport skeleton. X may contain at least one substituent selected from a carbonyl group, an ester group, and an aromatic ring and may have a side chain with an alkyl group, preferably an alkyl group having 1 to 4 carbon atoms.

A compound represented by general formula (2) below is more preferred. Hereinafter, a charge transport material having a reactive group will be described based on the compound represented by general formula (2) below.

General formula (2)

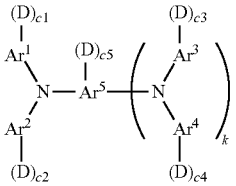

In general formula (2), $Ar^1$ to $Ar^4$ may be the same or different and each independently represent a substituted or unsubstituted aryl group, $Ar^5$ represents a substituted or unsubstituted aryl group or a substituted or unsubstituted arylene group, D represents a side chain having a reactive group, c1 to c5 are each independently an integer of 0 to 2, k is 0 or 1, and the total number of D is 1 to 6.

The total number of D is particularly preferably 1. In the case where the total number of D is 1, a three-dimensional cross-linked body is not formed when a copolymer (polymeric charge transport material) is prepared. Thus, the copolymer tends to be easily dispersed or dissolved together with the binder resin. In the case where the total number of D is 2 or more, a three-dimensional cross-linked body is formed, and thus it becomes difficult to disperse or dissolve the copolymer together with the binder resin. However, the mechanical strength tends to be increased.

In general formula (2), D that represents a side chain having a reactive group may be a group having a structure of $—(CH_2)_d—(O—(CH_2)_f)_e—O—CO—C(R')=CH_2$. In the above-described group, R' represents hydrogen or $CH_3$, d is an integer of 0 to 5, f is an integer of 1 to 5, and e is 0 or 1.

In general formula (2), $Ar^1$ to $Ar^4$ are each independently a substituted or unsubstituted aryl group. $Ar^1$ to $Ar^4$ may be the same or different.

Examples of a substituent in the substituted aryl group include alkyl groups or alkoxy groups having 1 to 4 carbon atoms and substituted or unsubstituted aryl groups having 6 to 10 carbon atoms. Herein, the substituent excludes D (a side chain having a reactive group).

Each of $Ar^1$ to $Ar^4$ may be one of compounds represented by formulas (1) to (7) below. Formulas (1) to (7) below each include "$-(D)_c$," that collectively represents "$-(D)_{c1}$" to "$-(D)_{c4}$" respectively linked with $Ar^1$ to $Ar^4$.

(1)

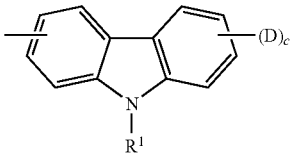

(2)

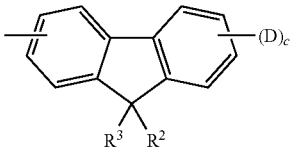

(3)

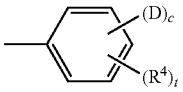

(4)

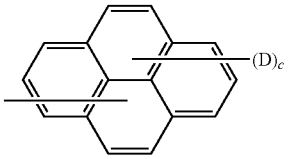

(5)

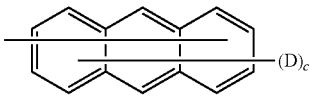

(6)

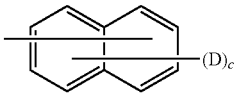

(7)

In formulas (1) to (7) above, $R^1$ represents one selected from a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms; $R^2$ to $R^4$ each independently represent one selected from a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; Ar represents a substituted or unsubstituted arylene group; Z' represents a divalent organic linking group; D represents a side chain having a reactive group; c is an integer of 0 to 2; s is 0 or 1; and t is an integer of 0 to 3.

Ar in formula (7) may be represented by structural formula (8) or (9) below.

(8)

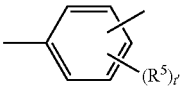

(9)

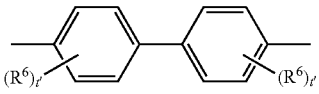

In formulas (8) and (9) above, $R^5$ and $R^6$ each independently represent one selected from a hydrogen atom, an alkyl group having 1 to 4 carbon atoms, an alkoxy group having 1 to 4 carbon atoms, a phenyl group substituted with an alkyl group having 1 to 4 carbon atoms or an alkoxy group having 1 to 4 carbon atoms, an unsubstituted phenyl group, an aralkyl group having 7 to 10 carbon atoms, and a halogen atom; and t' is an integer of 1 to 3.

In formula (7) above, Z' represents a divalent organic linking group and may be one of groups represented by formulas (10) to (17) below.

(10) $-(CH_2)_q-$

(11) $-(CH_2CH_2O)_r-$ (12)

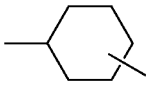

(13)

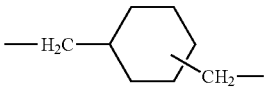

(14)

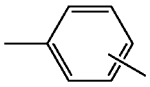

(15)

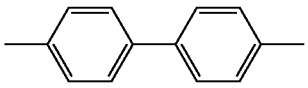

(16)

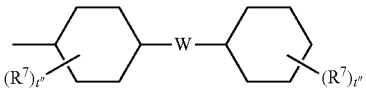

(17)

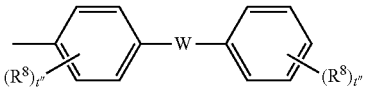

In formulas (10) to (17) above, $R^7$ and $R^8$ each independently represent one selected from a hydrogen atom, an alkyl group having 1 to 4 carbon atoms, an alkoxy group having 1 to 4 carbon atoms, a phenyl group substituted with an alkyl group having 1 to 4 carbon atoms or an alkoxy group having 1 to 4 carbon atoms, an unsubstituted phenyl group, an aralkyl group having 7 to 10 carbon atoms, and a halogen atom; W represents a divalent group; q and r are each independently an integer of 1 to 10; and t'' is an integer of 0 to 3.

In formulas (16) and (17) above, W may be one of the divalent groups represented by formulas (18) to (26) below. In formula (25), u is an integer of 0 to 3.

(18) $-CH_2-$

(19) $-C(CH_3)_2-$

(20) $-O-$

(21) $-S-$

(22) $-C(CF_3)_2-$

(23) $-Si(CH_3)_2-$ (24)

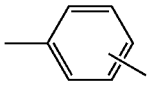

(25)

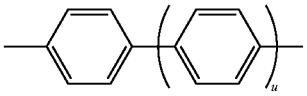

(26)

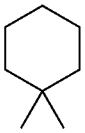

In general formula (2) above, $Ar^5$ represents a substituted or unsubstituted aryl group when k is 0. Examples of the aryl group include the aryl groups exemplified when $Ar^1$ to $Ar^4$ have been described. $Ar^5$ is a substituted or unsubstituted arylene group when k is 1. Examples of the arylene group include arylene groups obtained by removing one hydrogen atom from the aryl groups exemplified when $Ar^1$ to $Ar^4$ have been described.

Specific examples of the compound represented by general formula (2) above will now be described. The compound represented by general formula (2) is not limited at all by such compounds.

i-1

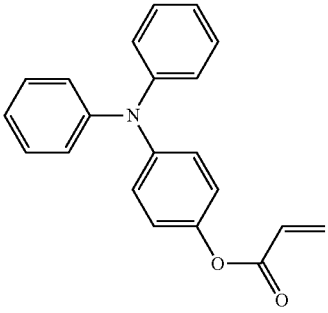

i-2

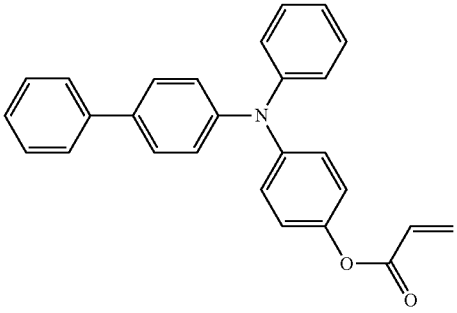

-continued
i-3
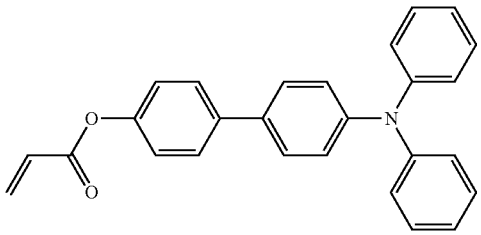
i-4
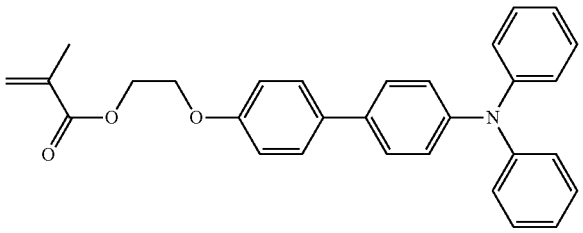
i-5
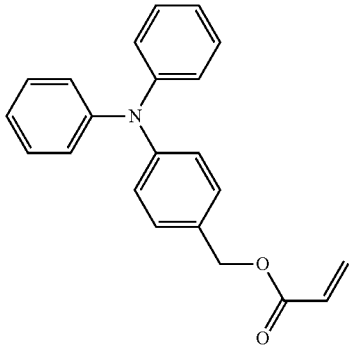
i-6
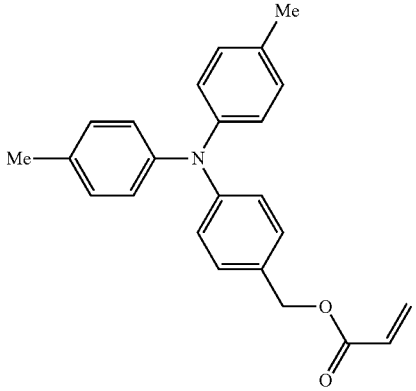
i-7
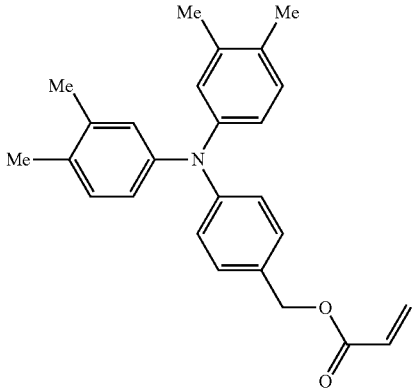
i-8
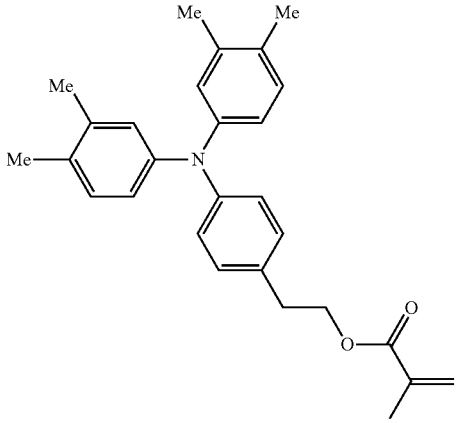
i-9
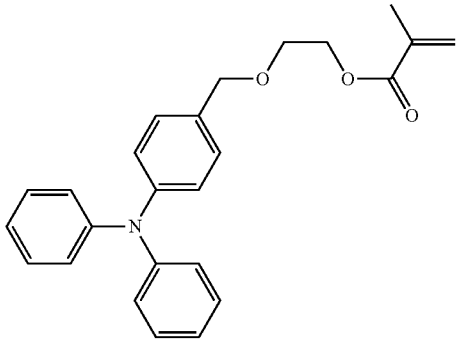
i-10
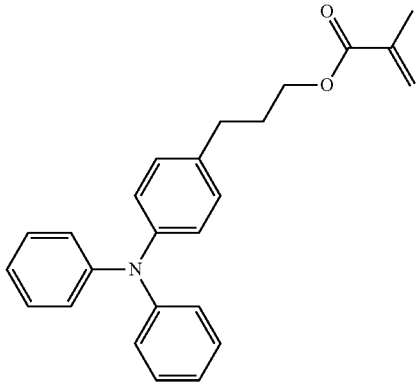

-continued
i-11
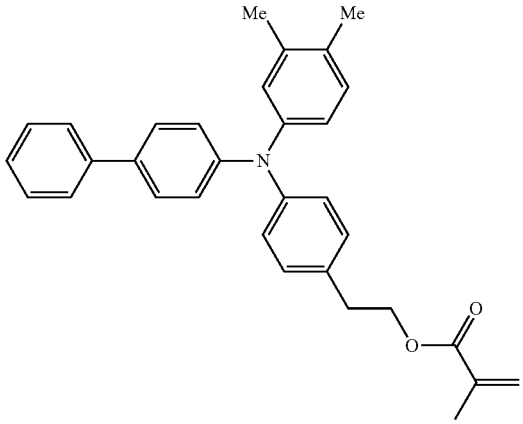
i-12
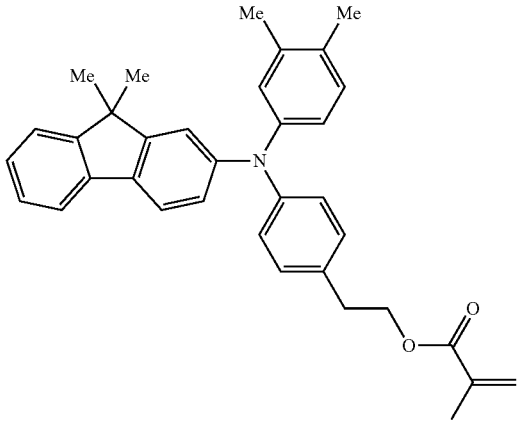
i-13
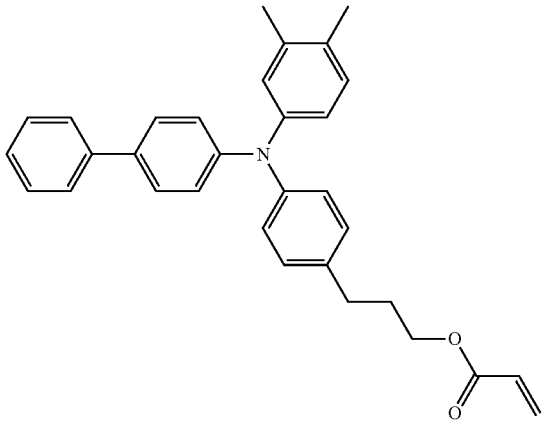
i-14
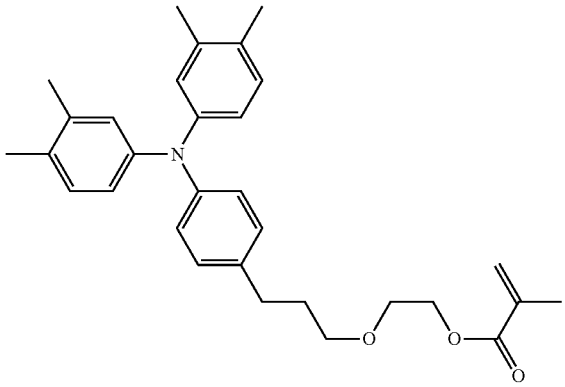
i-15
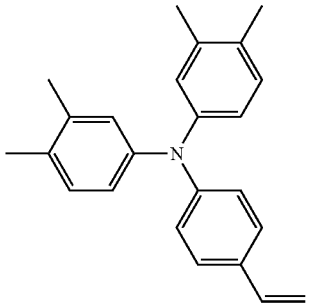
i-16
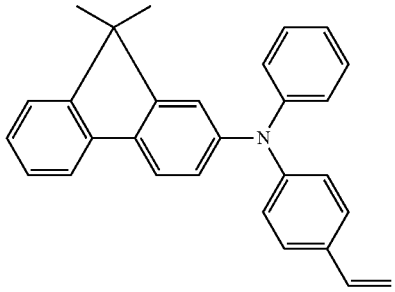
i-17
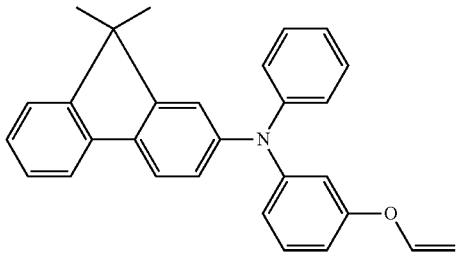
i-18
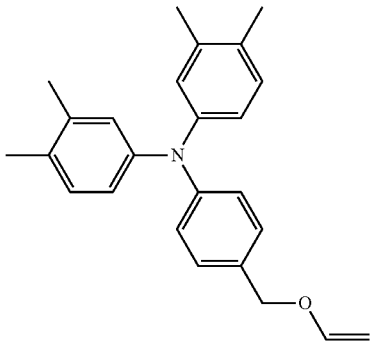

-continued
i-19
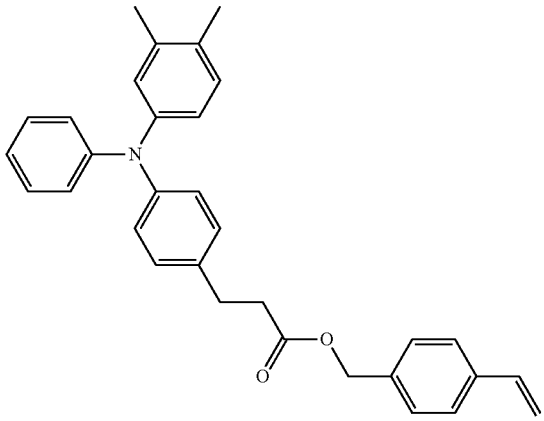
i-20
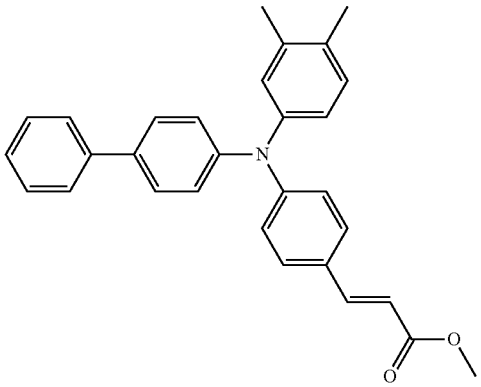
i-21
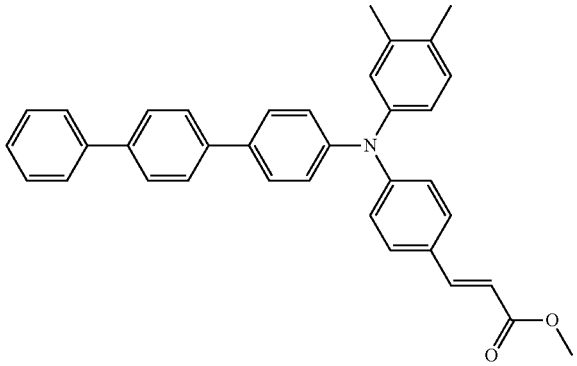
i-22
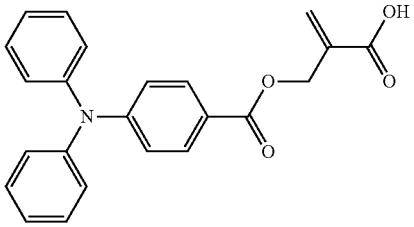
i-23
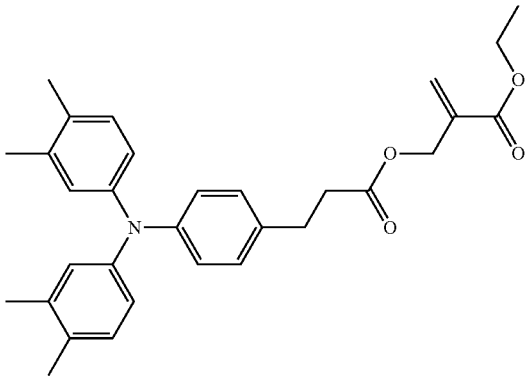
i-24
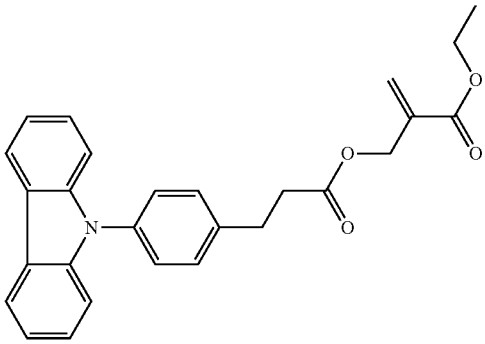
i-25
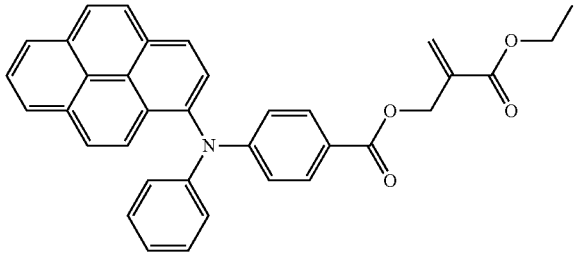
i-26
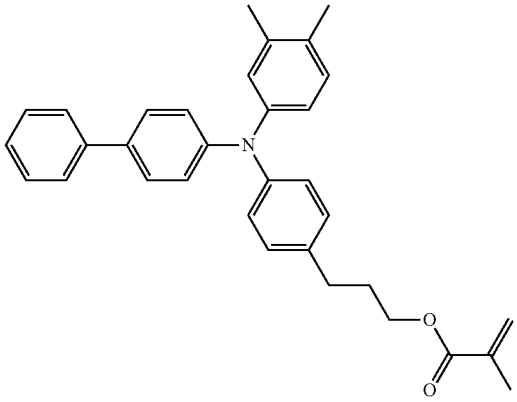

-continued
i-27
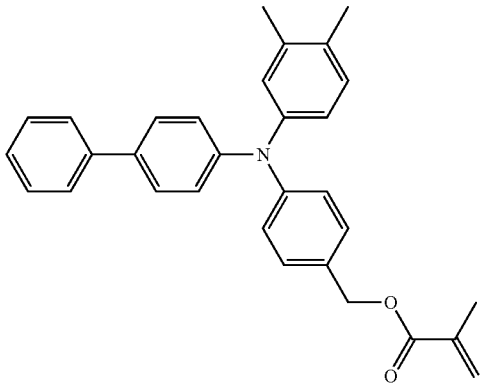
ii-1
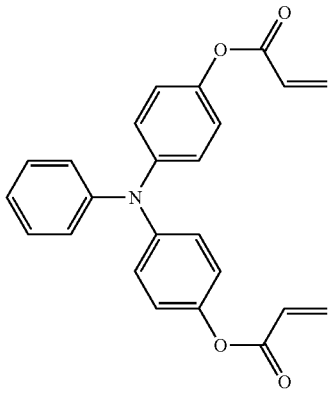
ii-2
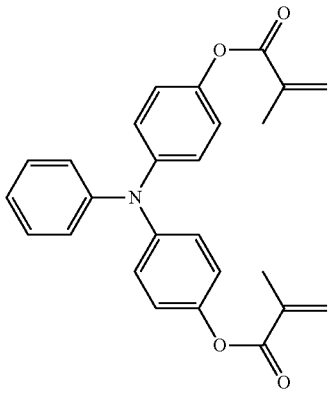
ii-3
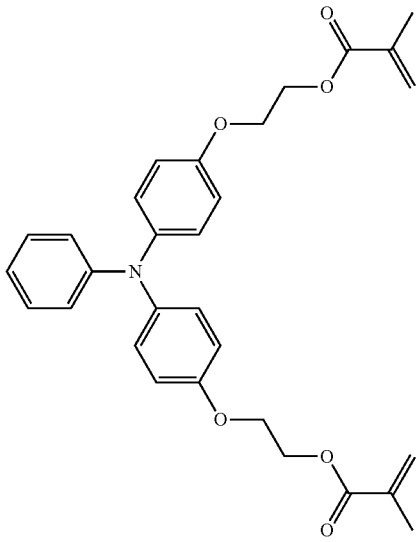
ii-4
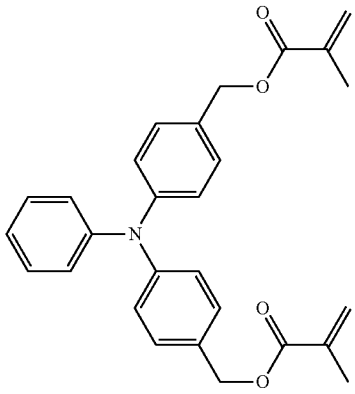
ii-5
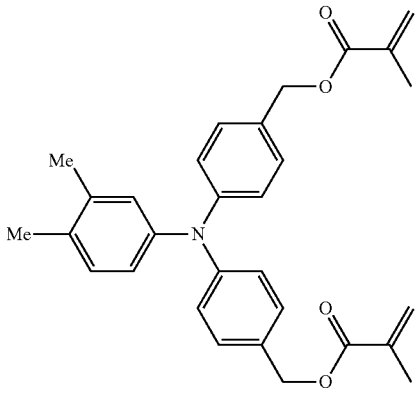

-continued
ii-6
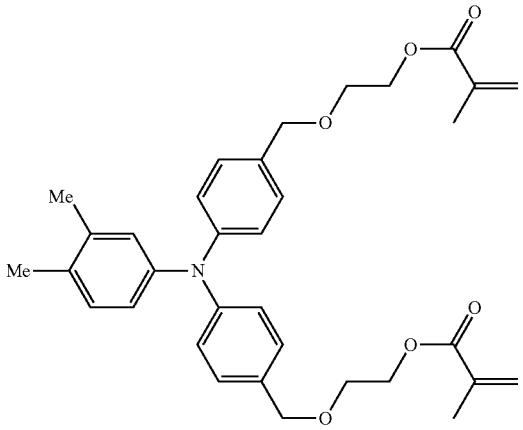
ii-7
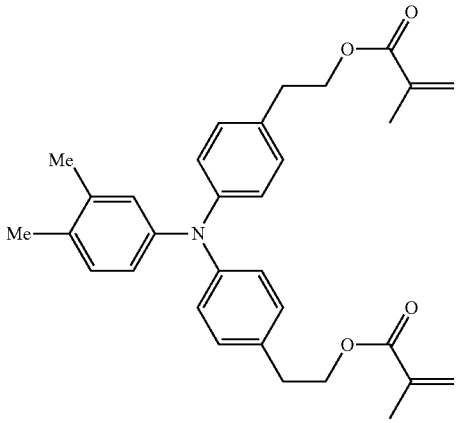
ii-8
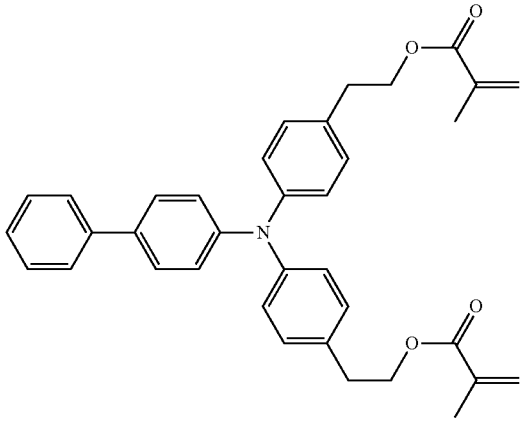
ii-9
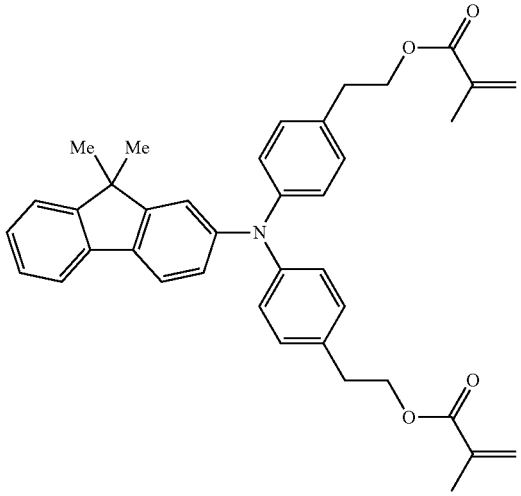
ii-10
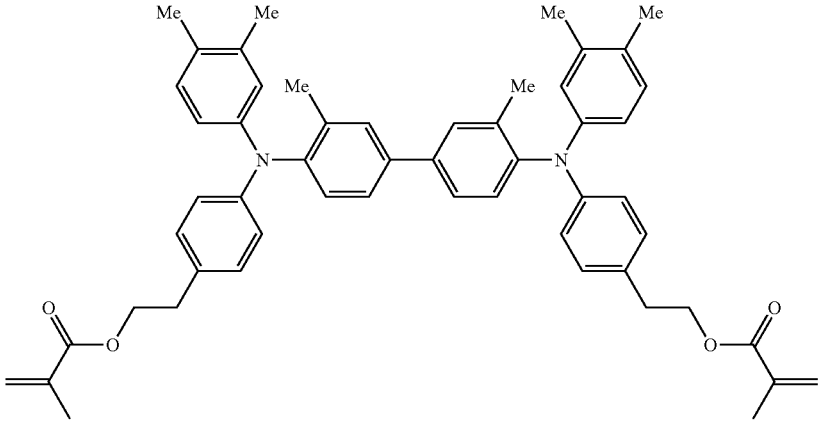

-continued
ii-11
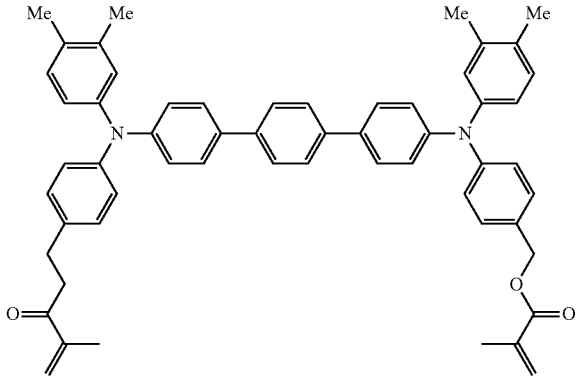
ii-12
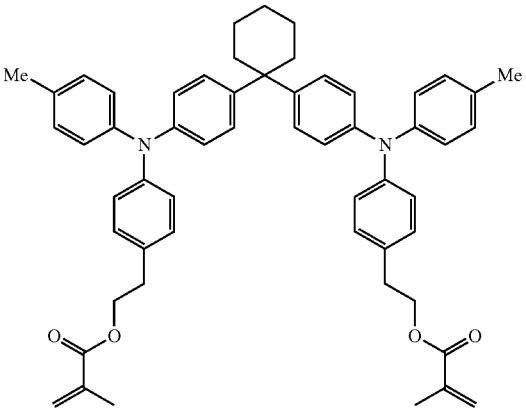
ii-13
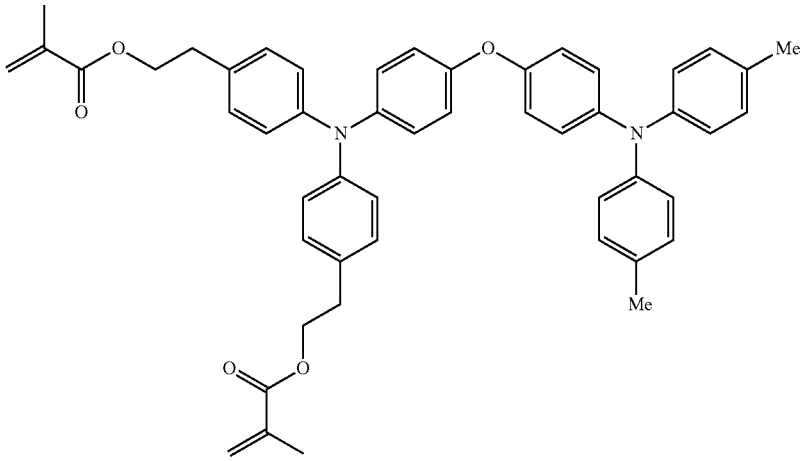
ii-14
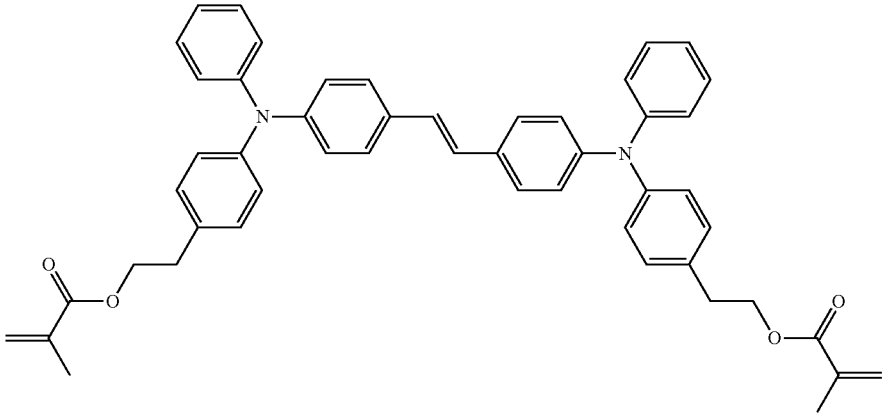

-continued
ii-15
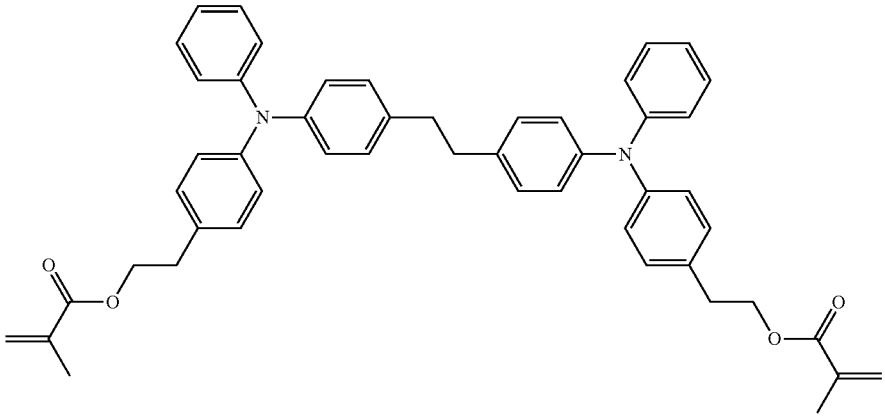
ii-16
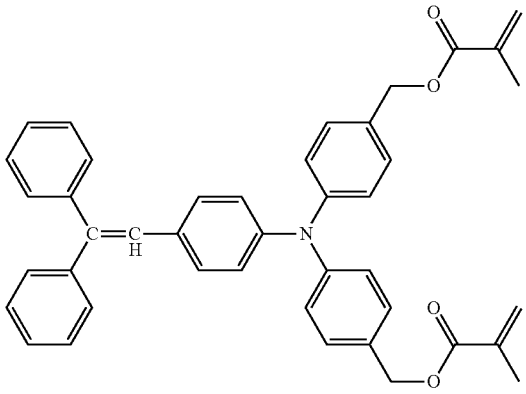
ii-17
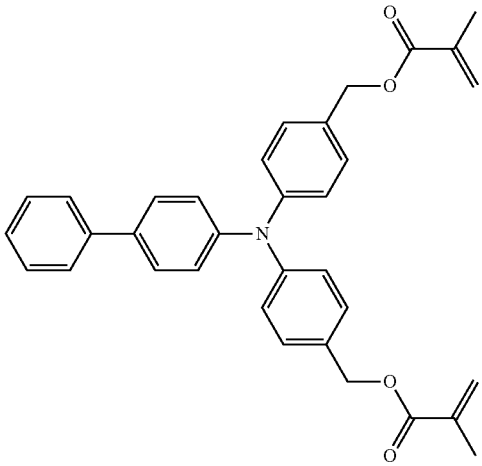
ii-18
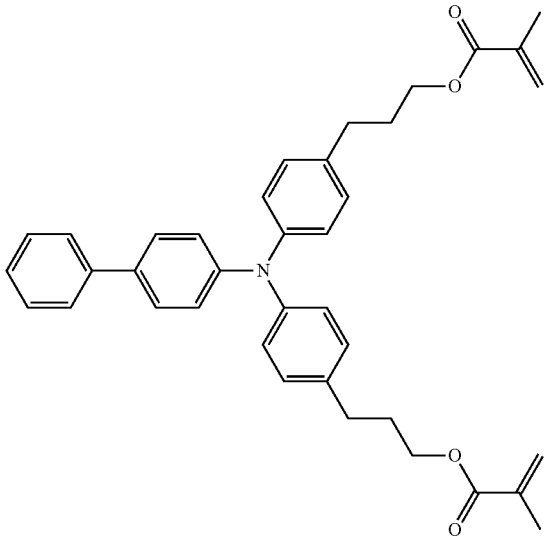

-continued
ii-19
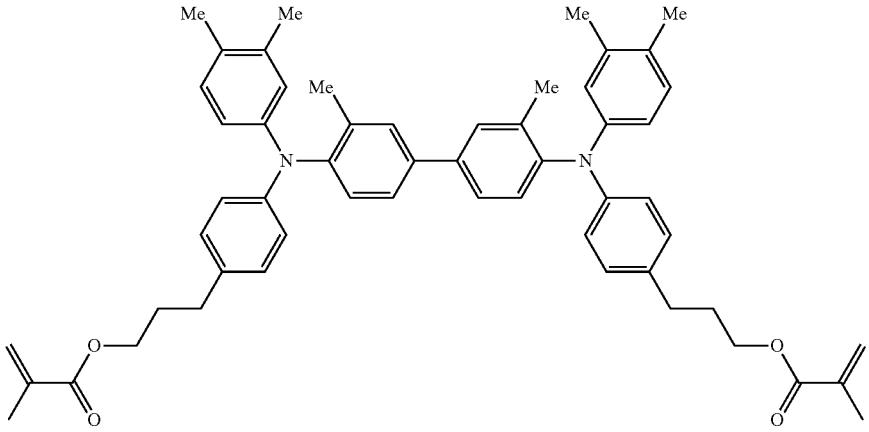
ii-24
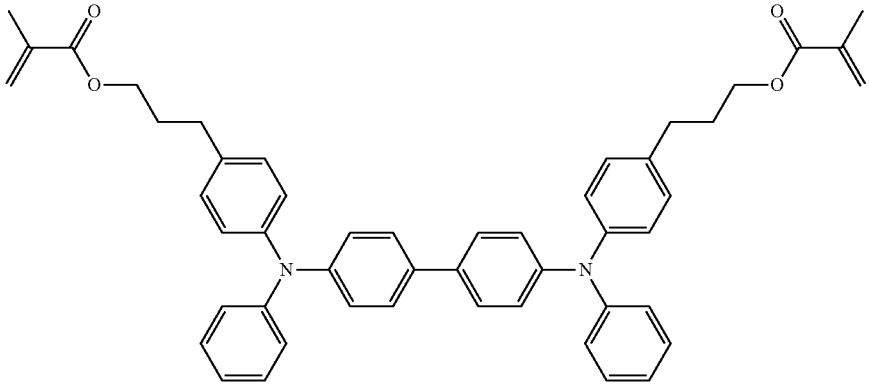
ii-25
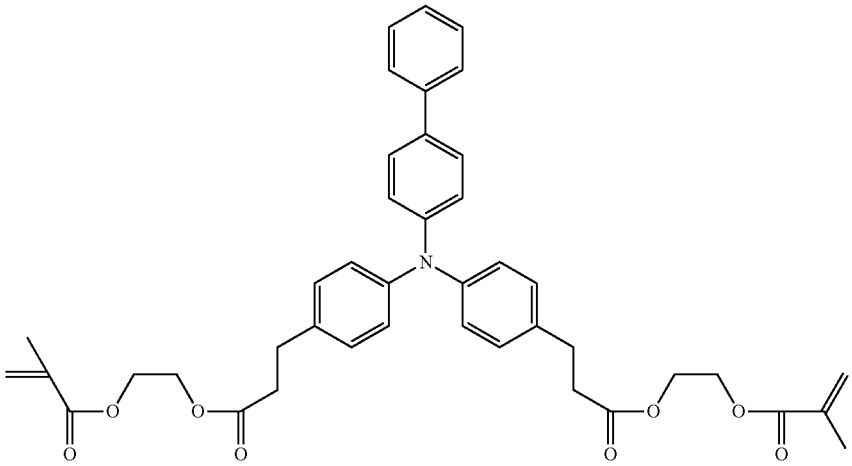

-continued
ii-26
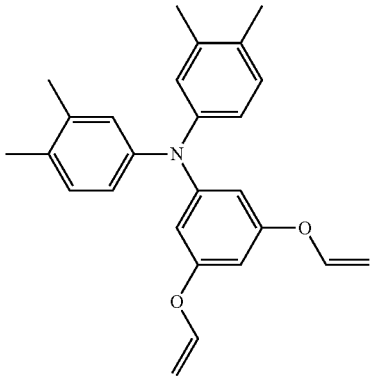
ii-27
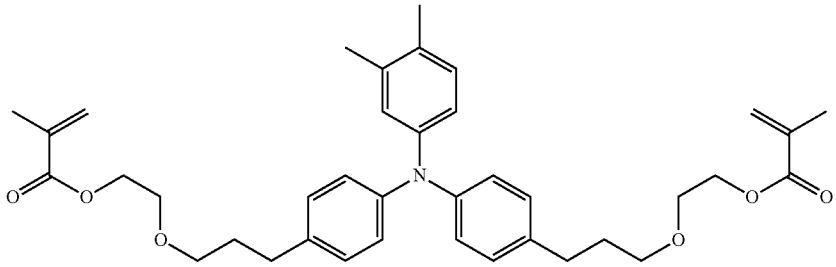
ii-28
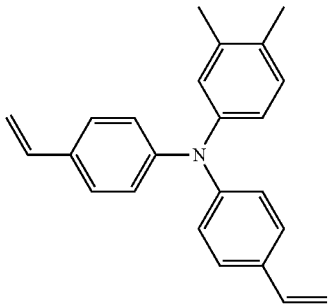
ii-29
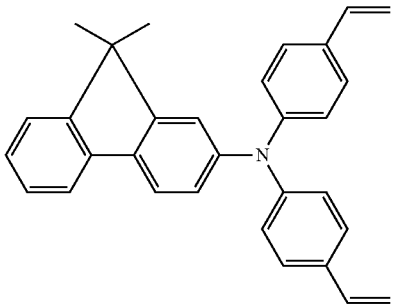
ii-30
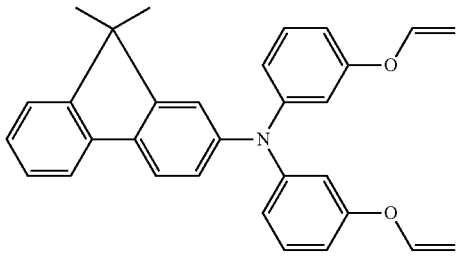
ii-31
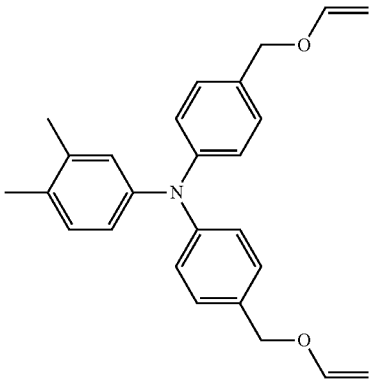

-continued
ii-32
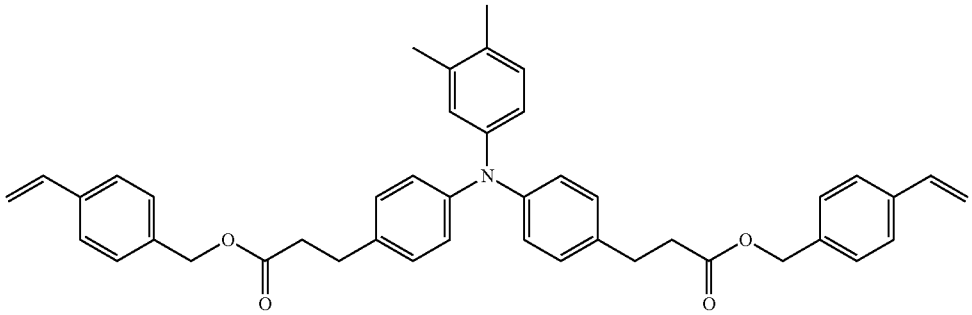
ii-33
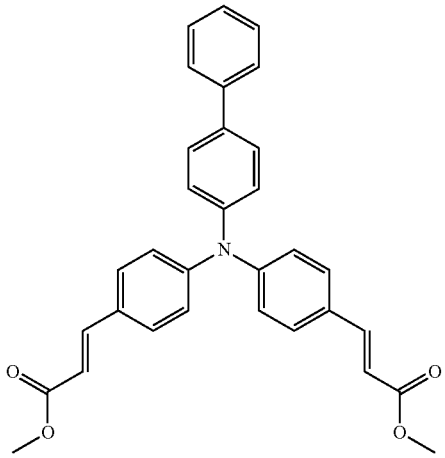
ii-34
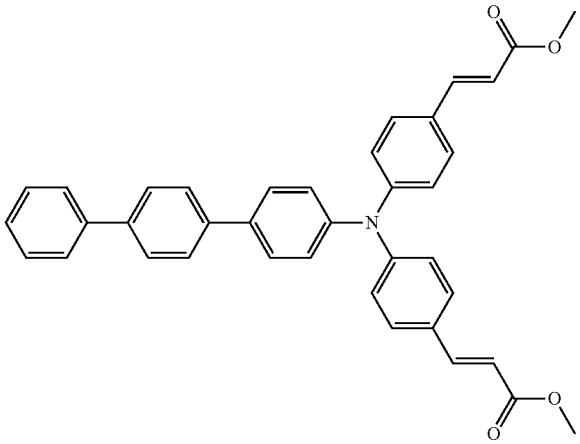
ii-35
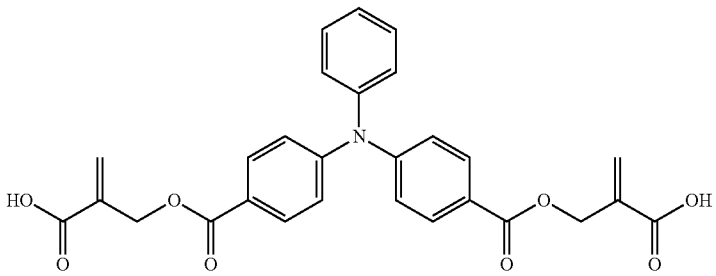
ii-36
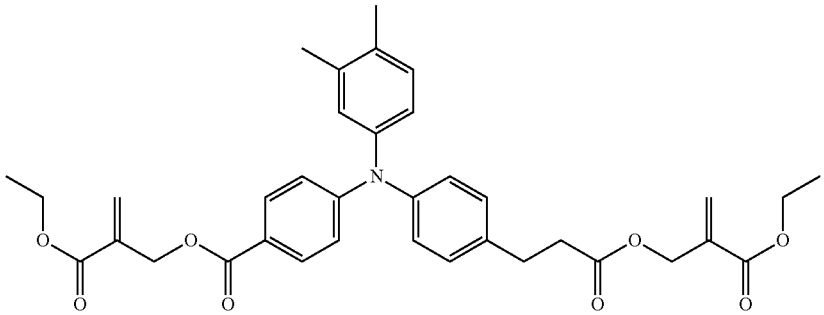

-continued
ii-37
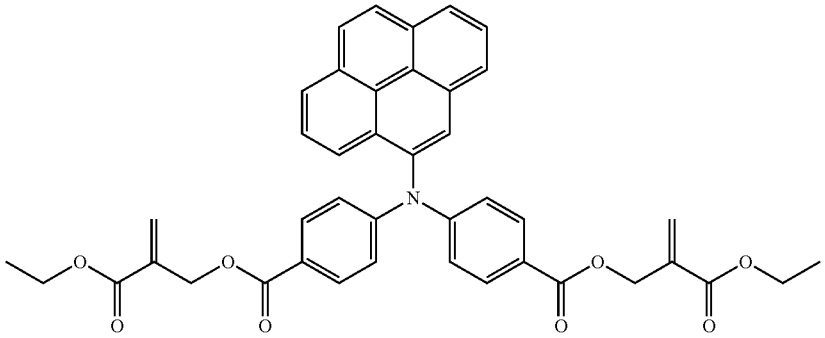
ii-38
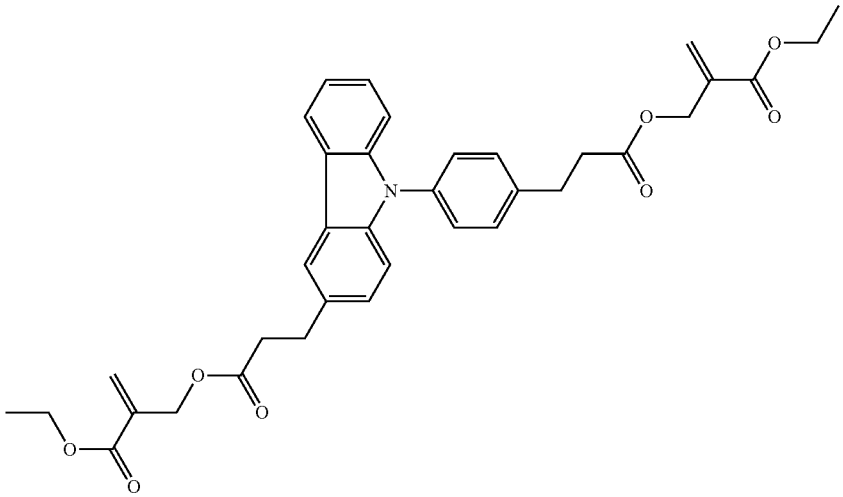
ii-39
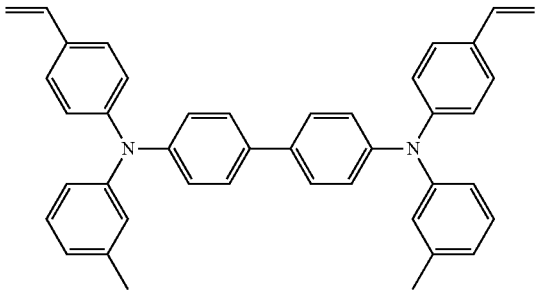
ii-40
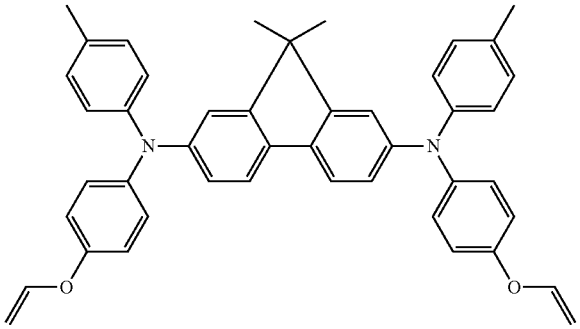
ii-41
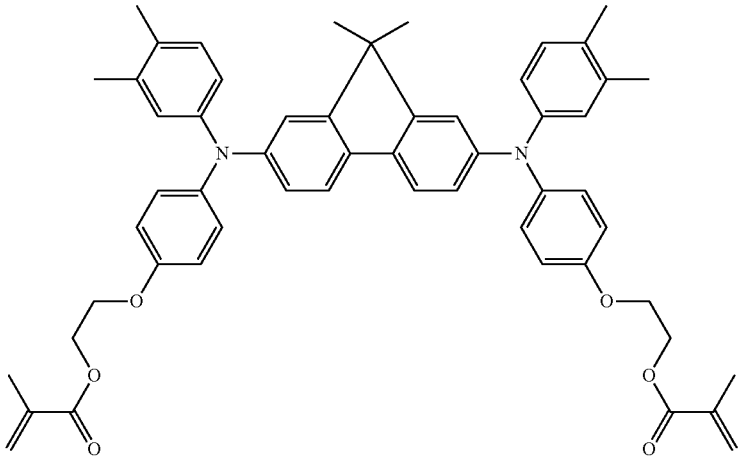

-continued
ii-42
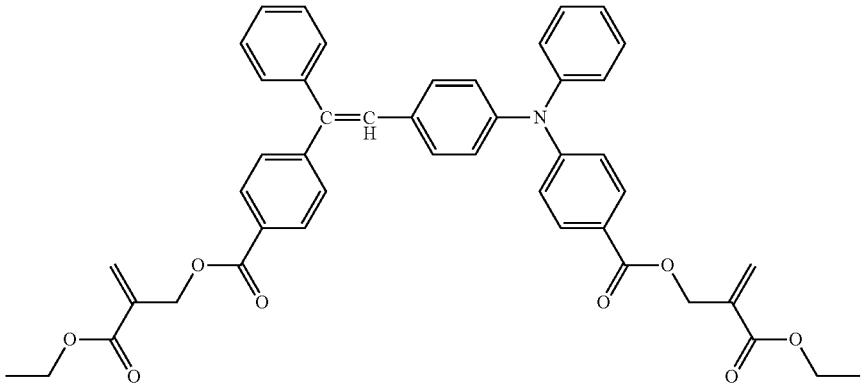
ii-43
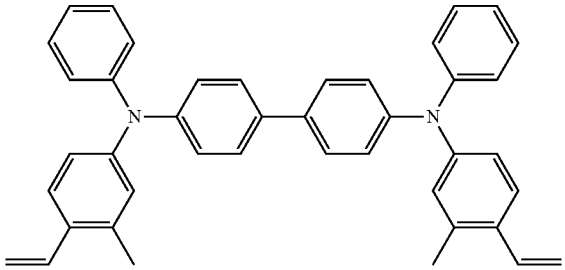
ii-44
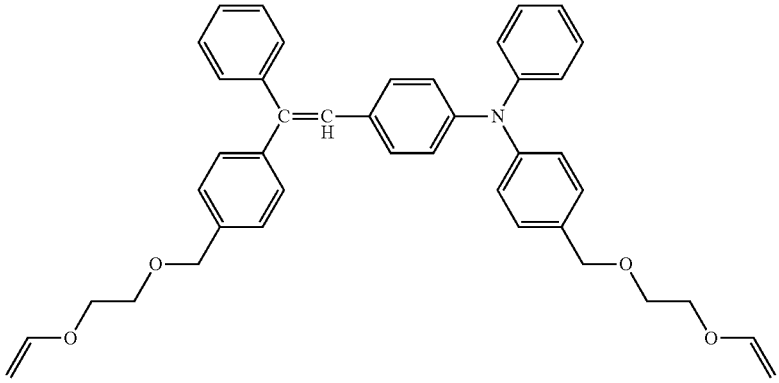
ii-45
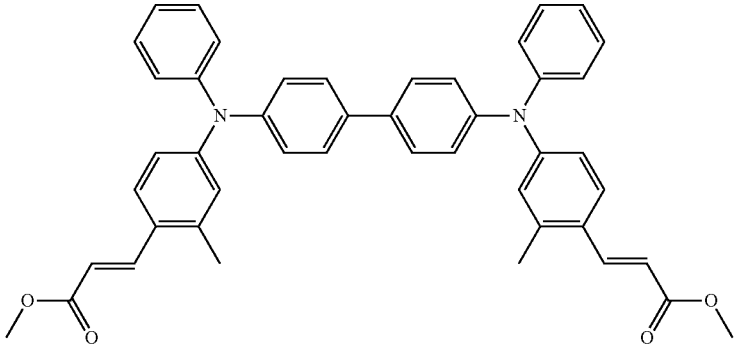

-continued
ii-46
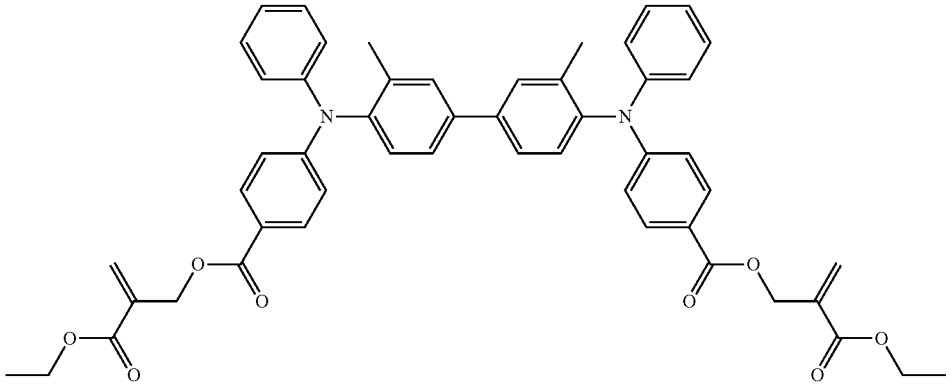
ii-47
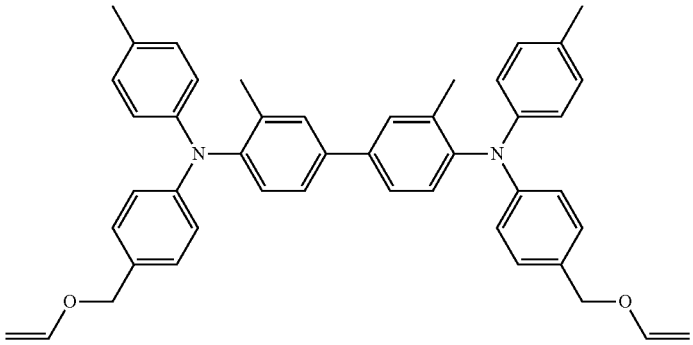
ii-48
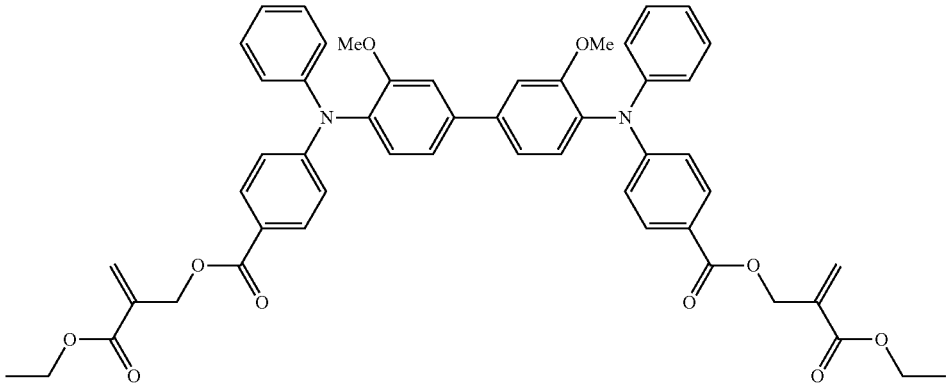
ii-49
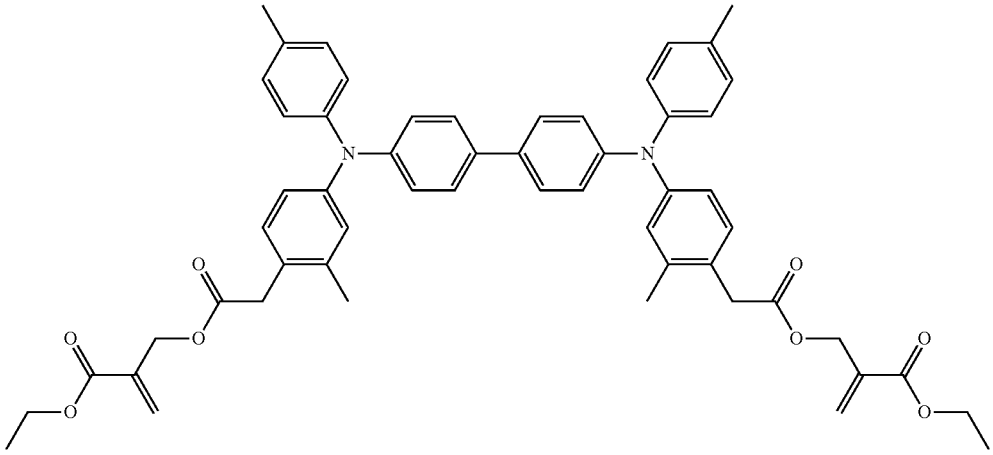

-continued
ii-50
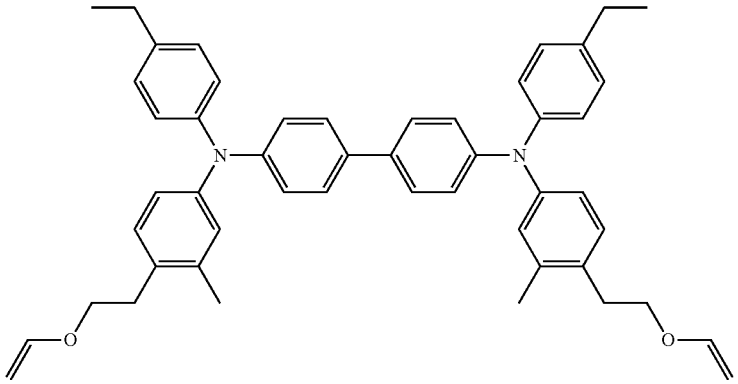
ii-51
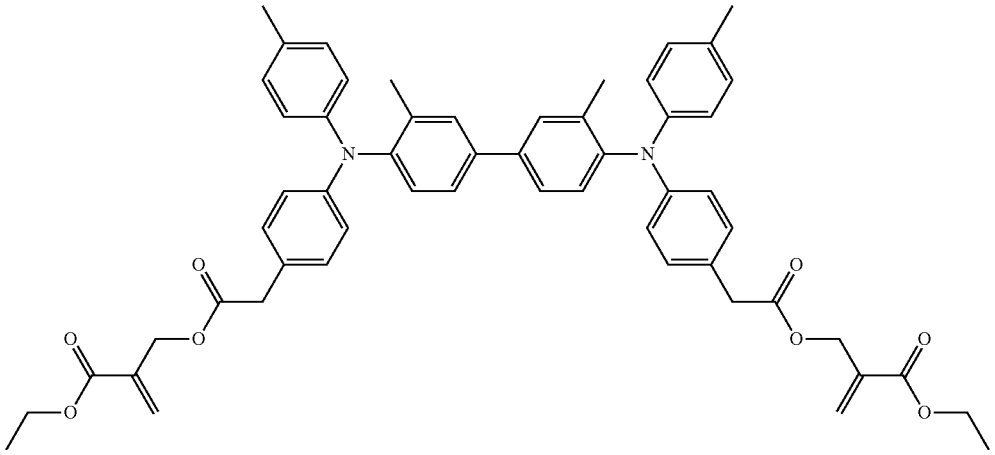
ii-52
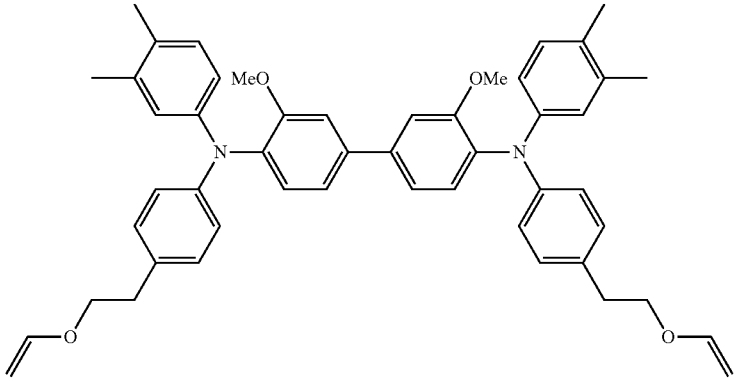

-continued
ii-53
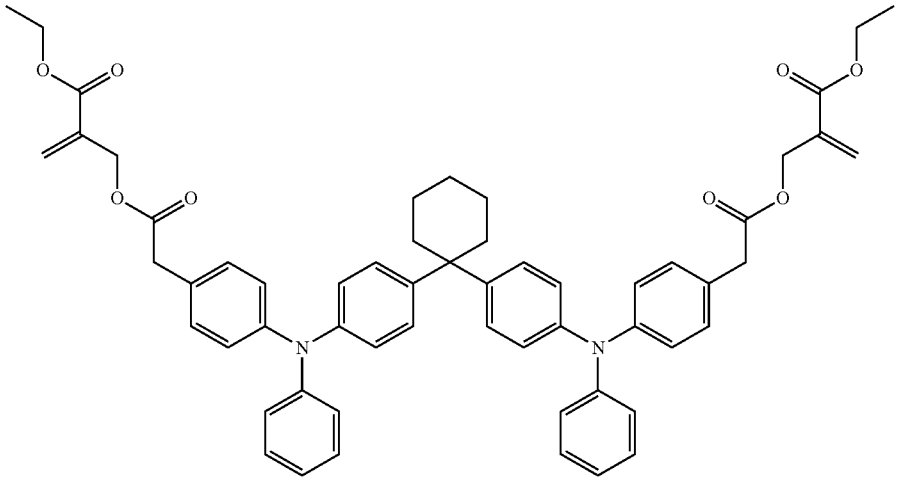
ii-54
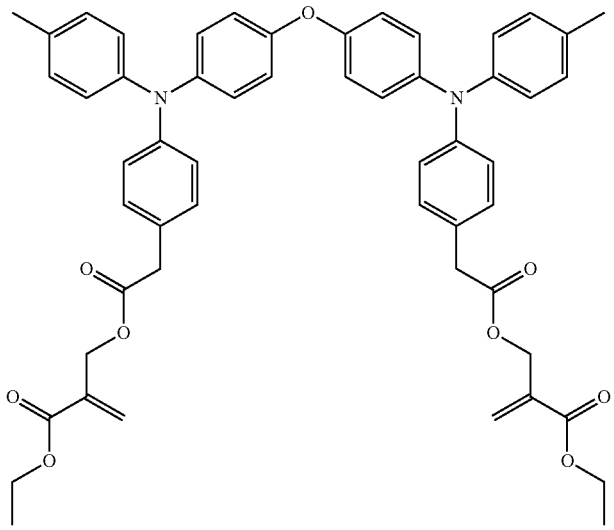
ii-55
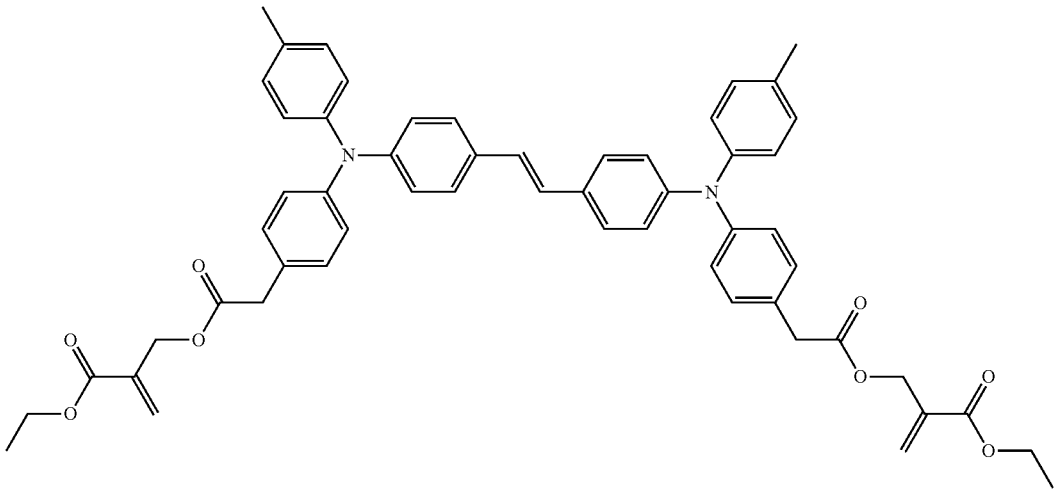

-continued
ii-56
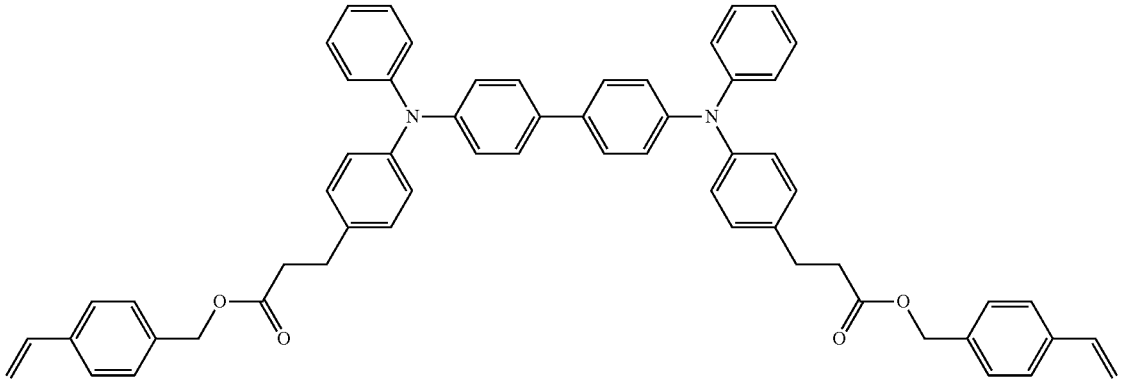
iii-1
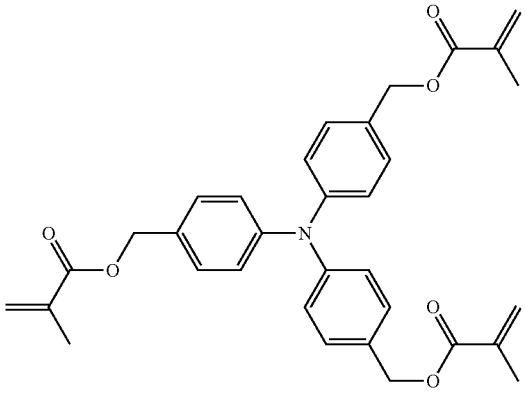
iii-2
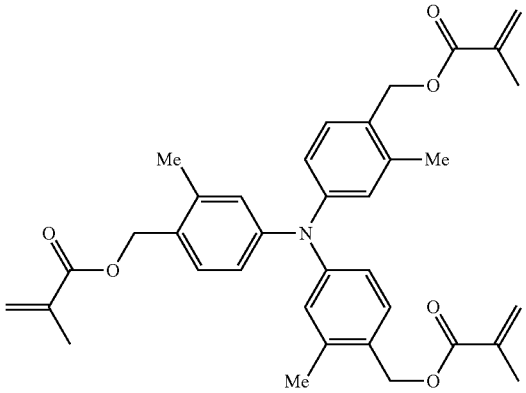
iii-3
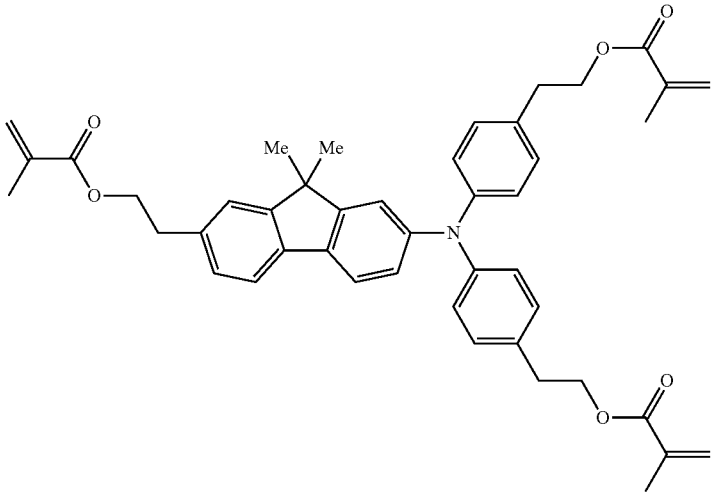

-continued
iii-4
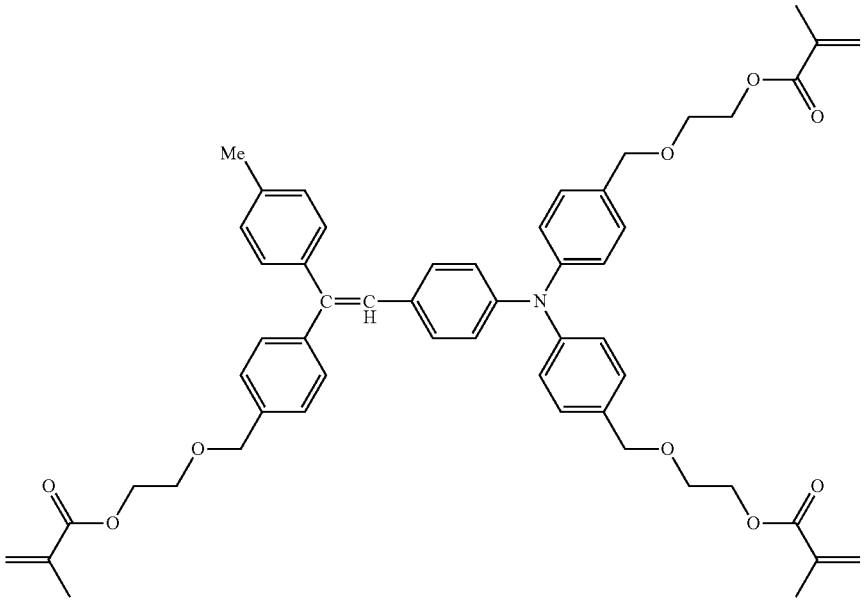
iii-5
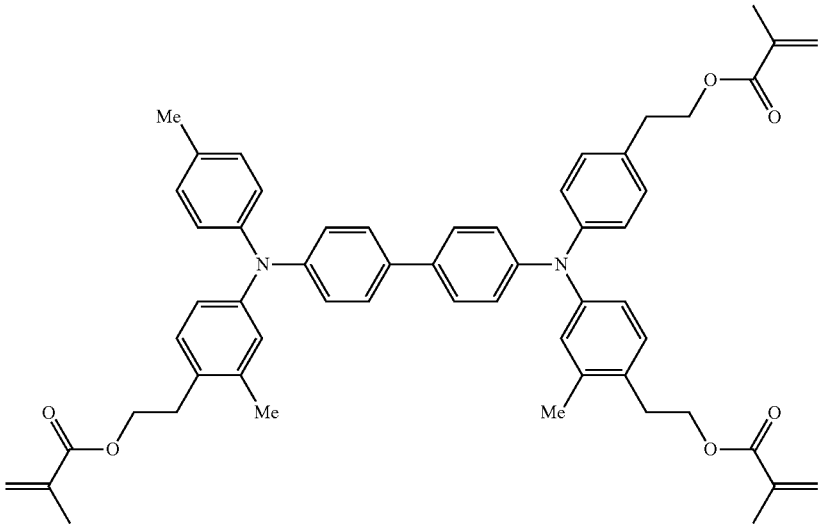
iii-6
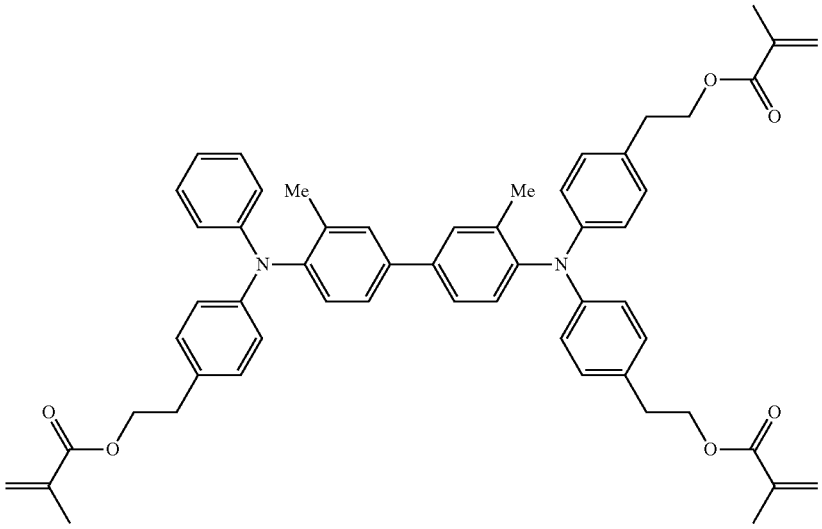

-continued
iii-7
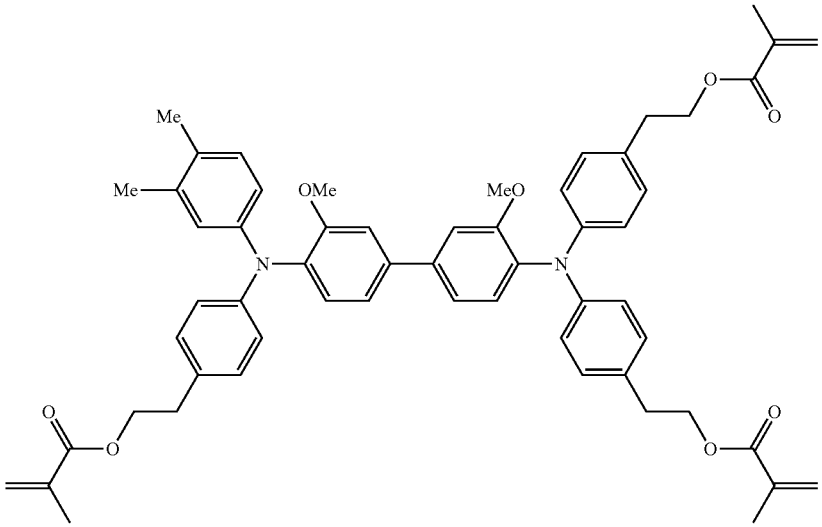
iii-8
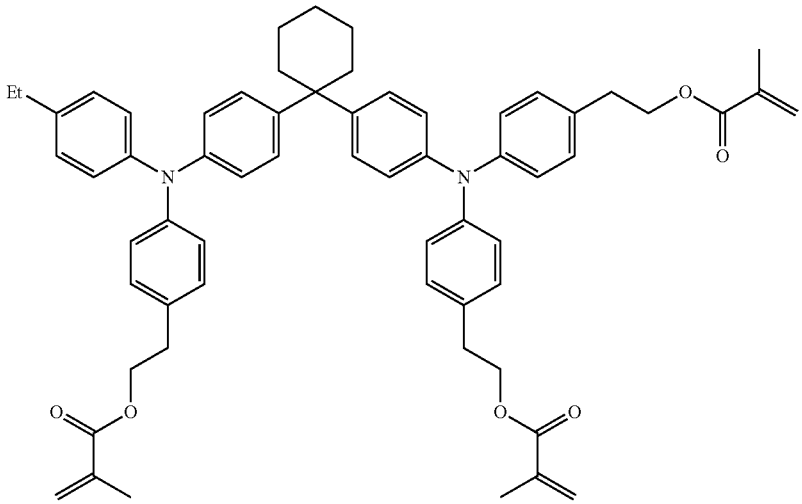
iii-9
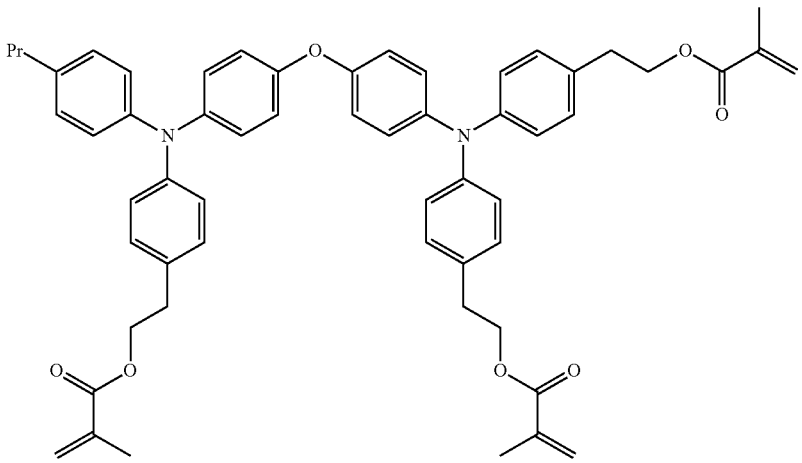

-continued
iii-10
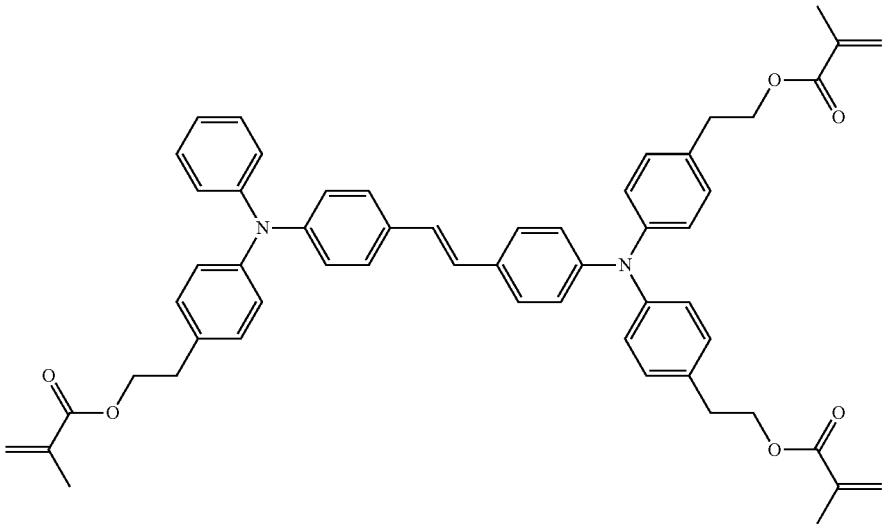
iii-11
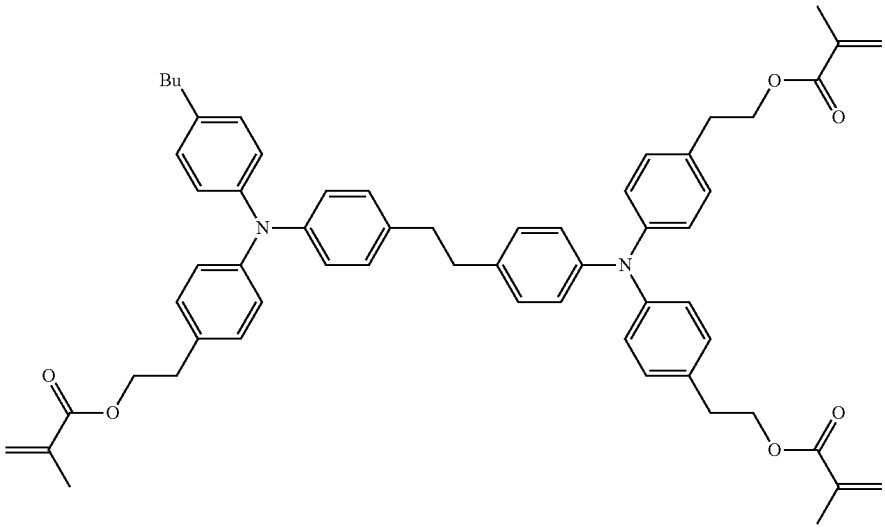
iii-12
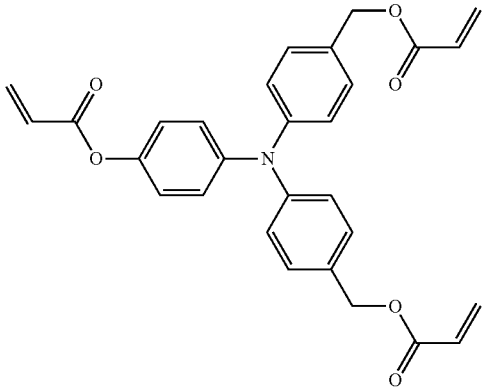
iii-13
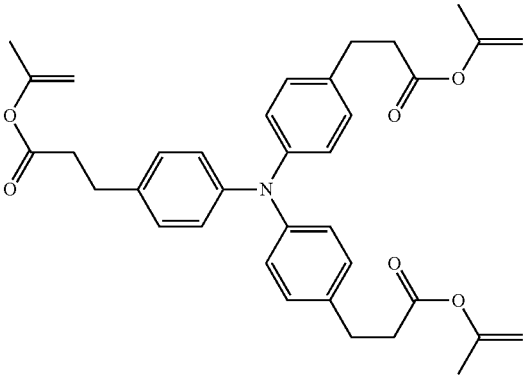

-continued
iii-14
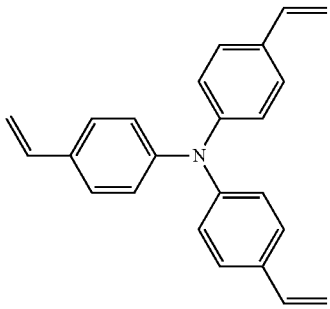
iii-15
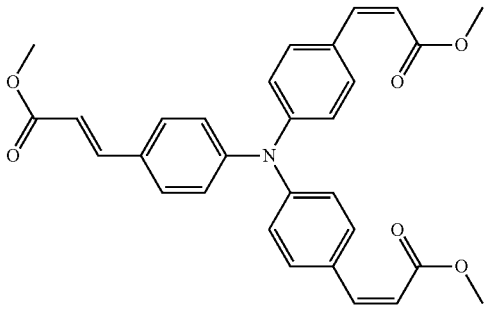
iii-16
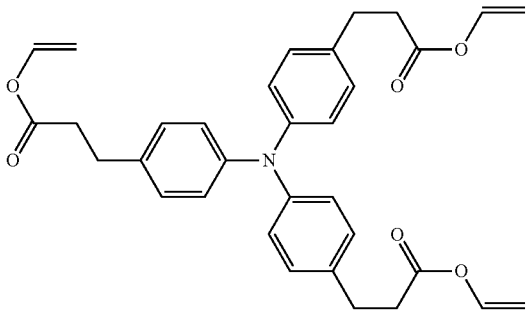
iii-17
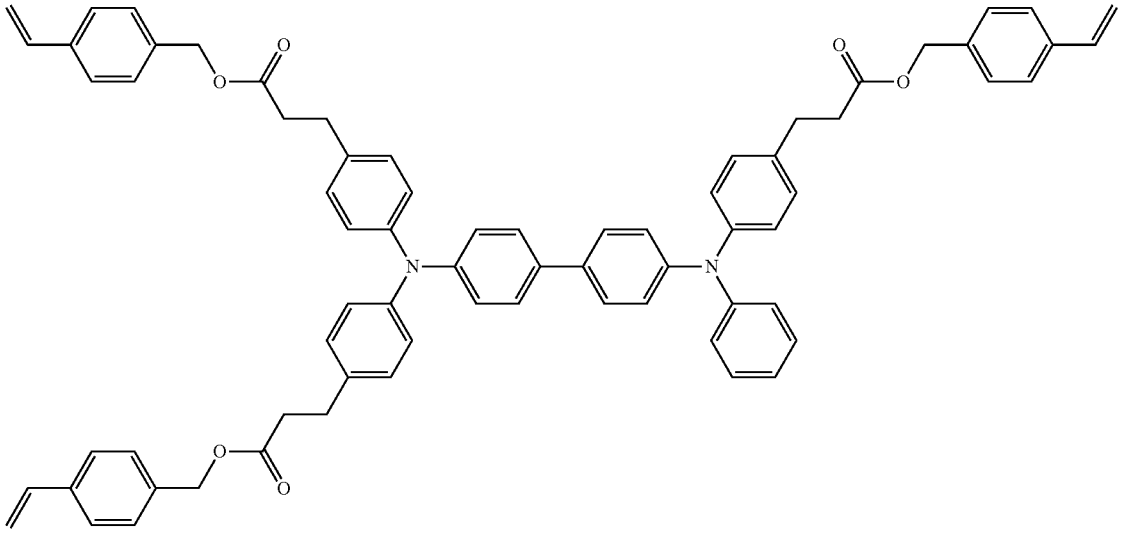

-continued
iii-18
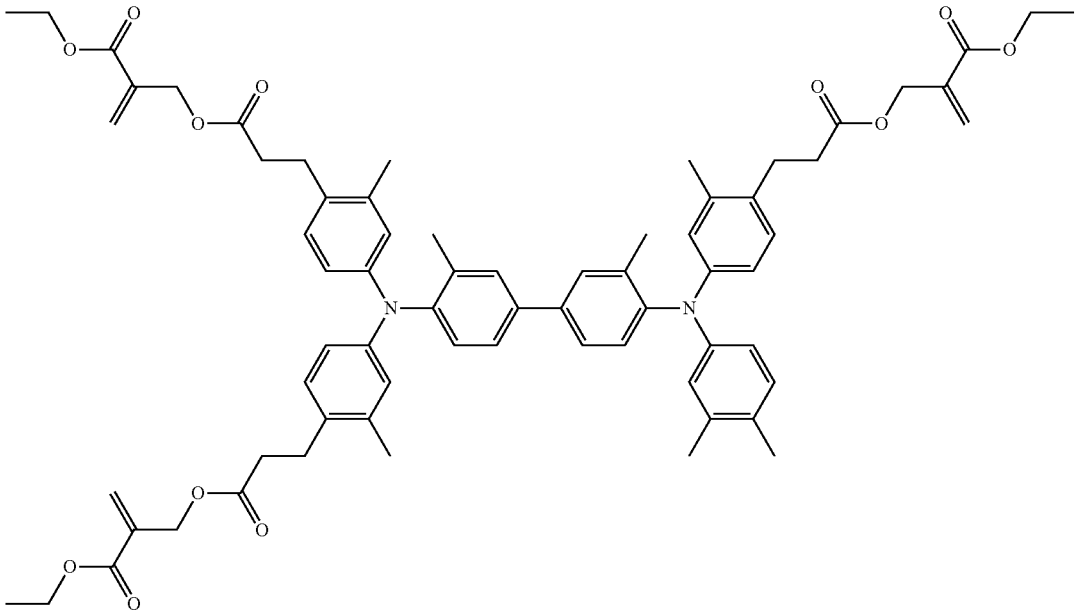
iii-19
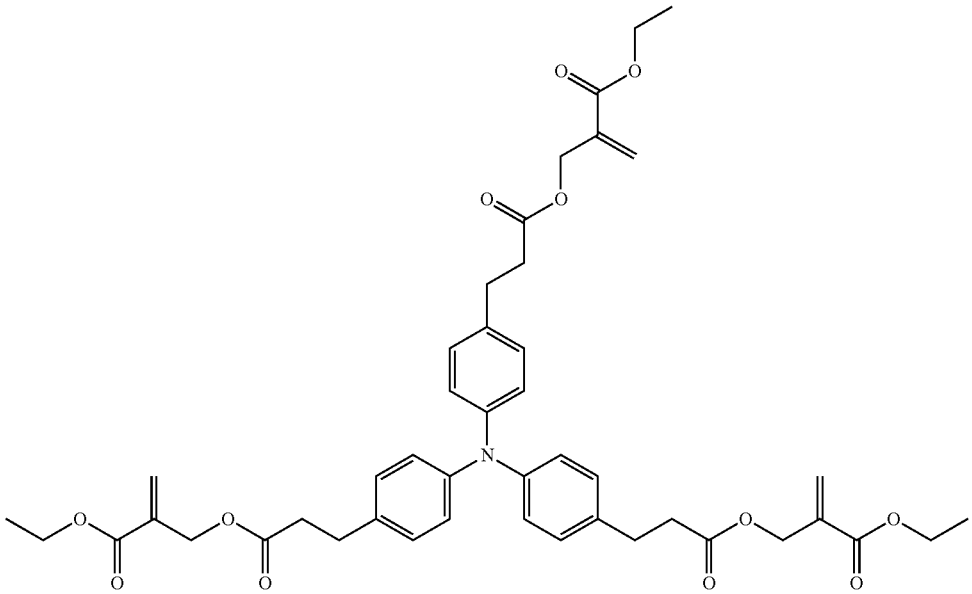
iv-1
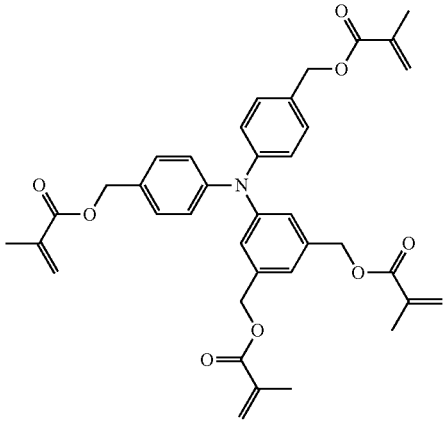
iv-2
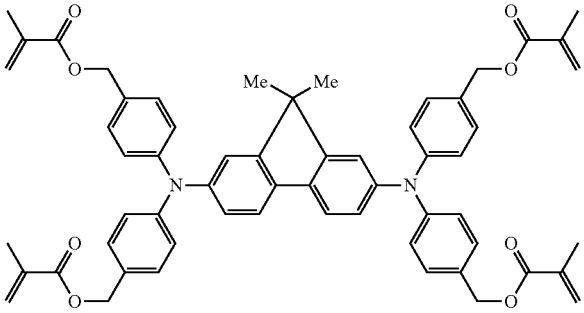

-continued
iv-3
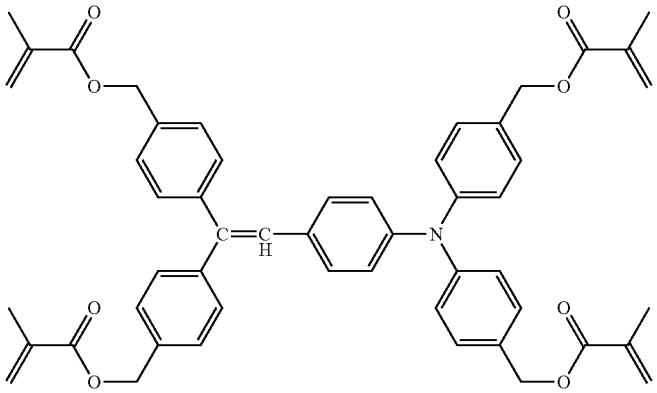
iv-4
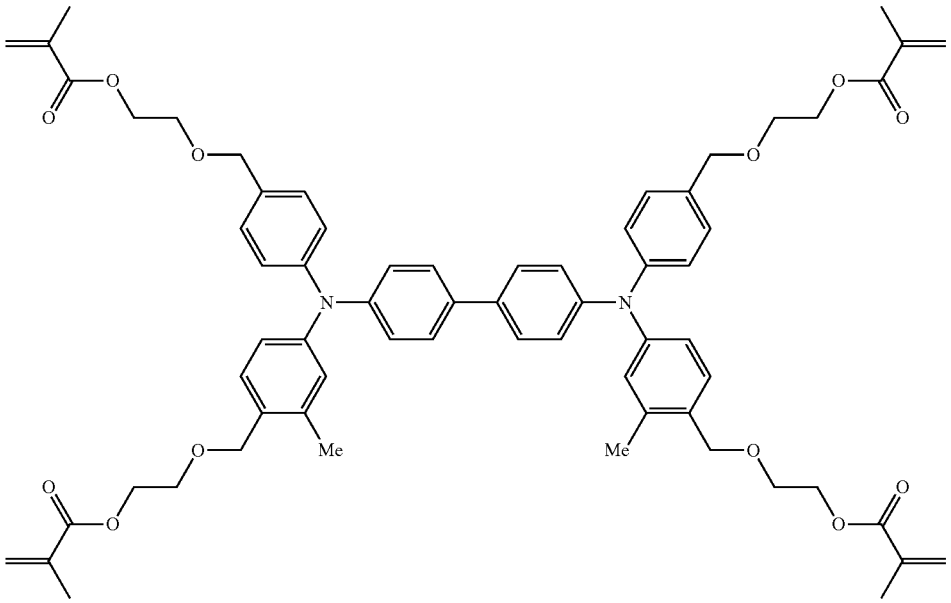
iv-5
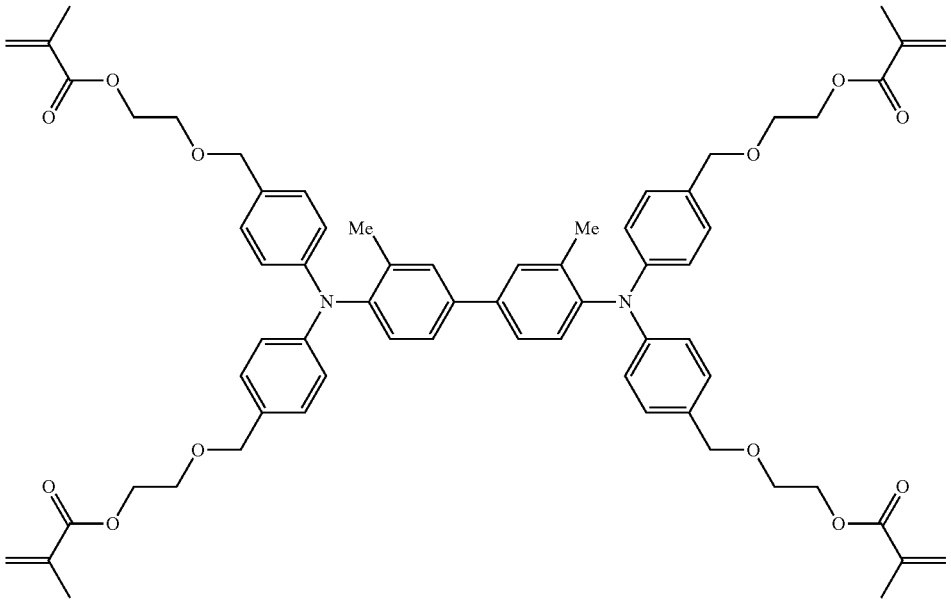

-continued
iv-6
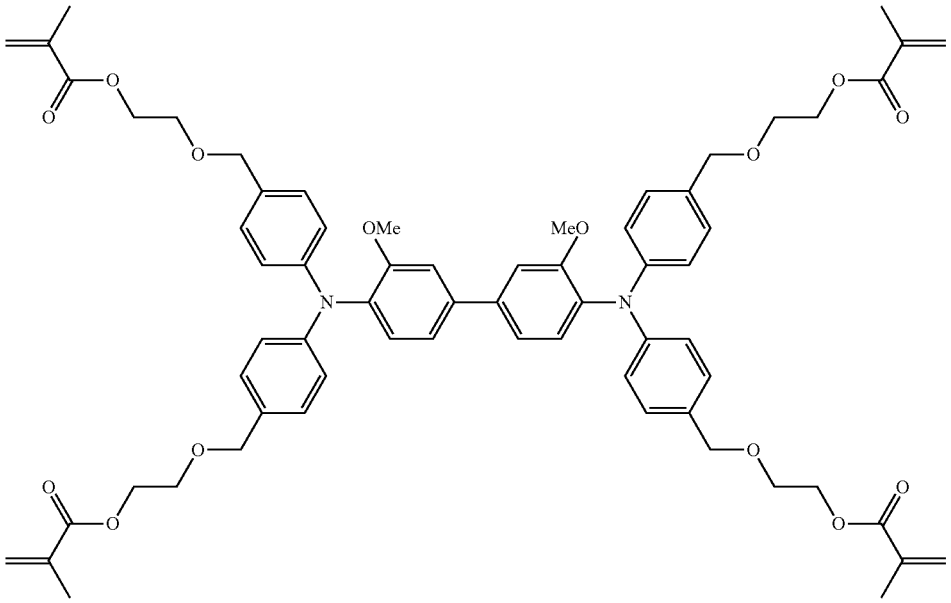
iv-7
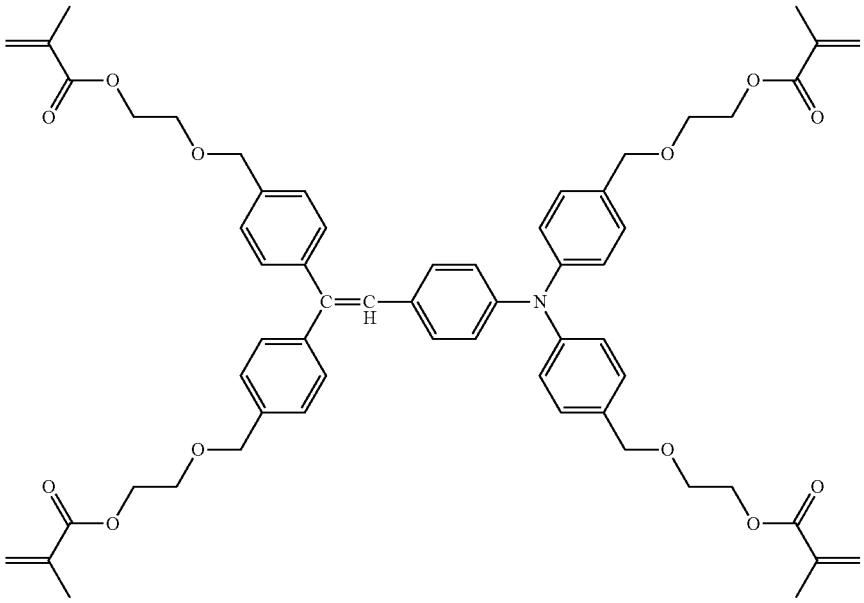

-continued
iv-8
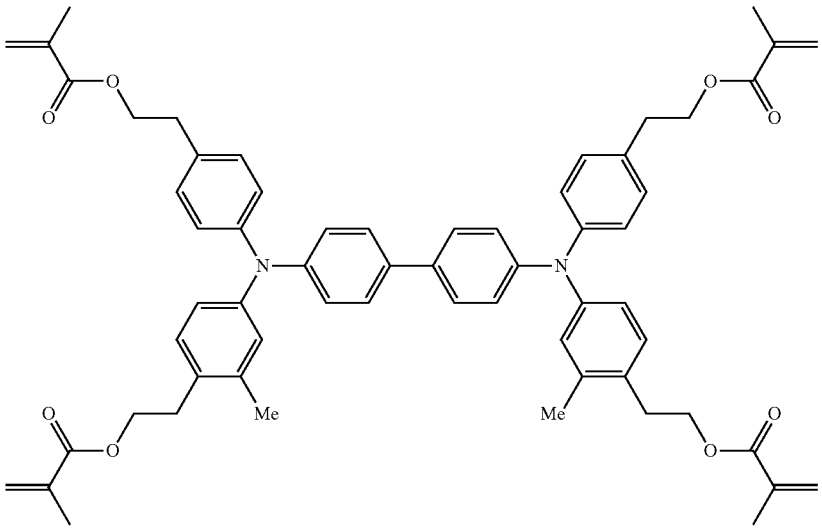
iv-9
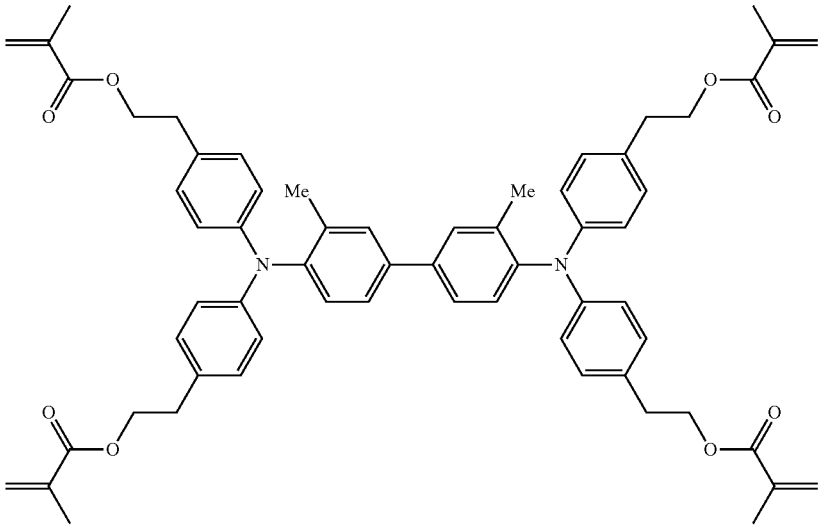
iv-10
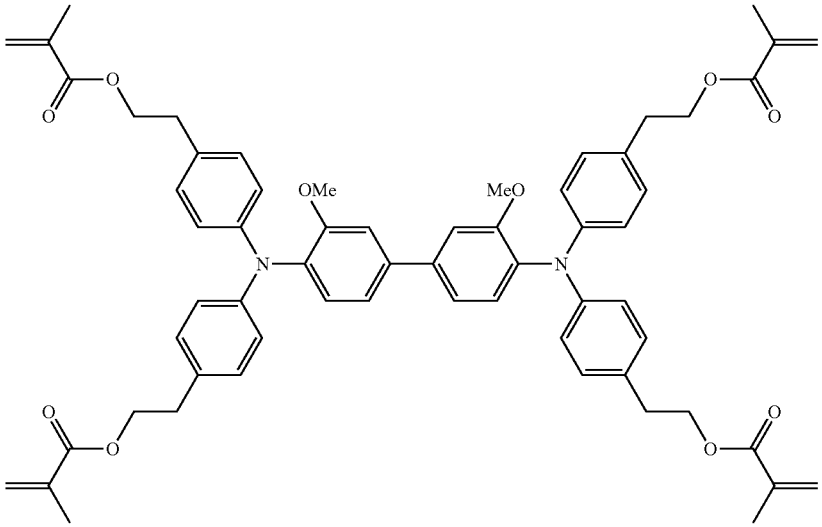

-continued
iv-11
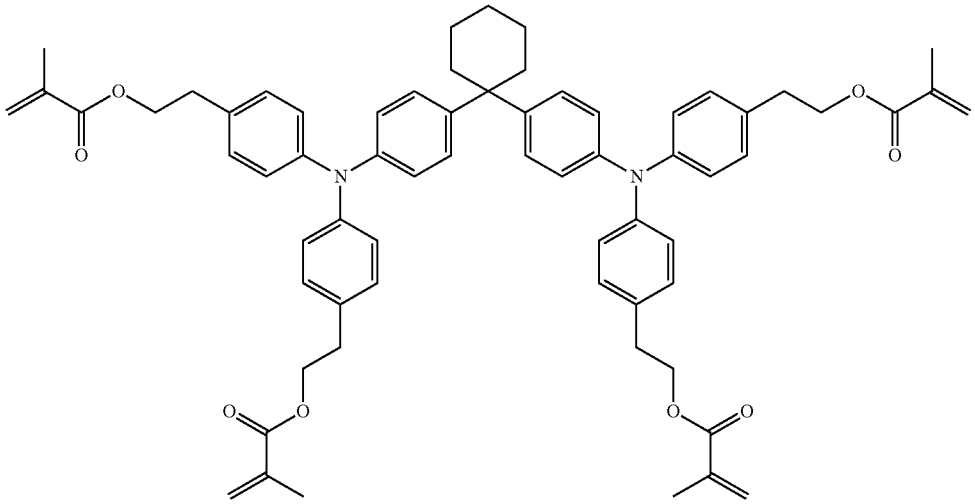
iv-12
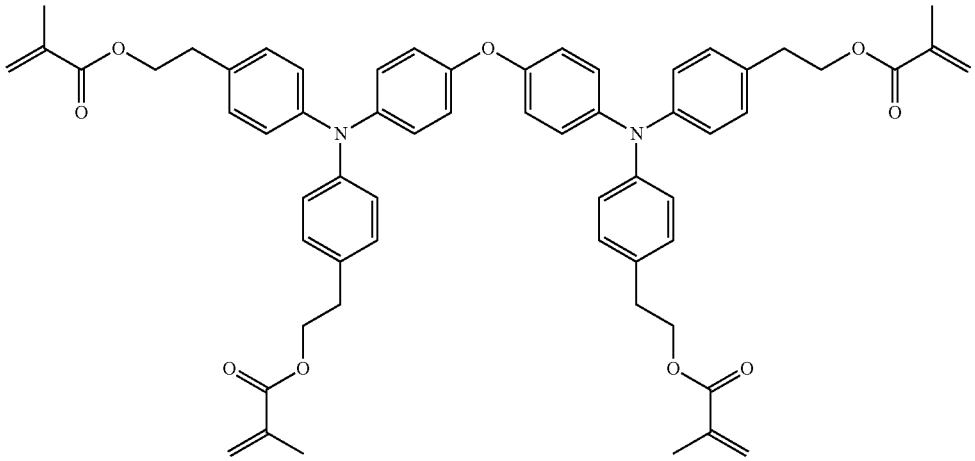
iv-13
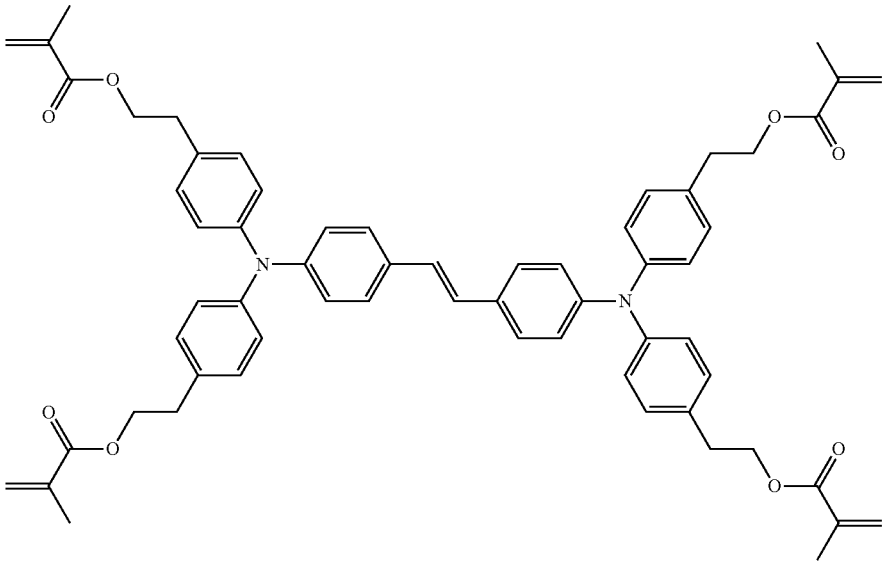

-continued
iv-14
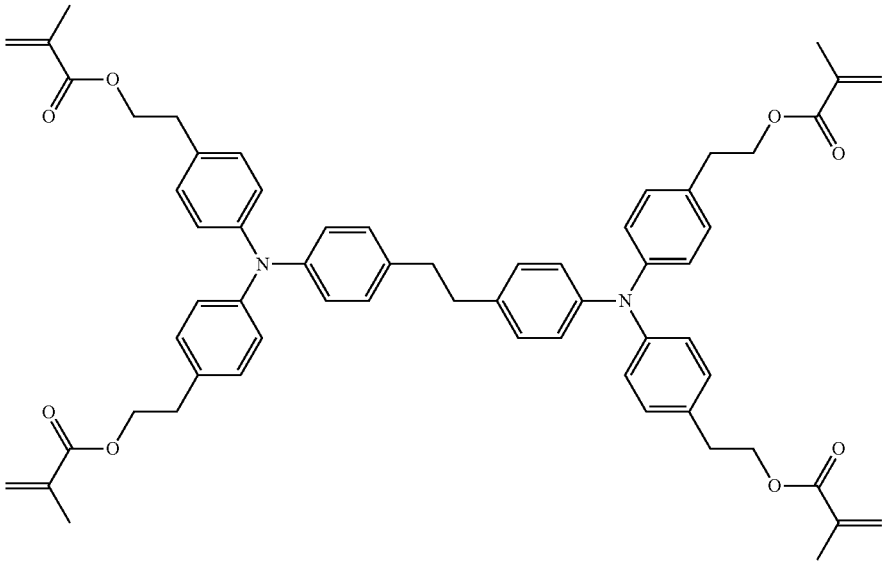
iv-15
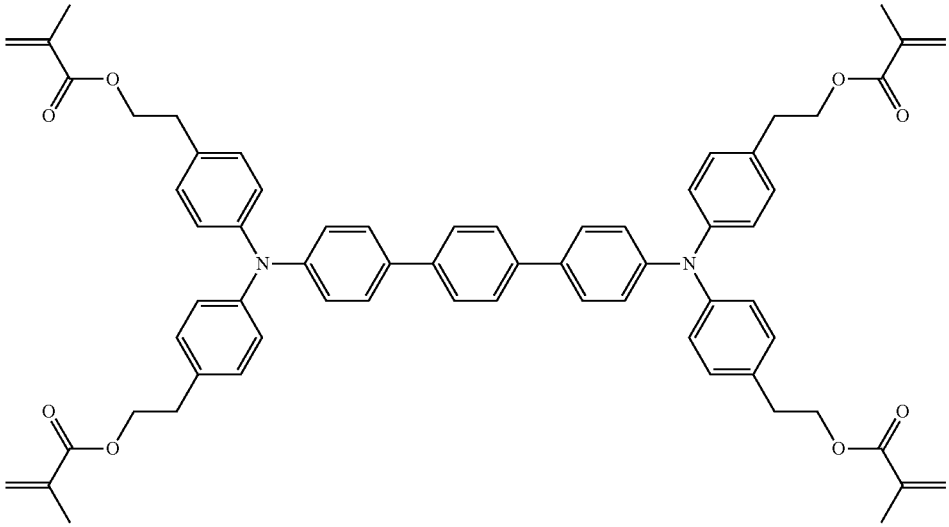
iv-16
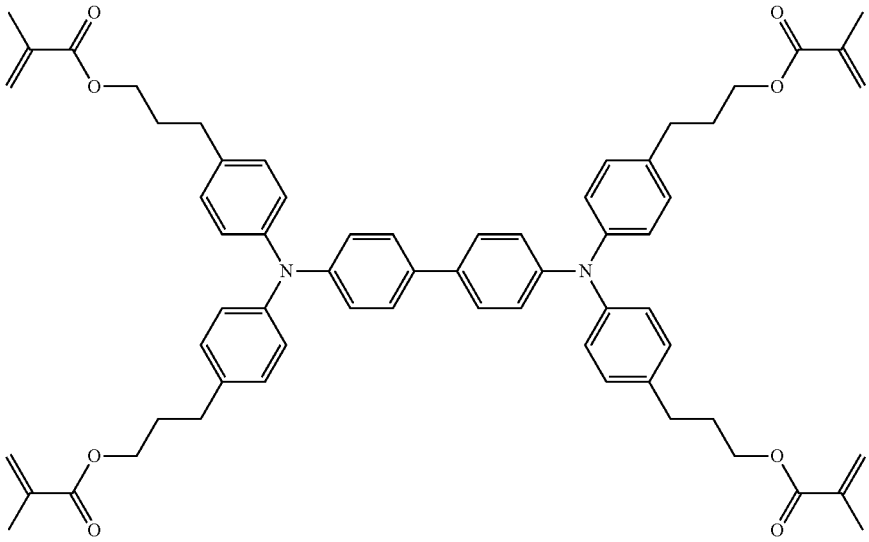

-continued
iv-17
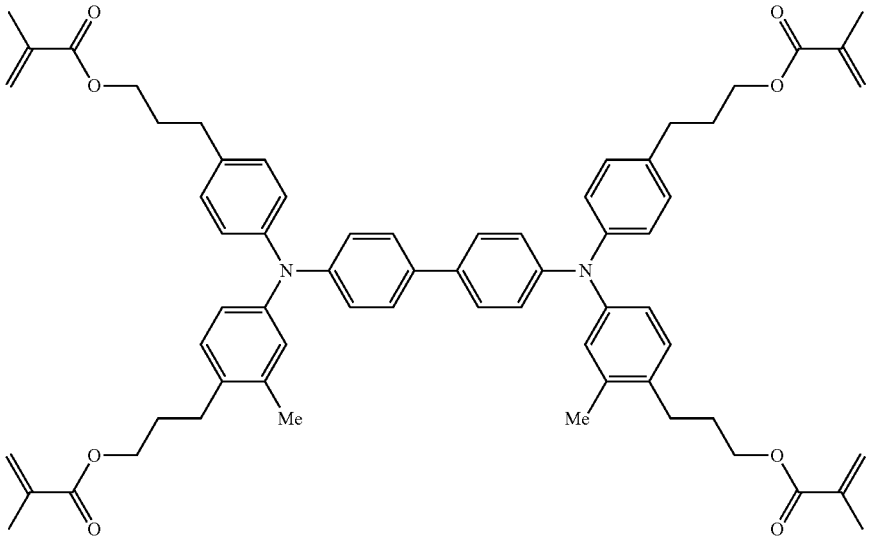
iv-18
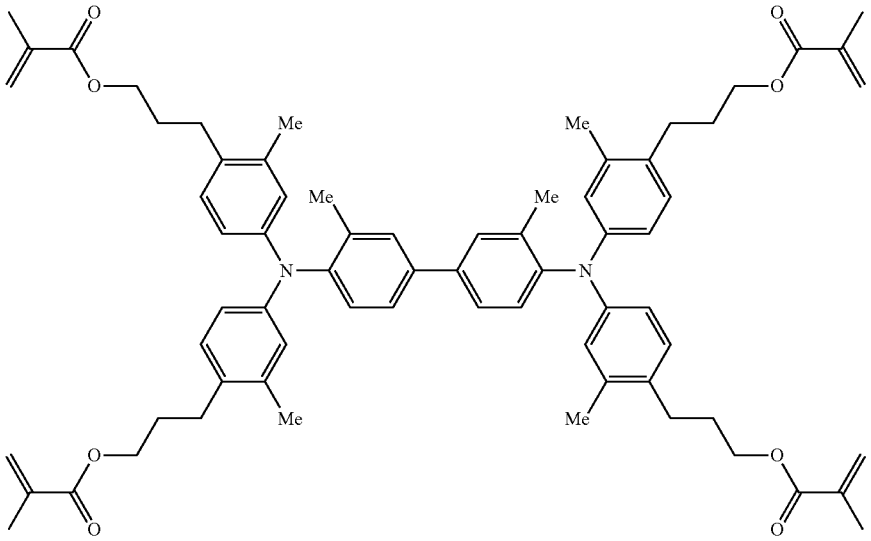

-continued
iv-19
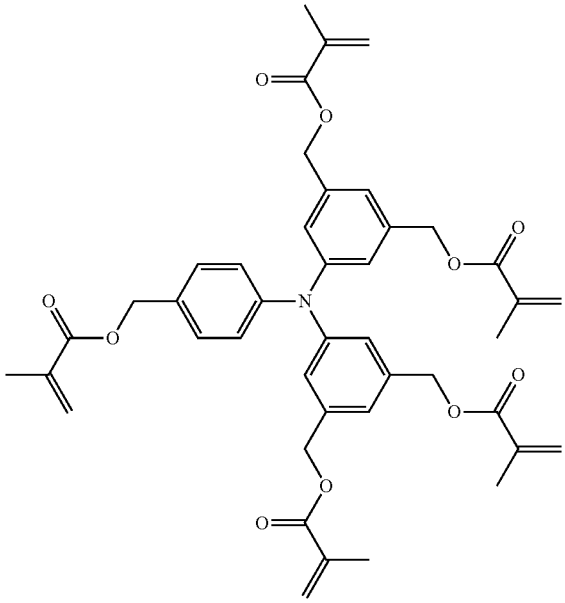
iv-20
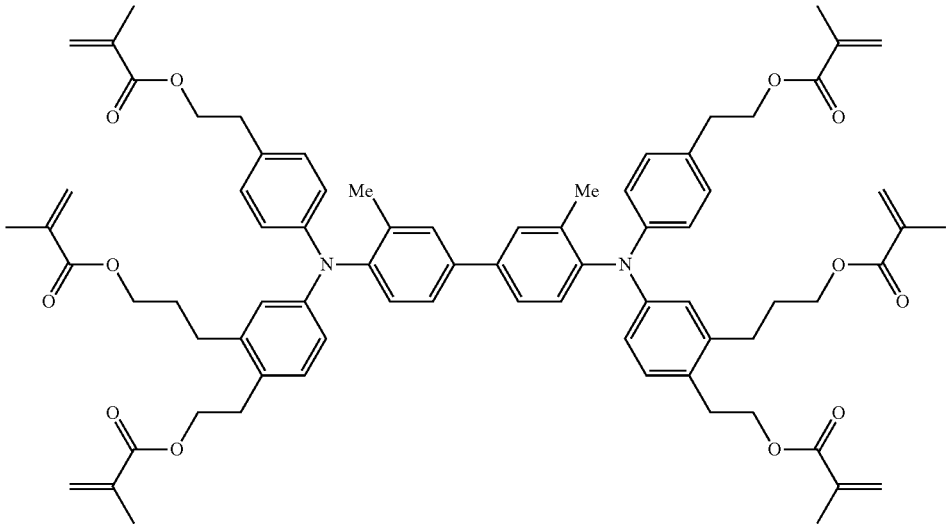

-continued
iv-21
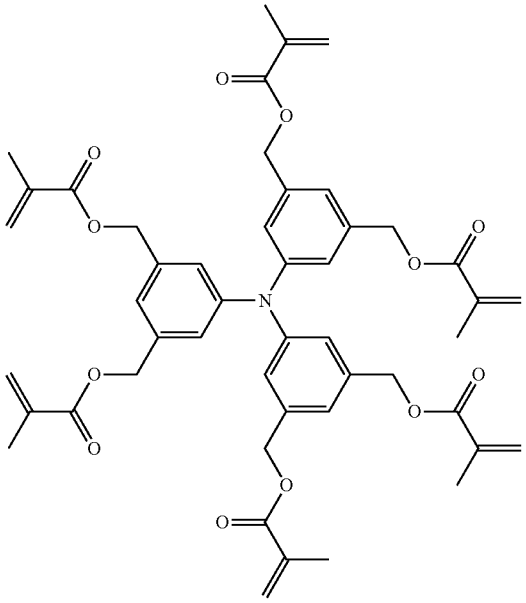
iv-22
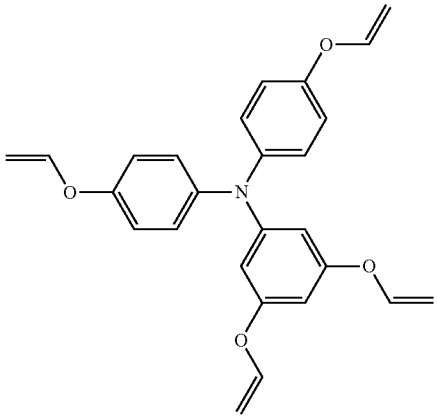
iv-23
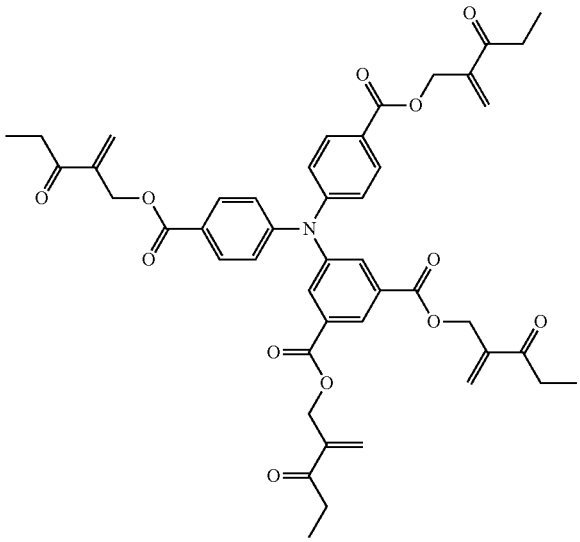
iv-24
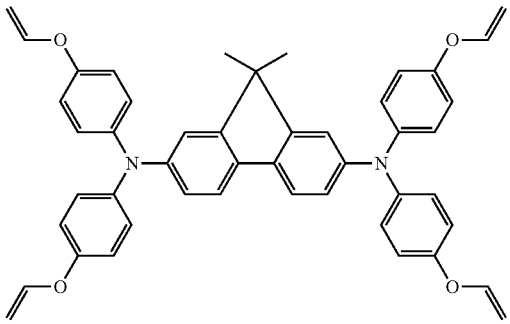

-continued
iv-25
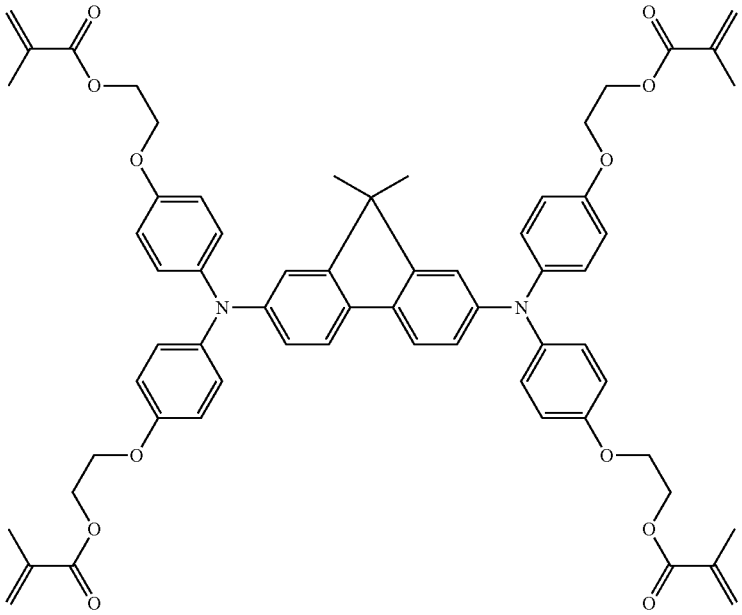
iv-26
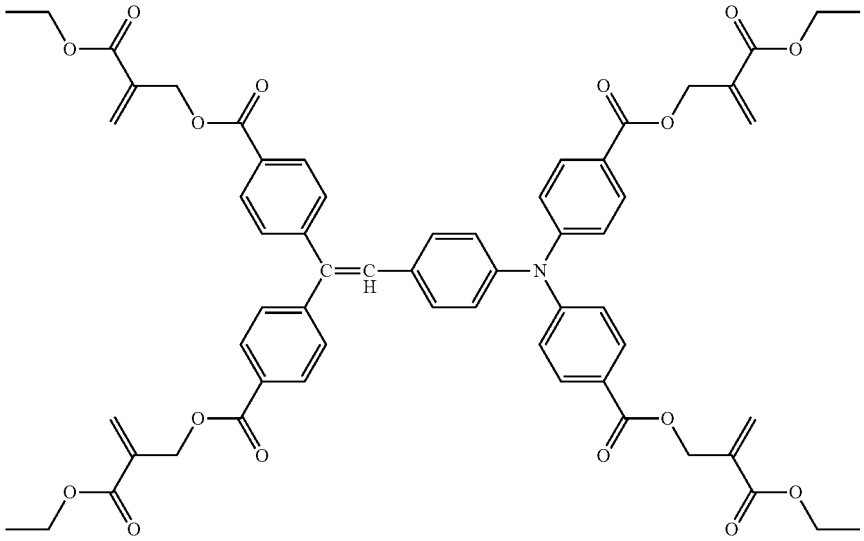

-continued
iv-27
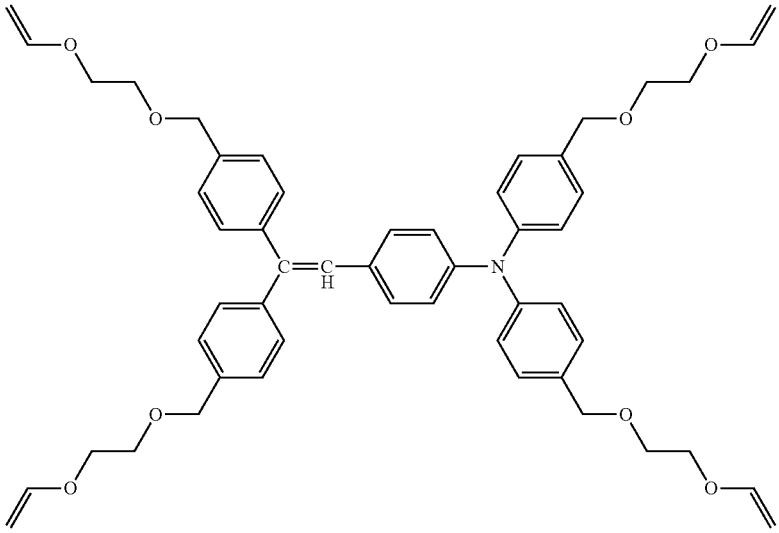
iv-28
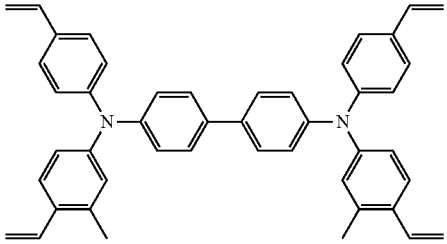
iv-29
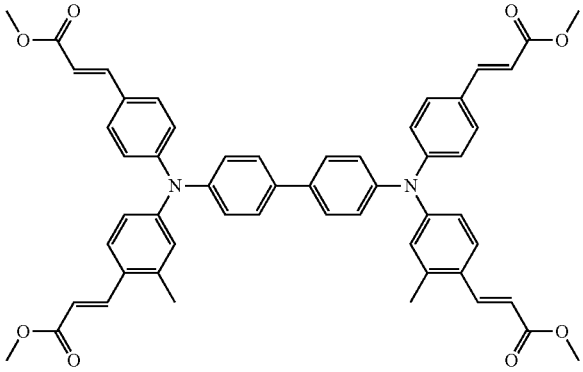
iv-30
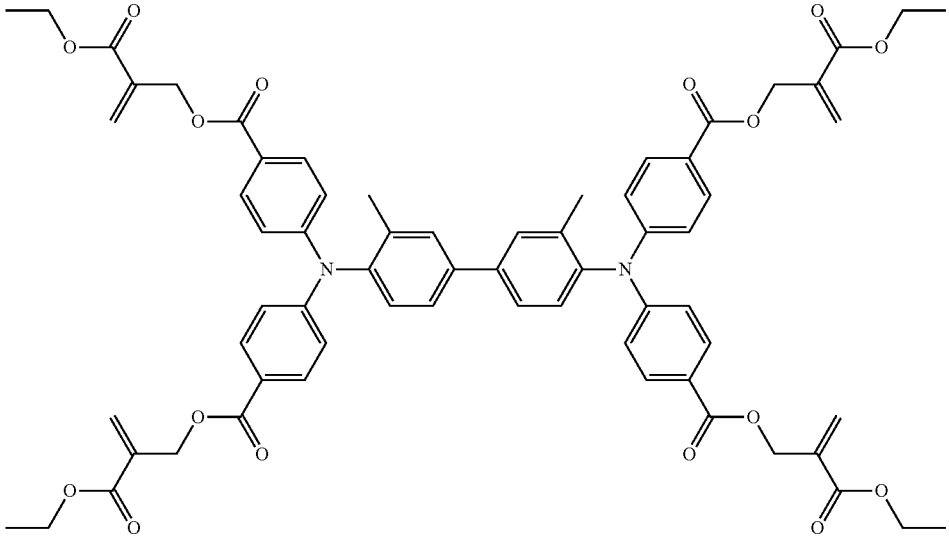

-continued
iv-31
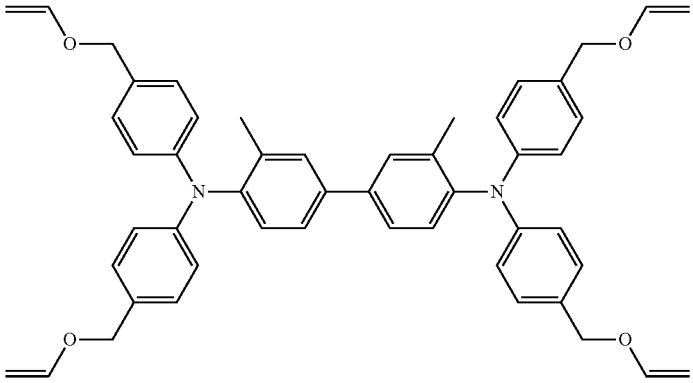
iv-32
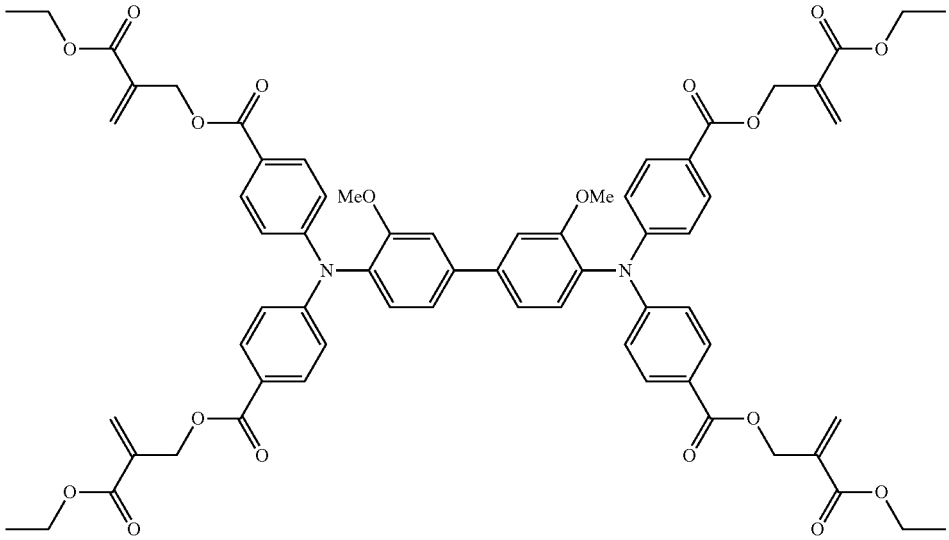
iv-33
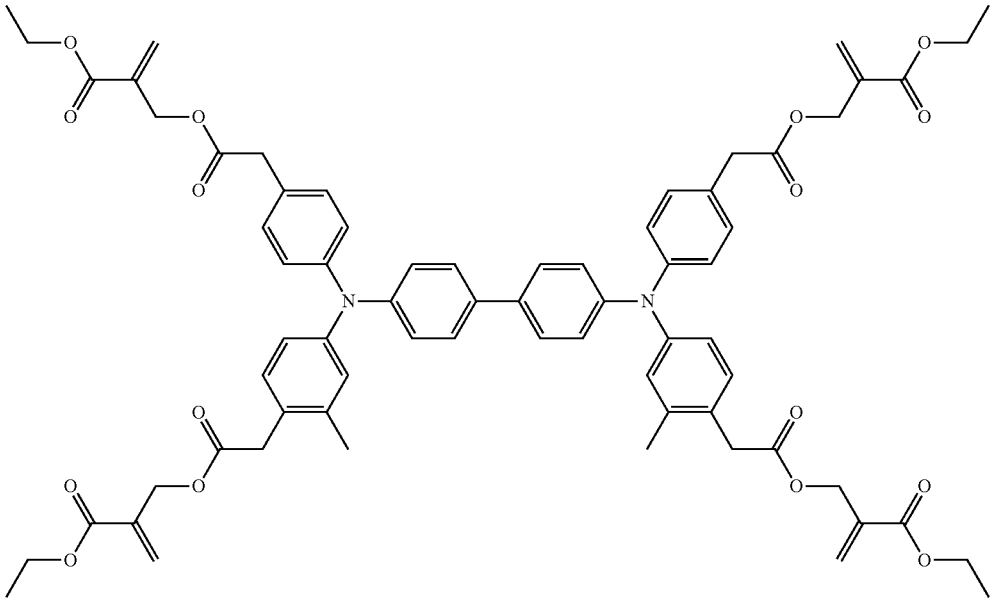

-continued
iv-34
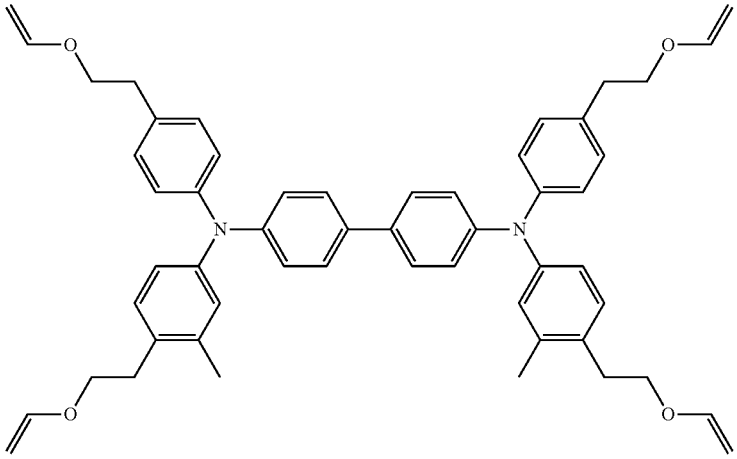
iv-35
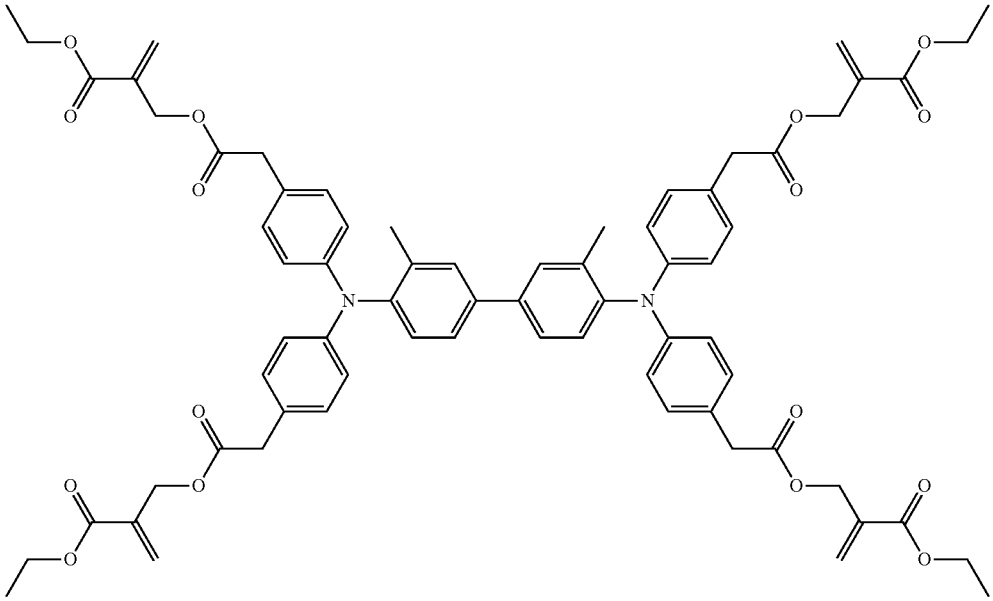
iv-36
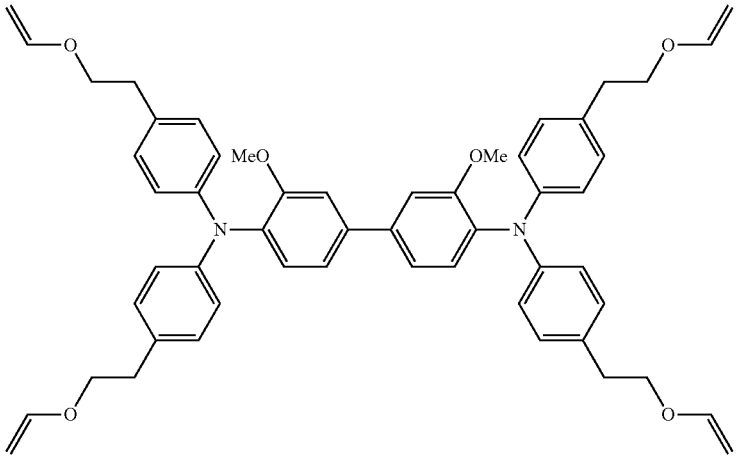

-continued
iv-37
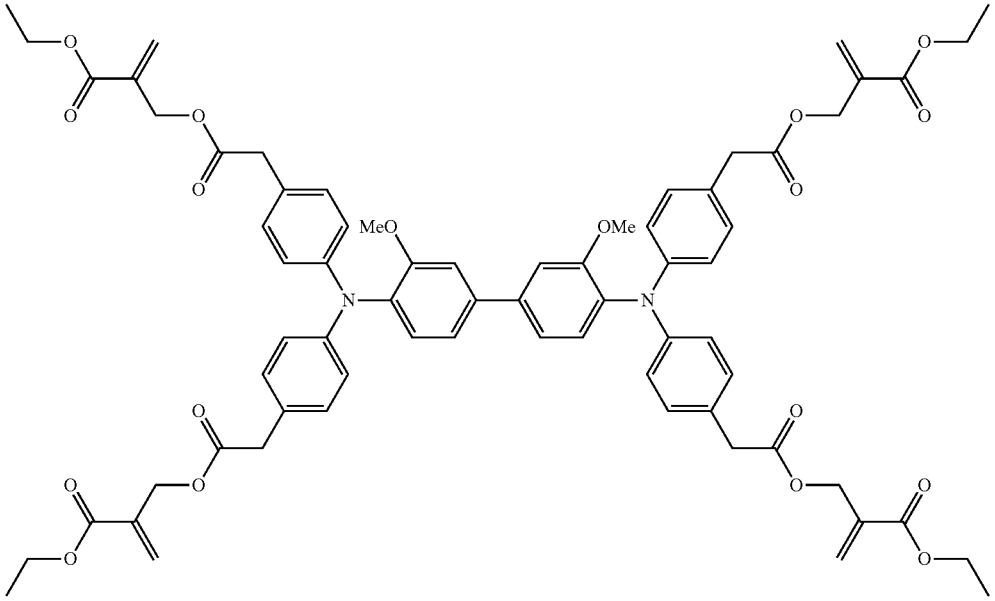
iv-38
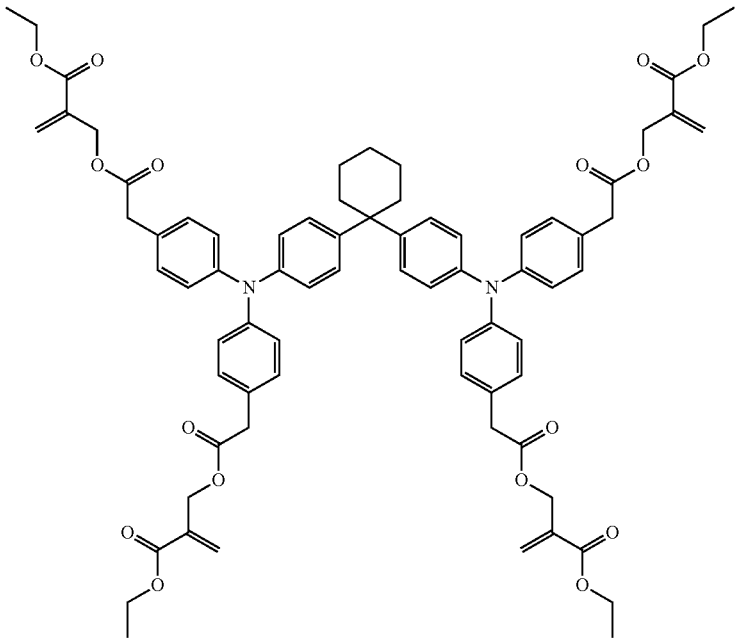

-continued
iv-39
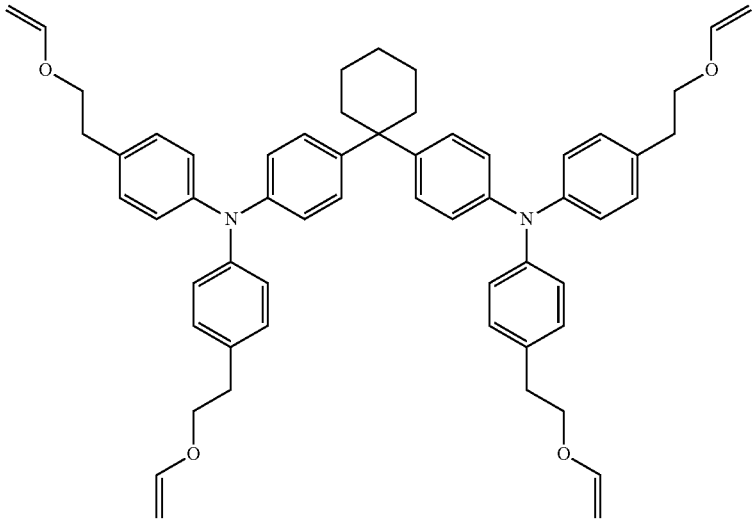
iv-40
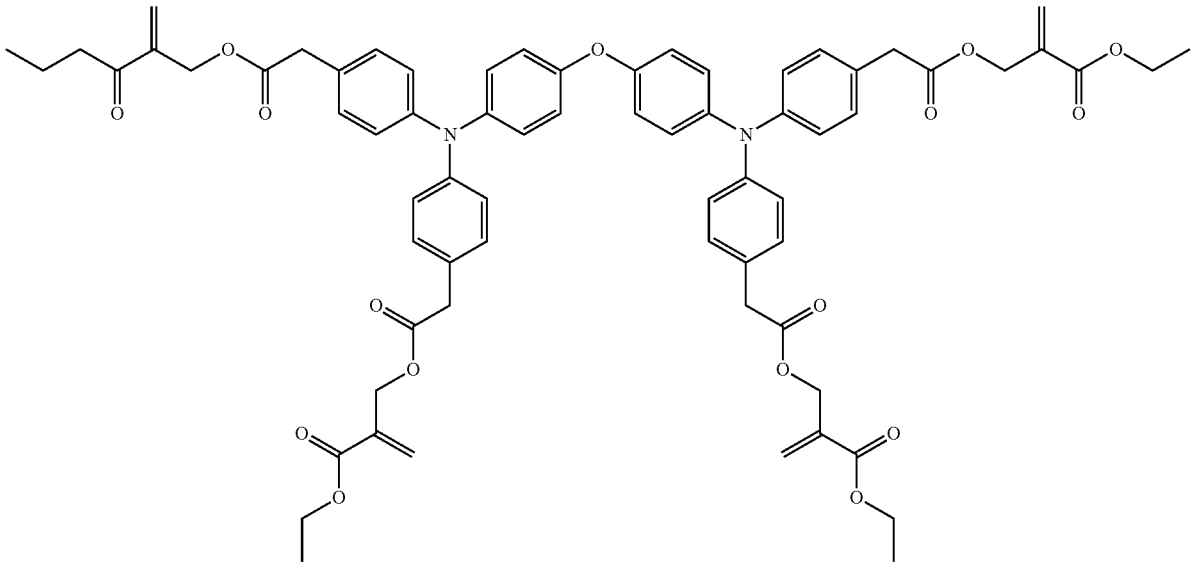

-continued
iv-41
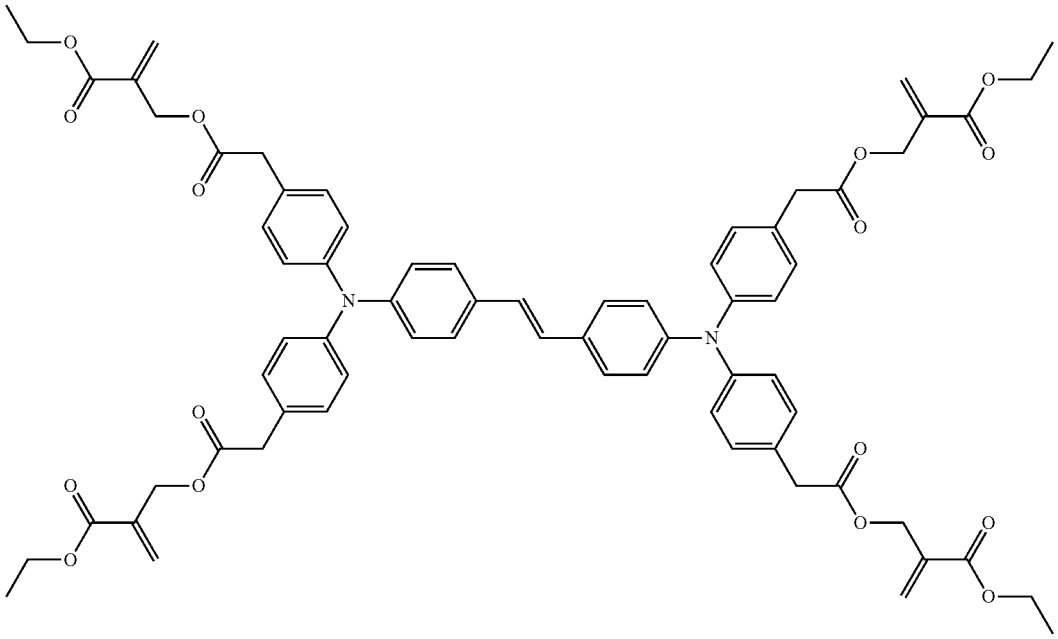
iv-42
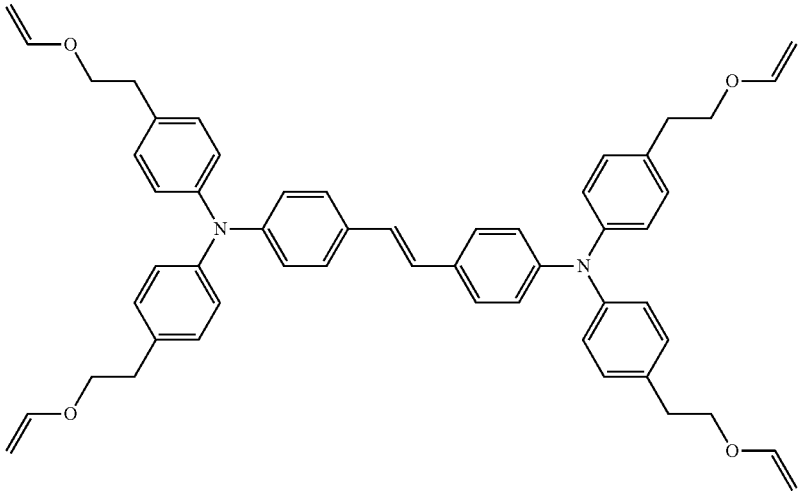

-continued
iv-43
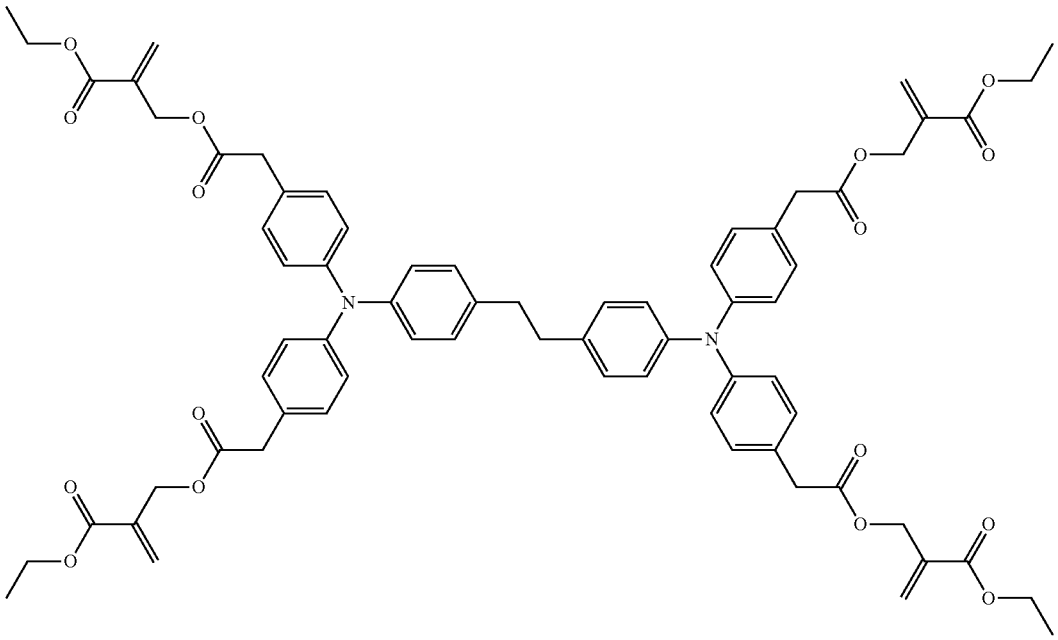
iv-44
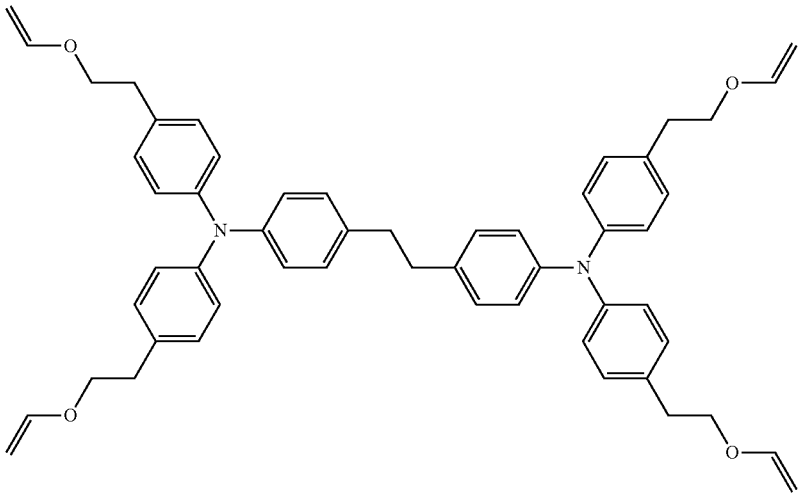

-continued
iv-45
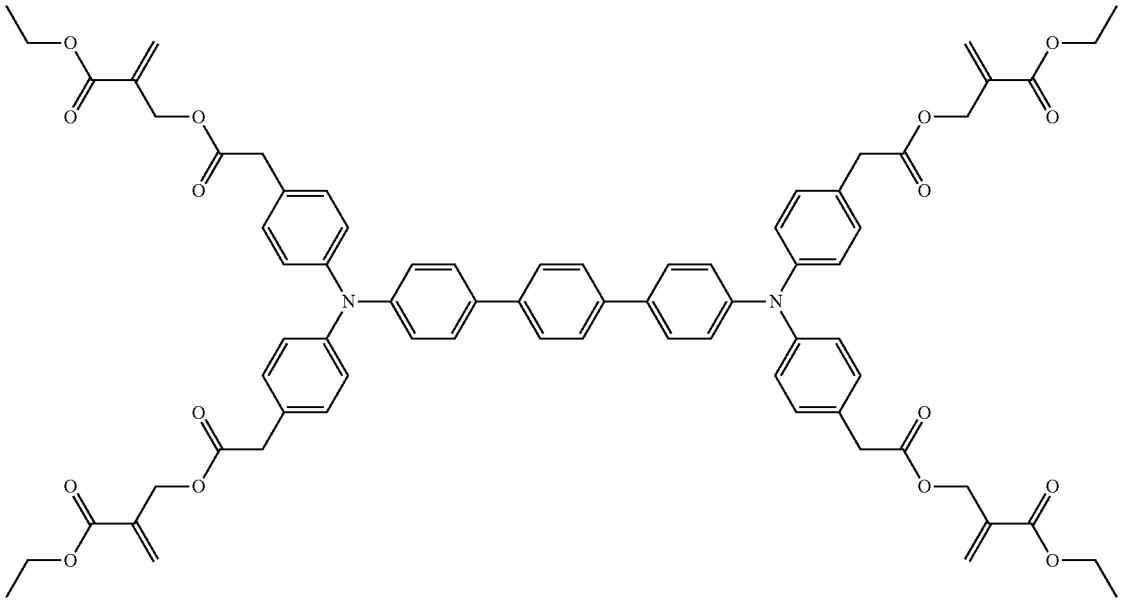
iv-46
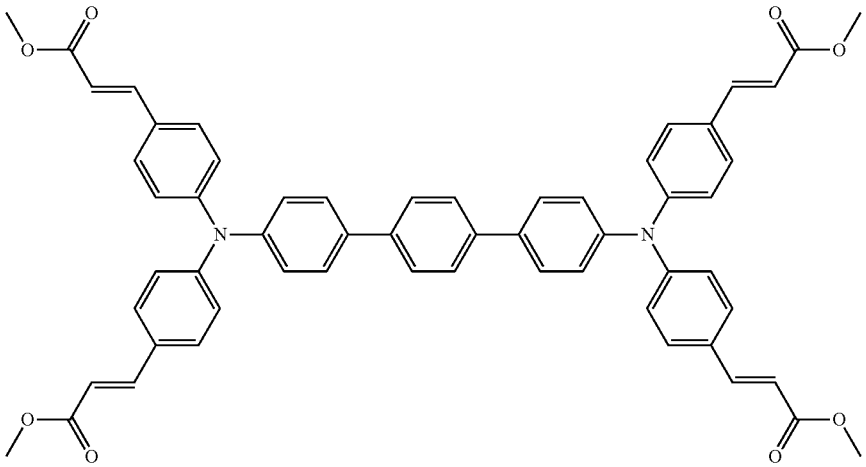
iv-47
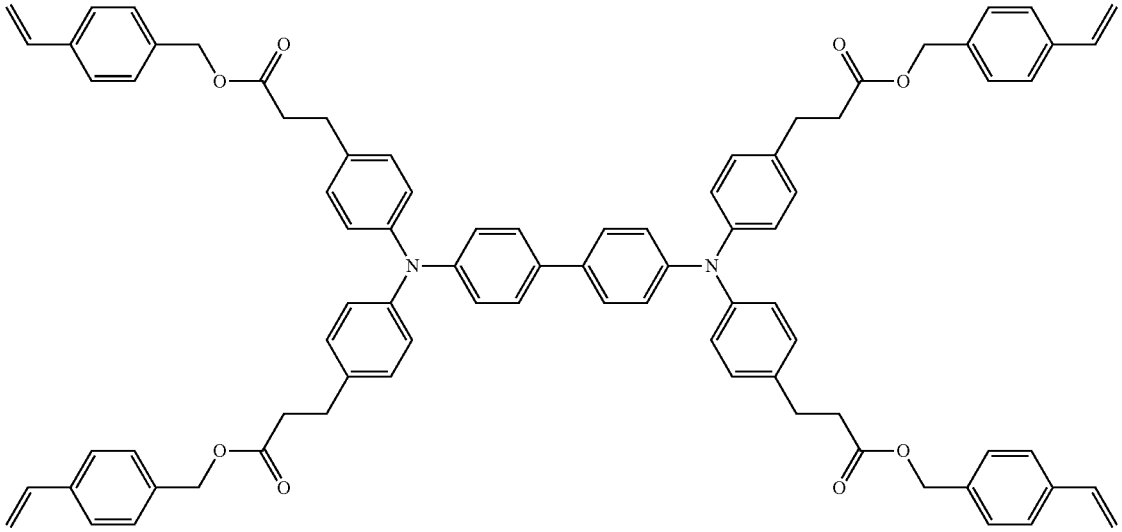

-continued
iv-48
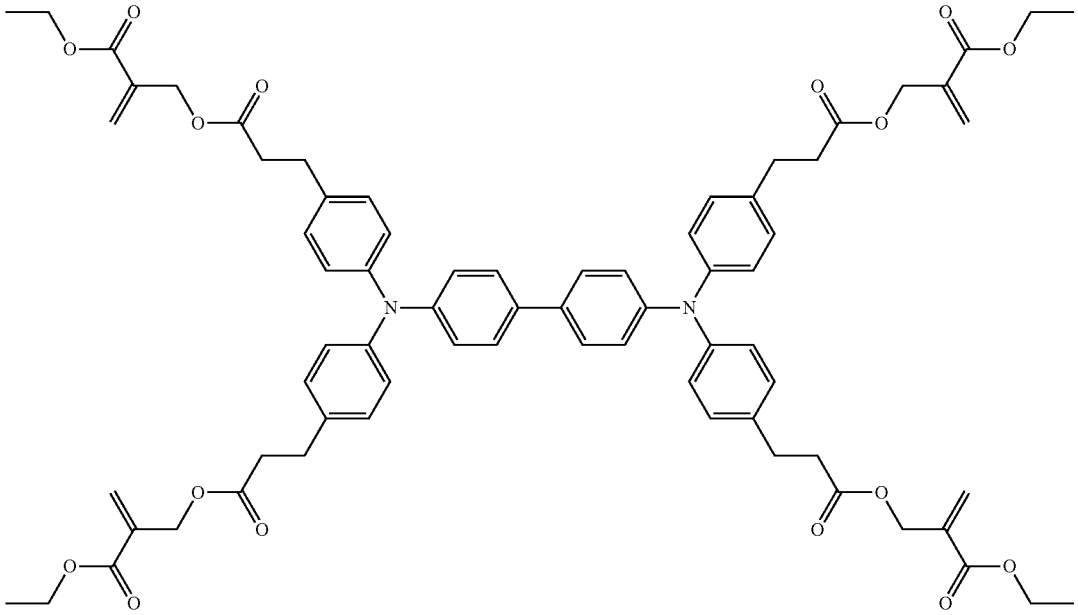
iv-49
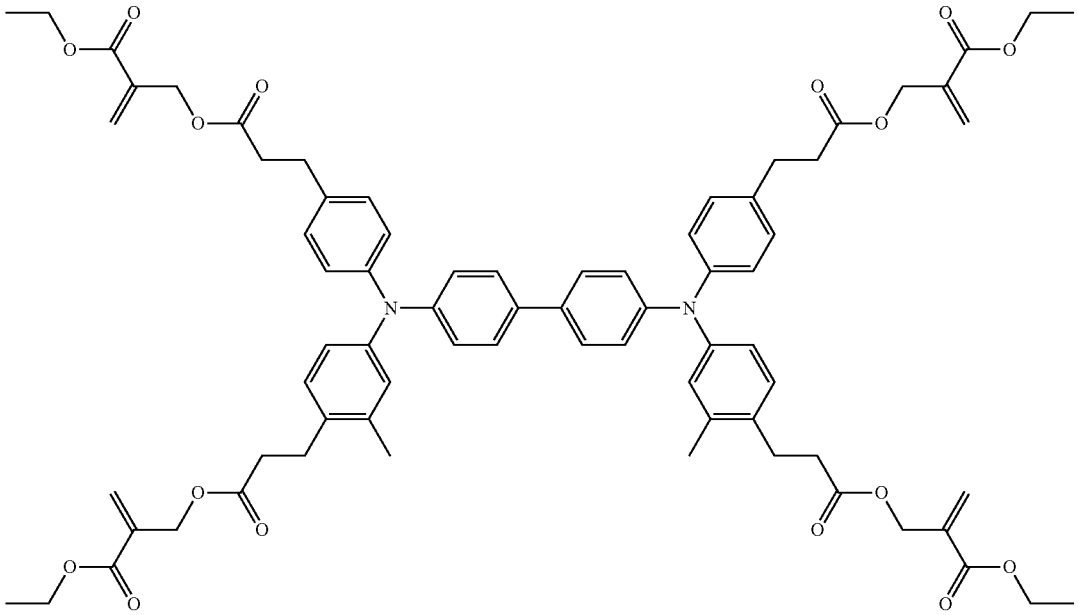

-continued
iv-50
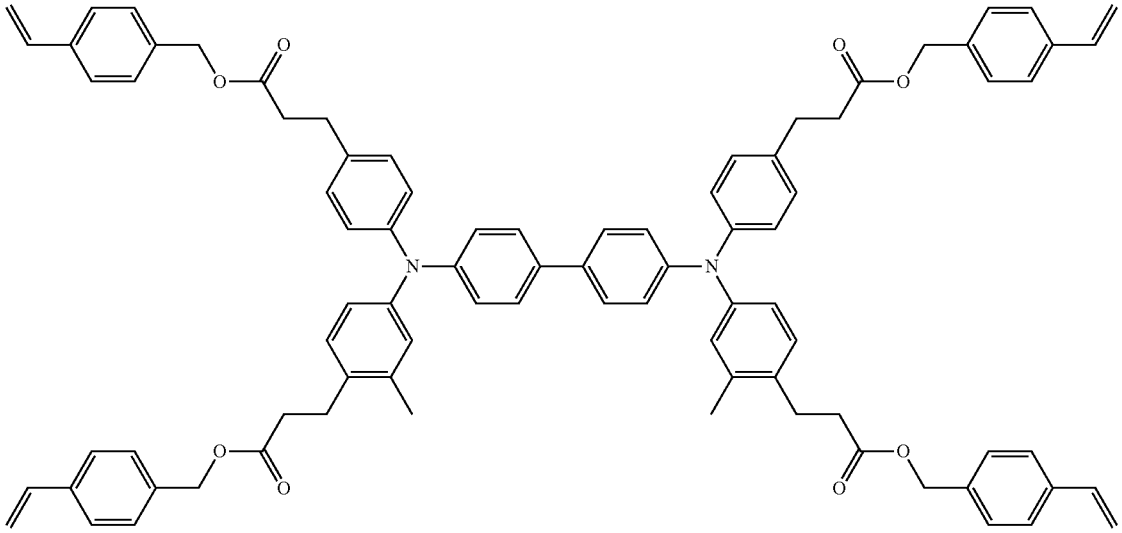
iv-51
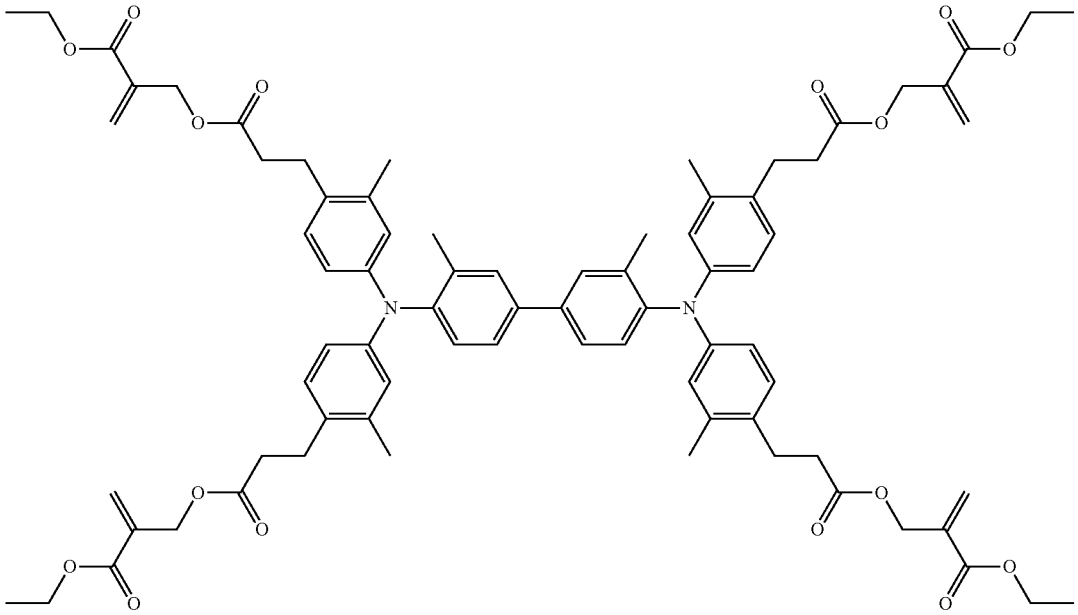

-continued
iv-52
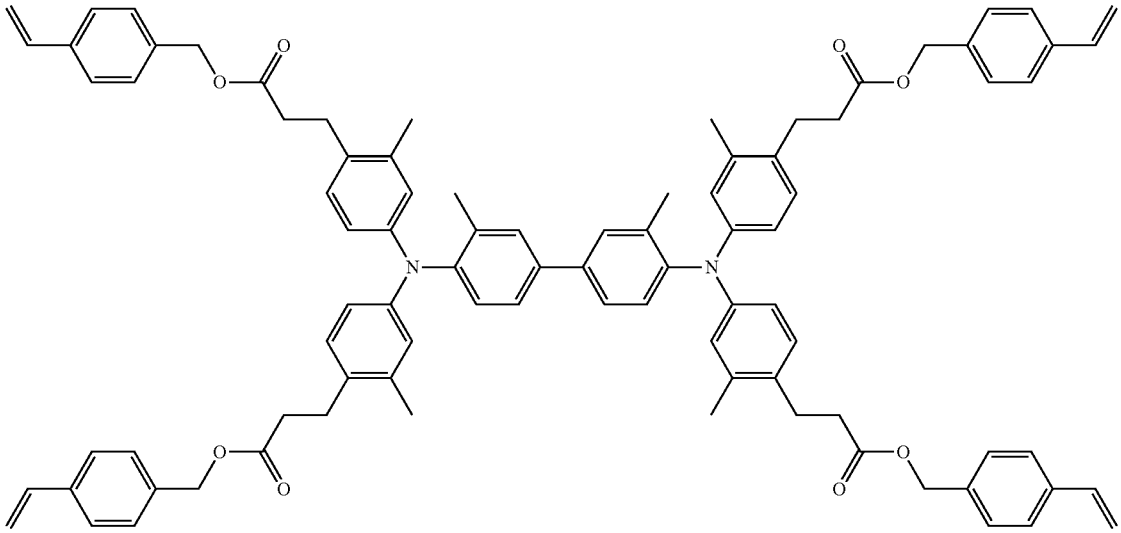
iv-53
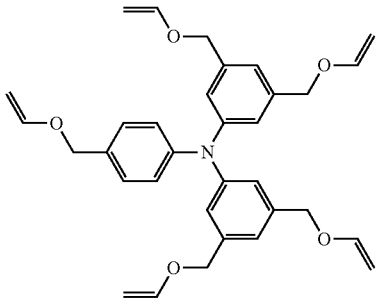
iv-54
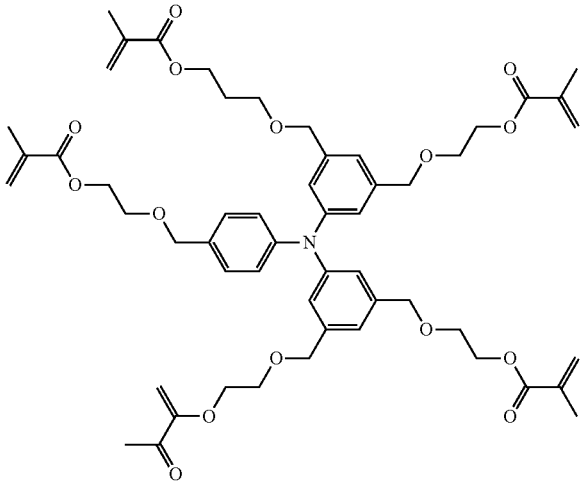
iv-55
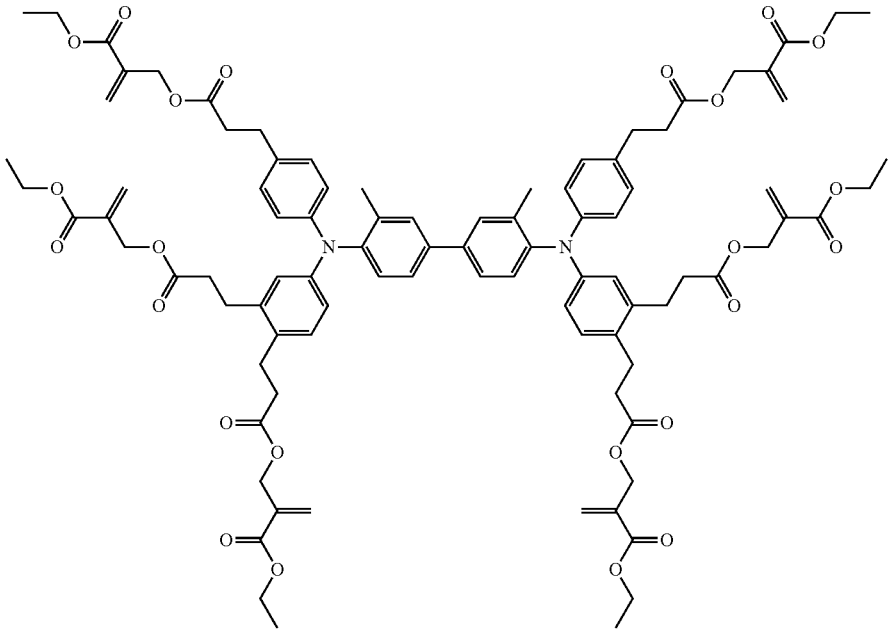

-continued iv-56

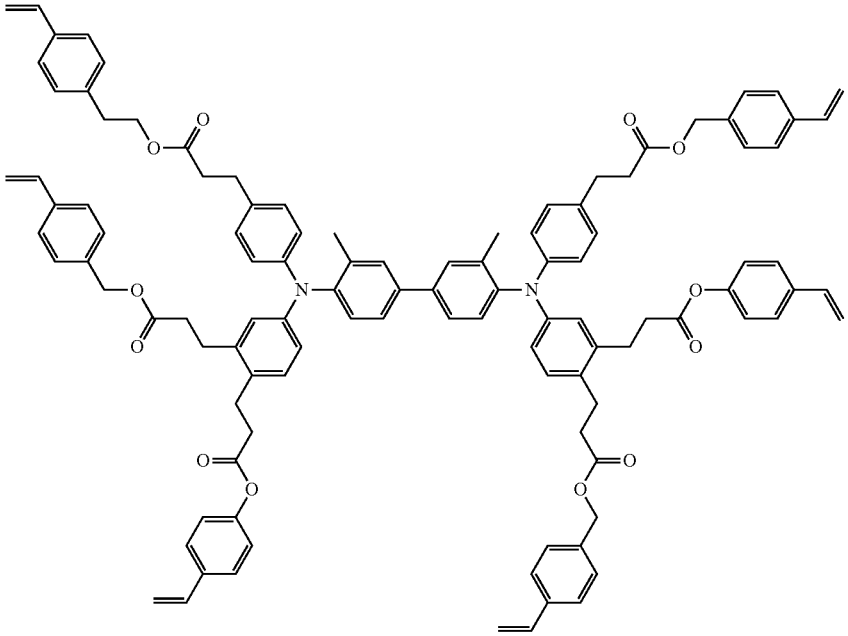

iv-57

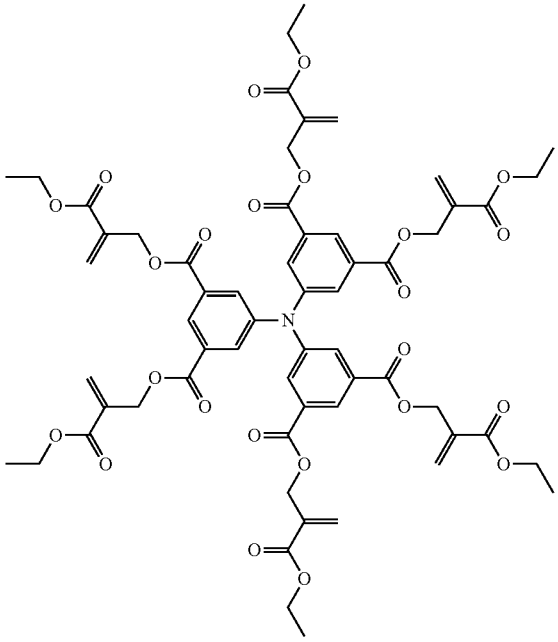

iv-58

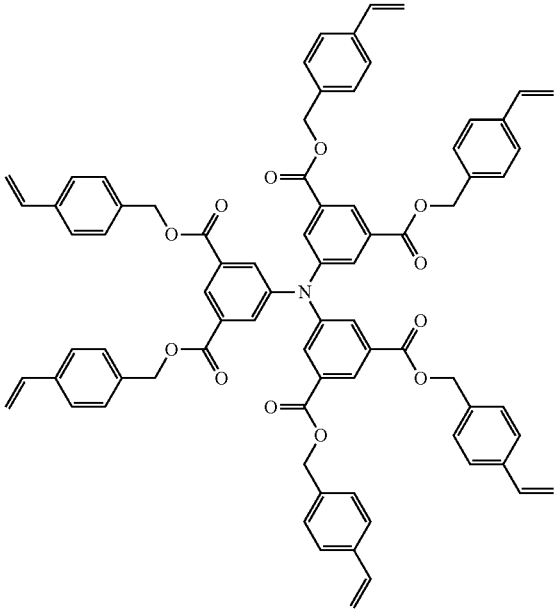

In the charge transport material, at least one carbon atom may be interposed between a charge transport component and a reactive group, and in particular an alkylene group may be used as a linking group.

Furthermore, a structure having a methacrylic group may be used as a reactive group.

In the case where the charge transport material having a reactive group is used for a coating solution for forming the charge transport layer 2B-2 that is an outermost surface layer, the coating solution being used when the electrophotographic photoconductor according to the first exemplary embodiment is prepared, the content of the charge transport material is preferably 30% or more and 90% or less, more preferably 40% or more and 85% or less, and particularly preferably 50% or more and 80% or less by mass relative to the total solid content of the coating solution.

In view of mechanical strength and electrical characteristics, the reactive monomer having charge transport property may have at least one reactive group in one molecule. Furthermore, in view of mechanical strength, a compound having a triphenylamine skeleton and two or more methacrylic groups in one molecule may be particularly used. The content of a compound having a triphenylamine skeleton and four or more methacrylic groups in one molecule is preferably 5% or more, more preferably 10% or more, and particularly preferably 15% or more by mass relative to the total solid content of the coating solution.

(Reactive Monomer Having No Charge Transport Property)

For the reactive monomer having no charge transport property, a constitutional unit derived from the reactive monomer having no charge transport property in a copolymer obtained through the copolymerization with the reactive monomer having charge transport property has a side chain with 4 or more carbon atoms.

Herein, the side chain included in the constitutional unit derived from the reactive monomer having no charge transport property is a constitutional unit corresponding to a structure branched from a main chain in the molecular structure when the copolymer is formed. In the case where the constitutional unit derived from the reactive monomer having no charge transport property has multiple side chains, any reactive monomer is used as the reactive monomer having no charge transport property according to this exemplary embodiment as long as at least one side chain has 4 or more carbon atoms.

In view of the compatibility with a binder resin, the number of carbon atoms in the side chain of the constitutional unit derived from the reactive monomer having no charge transport property is preferably 5 or more, more preferably 10 or more, and particularly preferably 12 or more. In view of the solubility of a reactive monomer and a copolymer, the number of carbon atoms of the constitutional unit derived from the reactive monomer having charge transport property in the copolymer is preferably 25 or less and more preferably 20 or less.

The reactive group of the reactive monomer having no charge transport property may be at least one selected from an acrylic group, a methacrylic group, a styryl group, and the derivatives thereof in view of copolymerizability with the reactive monomer having charge transport property.

The reactive monomer having no charge transport property that constitutes the copolymer according to this exemplary embodiment may have a bisphenol skeleton. If the reactive monomer having no charge transport property has a bisphenol skeleton, good compatibility with a binder resin is achieved and changes in image quality caused by the repeated use are suppressed.

The reactive monomer having no charge transport property that constitutes the copolymer according to this exemplary embodiment may have at least one of an alkylene oxide group and a hydroxyl group. If the reactive monomer having no charge transport property has an alkylene oxide group or a hydroxyl group, good compatibility with a binder resin is achieved and changes in image quality caused by repeated use are suppressed. An example of the reactive monomer having no charge transport property that constitutes the copolymer according to this exemplary embodiment, the reactive monomer having a side chain with 4 or more carbon atoms in the constitutional unit derived from the reactive monomer, is a compound represented by general formula (3-2) below.

General formula (3-2)

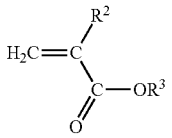

In general formula (3-2), $R^2$ represents hydrogen or an alkyl group having 1 to 4 carbon atoms and $R^3$ represents an organic group having 4 or more carbon atoms and no charge transport property.

An example of the reactive monomer having no charge transport property represented by general formula (3-2), the reactive monomer having a side chain with 4 or more carbon atoms in the constitutional unit included in the copolymer with the reactive monomer having charge transport property, is as follows. In the examples below, "(meth)acrylate" means acrylate or methacrylate. For example, "isobutyl(meth)acrylate" means both isobutyl acrylate and isobutyl methacrylate.

Examples of a monofunctional monomer include isobutyl (meth)acrylate, t-butyl(meth)acrylate, isooctyl (meth)acrylate, lauryl(meth)acrylate, isodecyl (meth)acrylate, tridecyl (meth)acrylate, stearyl (meth)acrylate, isobornyl(meth)acrylate, caprolactone (meth)acrylate, cyclohexyl(meth)acrylate, methoxy triethylene glycol(meth)acrylate, 2-ethoxyethyl (meth)acrylate, 2-(2-ethoxyethoxy)ethyl(meth)acrylate, tetrahydrofurfuryl(meth)acrylate, benzyl(meth)acrylate, ethyl carbitol(meth)acrylate, phenoxyethyl (meth)acrylate, 2-hydroxypropyl(meth)acrylate, 4-hydroxybutyl (meth)acrylate, methoxy polyethylene glycol(meth)acrylate, phenoxy polyethylene glycol(meth)acrylate, hydroxyethyl-o-phenylphenol (meth)acrylate, o-phenylphenol glycidyl ether (meth) acrylate, alkoxylated alkyl(meth)acrylate, and 3,3,5-trimethylcyclohexane triacrylate.

Examples of a difunctional monomer include 1,3-butylene glycol di(meth)acrylate, 1,4-butadiene glycol di(meth)acrylate, 1,6-hexanediol di(meth)acrylate, neopentyl glycol di(meth)acrylate, tetraethylene glycol di(meth)acrylate, triethylene glycol di(meth)acrylate, tripropylene glycol di(meth)acrylate, diethylene glycol di(meth)acrylate, ethoxylated bisphenol A di(meth)acrylate, cyclohexane dimethanol di(meth)acrylate, tricyclodecane di(meth)acrylate, alkoxylated neopentyl glycol di(meth)acrylate, polyethylene glycol di(meth)acrylate, and polypropylene glycol di(meth)acrylate.

Examples of a trifunctional monomer include trimethylolpropane tri(meth)acrylate, pentaerythritol tri(meth)acrylate, aliphatic tri(meth)acrylate, and alkoxylated trimethylolpropane tri(meth)acrylate.

Examples of a tetrafunctional monomer include pentaerythritol tetra(meth)acrylate, ditrimethylolpropane tetra (meth)acrylate, and aliphatic tetra(meth)acrylate.

Examples of a pentafunctional (or higher functional) monomer include dipentaerythritol penta(meth)acrylate and dipentaerythritol hexa(meth)acrylate.

These reactive monomers having no charge transport property may be used alone or in combination.

In view of the compatibility with a binder resin, a (meth) acrylate having a long-chain alkyl group with 10 to 20 carbon atoms or alkoxylated bisphenol di(meth)acrylate is preferably used among the reactive monomers having no charge transport property, and lauryl(meth)acrylate, isodecyl(meth) acrylate, tridecyl(meth)acrylate, stearyl(meth)acrylate, and ethoxylated bisphenol A di(meth)acrylate are more preferably used.

The copolymer according to this exemplary embodiment may include a constitutional unit represented by general formula (1-1) below and derived from the reactive monomer having charge transport property that is represented by general formula (3-1) and a constitutional unit represented by general formula (1-2) and derived from the reactive monomer having no charge transport property that is represented by general formula (3-2).

General formula (1-1)

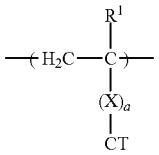

General formula (1-2)

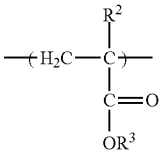

In general formulas (1-1) and (1-2), $R^1$ and $R^2$ each independently represent hydrogen or an alkyl group having 1 to 4 carbon atoms, $R^3$ represents an organic group having 4 or more carbon atoms and no charge transport property, X represents a divalent organic group having 1 to 10 carbon atoms, a is 0 or 1, and CT represents an organic group having a charge transport skeleton.

X may contain at least one substituent selected from a carbonyl group, an ester group, and an aromatic ring and may have a side chain with an alkyl group.

The amount of the reactive monomer having no charge transport property and serving as a constitutional unit derived from the reactive monomer in the copolymer is less than 100%, preferably 50% or less, and more preferably 30% or less by mass.

In this exemplary embodiment, a monofunctional monomer may be used as the reactive monomer having no charge transport property. When a difunctional (or higher functional) monomer is used, the copolymer is three-dimensionally cross-linked and thus the monomer sometimes becomes not easily dispersed in a photosensitive layer uniformly.

In this exemplary embodiment, for example, the copolymer derived from the reactive monomer having charge transport property and the reactive monomer having no charge transport property is obtained by polymerizing the reactive monomer having charge transport property and the reactive monomer having no charge transport property in a solution using a polymerization initiator. One of a thermal polymerization initiator and a photopolymerization initiator is used as the polymerization initiator.

Examples of the thermal polymerization initiator include azo-based initiators such as V-30, V-40, V-59, V-601, V-65, V-70, VE-073, VF-096, Vam-110, and Vam-111 (products of Wako Pure Chemical Industries), OTazo-15, OTazo-30, AIBN, AMBN, ADVN, and ACVA (products of Otsuka Pharmaceutical Co., Ltd.), PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PEROYL IB, PEROYL 355, PEROYL L, PEROYL SA, NYPER BW, NYPER BMT-K40/M, PEROYL IPP, PEROYL NPP, PEROYL TCP, PEROYL OPP, PEROYL SBP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT, and PERBUTYL Z (products of NOF CORPORATION), Kayaketal AM-C55, Trigonox 36-C75, Laurox, Perkadox L-W75, Perkadox CH-50L, Trigonox TMBH, Kayacumene H, Kayabutyl H-70, Perkadox BC-FF, Kayahexa AD, Perkadox 14, Kayabutyl C, Kayabutyl D, Kayahexa YD-E85, Perkadox 12-XL25, Perkadox 12-EB20, Trigonox 22-N70, Trigonox 22-70E, Trigonox D-T50, Trigonox 423-C70, Kayaester CND-C70, Kayaester CND-W50, Trigonox 23-C70, Trigonox 23-W50N, Trigonox 257-C70, Kayaester P-70, Kayaester TMPD-70, Trigonox 121, Kayaester O, Kayaester HTP-65W, Kayaester AN, Trigonox 42, Trigonox F-C50, Kayabutyl B, Kayacarbon EH-C70, Kayacarbon EH-W60, Kayacarbon I-20, Kayacarbon BIC-75, Trigonox 117, and Kayalen 6-70 (products of Kayaku Akzo Corporation), and Luperox 610, Luperox 188, Luperox 844, Luperox 259, Luperox 10, Luperox 701, Luperox 11, Luperox 26, Luperox 80, Luperox 7, Luperox 270, Luperox 2, Luperox 546, Luperox 554, Luperox 575, Luperox TANPO, Luperox 555, Luperox 570, Luperox TAP, Luperox TBIC, Luperox TBEC, Luperox JW, Luperox TAIC, Luperox TAEC, Luperox DC, Luperox 101, Luperox F, Luperox DI, Luperox 130, Luperox 220, Luperox 230, Luperox 233, and Luperox 531 (products of ARKEMA Yoshitomi, Ltd.).

An intramolecular cleavage-type initiator, a hydrogen abstraction-type initiator, or the like is used as the photopolymerization initiator.

Examples of the intramolecular cleavage-type initiator include those based on benzyl ketal, alkylphenone, aminoalkylphenone, phosphine oxide, titanocene, and oxime.

Specific examples of the benzyl ketal-based initiator include 2,2-dimethoxy-1,2-diphenylethan-1-one. Examples of the alkylphenone-based initiator include 1-hydroxy-cyclohexyl-phenyl-ketone, 2-hydroxy-2-methyl-1-phenyl-propan-1-one, 1-[4-(2-hydroxyethoxy)-phenyl]-2-hydroxy-2-methyl-1-propan-1-one, 2-hydroxy-1-{4-[4-(2-hydroxy-2-methyl-propionyl)-benzyl]phenyl}-2-methyl-propan-1-one, acetophenone, and 2-phenyl-2-(p-toluenesulfonyloxy)acetophenone. Examples of the aminoalkylphenone-based initiator include p-dimethylaminoacetophenone, p-dimethylaminopropiophenone, 2-methyl-1-(4-methylthiophenyl)-2-morpholinopropan-1-one, and 2-benzyl-2-dimethylamino-1-(4-morpholinophenyl)-butanone-1,2-(dimethylamino)-2-[(4-methylphenyl)methyl]-1-[4-(4-morpholinyl)phenyl]-1-butanone. Examples of the phosphine oxide-based initiator include 2,4,6-trimethylbenzoyl-diphenyl-phosphine oxide and bis(2,4,6-trimethylbenzoyl)-phenyiphosphine oxide. An example of the titanocene-based initiator includes bis(η5-2,4-cyclopentadien-1-yl)-bis(2,6-difluoro-3-(1H-pyrrol-1-yl)-phenyl)titanium. Examples of the oxime-based initiator include 1,2-octanedione, 1-[4-(phenylthio)-, 2-(O-benzoyloxime)], and ethanone, 1-[9-ethyl-6-(2-methylbenzoyl)-9H-carbazol-3-yl]-, 1-(O-acetyloxime).

Examples of the hydrogen abstraction-type initiator include those based on benzophenone, thioxanthone, benzyl, and Michler's ketone.

Specific examples of the benzophenone-based initiator include 2-benzoyl benzoic acid, 2-chlorobenzophenone, 4,4'-dichlorobenzophenone, 4-benzoyl-4'-methyldiphenyl sulfide, and p,p'-bisdiethylaminobenzophenone. Examples of the thioxanthone-based initiator include 2,4-diethylthioxanthen-9-one, 2-chlorothioxanthone, and 2-isopropylthioxanthone. Examples of the benzyl-based initiator include benzyl, (±)-camphorquinone, and p-anisyl.

These polymerization initiators are added in an amount of 0.2% or more and 10% or less, preferably 0.5% or more and 8% or less, and more preferably 0.7% or more and 5% or less by mass relative to the total amount of reactive monomers during the synthesis of the copolymer.

The polymerization reaction may be performed, for example, in an inert gas atmosphere in which the oxygen concentration is 10% or less, preferably 5% or less, and more preferably 1% or less so that the chain reaction is performed without deactivating the radicals generated.

To improve the mechanical strength and charge transport property of an outermost surface layer of the photoconductor, the weight-average molecular weight of the polymer according to this exemplary embodiment is preferably 10000 or more and 500000 or less, more preferably 10000 or more and 250000 or less, and particularly preferably 25000 or more and 150000 or less.

In view of electrical characteristics, the ratio of the constitutional unit derived from the reactive monomer having charge transport property in the copolymer is preferably 20% or more and 95% or less and more preferably 25% or more and 80% or less on a molar basis.

(Binder Resin)

Specific examples of the binder resin used in this exemplary embodiment include polycarbonate resin, polyester resin, polyarylate resin, methacrylate resin, acrylate resin, polyvinyl chloride resin, polyvinylidene chloride resin, polystyrene resin, polyvinyl acetate resin, styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone-alkyd resin, phenol-formaldehyde resin, styrene-alkyd resin, poly-N-vinylcarbazole, and polysilane. Polymeric charge transport materials such as polyester-based polymeric charge transport material disclosed in Japanese Unexamined Patent Application Publication Nos. 8-176293 and 8-208820 may be used as the binder resin. To improve mechanical strength, a polycarbonate resin or a polyarylate resin may be particularly used.

In view of the compatibility with the copolymer, the viscosity-average molecular weight of the binder resin used for the charge transport layer 2B-2 is preferably 50000 or more and more preferably 55000 or more.

These binder resins are used alone or in combination.

To improve the mechanical strength and charge transport property of an outermost surface layer, the blend ratio of the copolymer to the binder resin that constitute the outermost surface layer of the photoconductor according to this exemplary embodiment is preferably set to be about 10:1 to 1:5 and more preferably 8:1 to 1:3 by mass.

In this exemplary embodiment, in addition to the materials described above, a charge transport material having no reactive group that is described below, an antioxidant, an additive, or the like may be contained in the outermost surface layer of the photoconductor.

(Charge Transport Material having No Reactive Group)

In this exemplary embodiment, a charge transport material having no reactive group may be used together as a material constituting the outermost surface layer of the photoconductor.

Examples of the charge transport material having no reactive group include electron transport compounds such as quinone compounds, e.g., p-benzoquinone, chloranil, bromanil, and anthraquinone, tetracyanoquinodimethane compounds, fluorenone compounds, e.g., 2,4,7-trinitrofluorenone, xanthone compounds, benzophenone compounds, cyanovinyl compounds, and ethylene compounds; and hole transport compounds such as triarylamine compounds, benzidine compounds, arylalkane compounds, aryl-substituted ethylene compounds, stilbene compounds, anthracene compounds, and hydrazone compounds.

Triarylamine derivatives represented by structural formulas (a-1) and (a-2) below or benzidine derivatives are preferred.

(a-1)

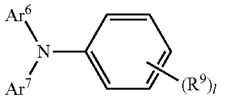

In formula (a-1), R9 represents a hydrogen atom or a methyl group, 1 is 1 or 2, and $Ar^6$ and $Ar^7$ each represent a substituted or unsubstituted aryl group.

(a-2)

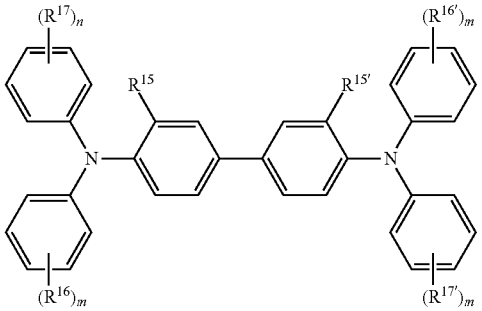

In formula (a-2), $R^{15}$ and $R^{15'}$ be the same or different and each represent a hydrogen atom, a halogen atom, an alkyl group having 1 to 5 carbon atoms, or an alkoxy group having 1 to 5 carbon atoms; $R^{16}$, $R^{16'}$, $R^{17}$, and $R^{17'}$ may be the same or different and each represent a hydrogen atom, a halogen atom, an alkyl group having 1 to 5 carbon atoms, an alkoxy group having 1 to 5 carbon atoms, an amino group substituted with an alkyl group having 1 to 2 carbon atoms, or a substituted or unsubstituted aryl group; and m and n are each an integer of 0 to 2.

A polymeric charge transport material having no reactive group, such as poly-N-vinyl carbazole or polysilane may also be used. Among publicly known non-cross-linking polymeric charge transport materials, polyester-based polymeric charge transport materials disclosed in Japanese Laid-opened Patent Application Publication Nos. 8-176293 and 8-208820 are particularly preferred. The polymeric charge transport material forms a layer by themselves, but the polymeric charge transport material may be mixed with the above-described binder resin to form a layer. These charge transport materials may be used alone or in combination, but are not limited to those described above.

In the case where the charge transport material having no reactive group is used for a coating solution for forming the charge transport layer 2B-2 that is an outermost surface layer, the coating solution being used when the electrophotographic photoconductor according to the first exemplary embodiment is produced, the content of the charge transport material is preferably 15% or more and 75% or less and more preferably 25% or more and 60% or less by mass relative to the total solid content of the coating solution.

The charge transport layer that is to be an outermost surface layer of the photoconductor of the exemplary embodiment may further contain a coupling agent, a fluorine compound, or the like. Examples of the compound include various silane coupling agents and commercially available silicone hard coating agents.

Examples of the silane coupling agent include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl)γ-aminopropyltriethoxysilane, tetramethoxysilane, methyltrimethoxysilane, and dimethyldimethoxysilane.

Examples of the commercially available hard coating agents include KP-85, X-40-9740, and X-8239 (products of Shin-Etsu Chemical Co., Ltd.), and AY42-440, AY42-441, and AY49-208 (products of Dow Corning Toray Co., Ltd.).

A fluorine-containing compound may be added. Examples of the fluorine-containing compound include (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane.

The amount of the silane coupling agent used may be any, but the amount of the fluorine-containing compound used may be 0.25 times or less the amount of the compound that does not contain fluorine by mass. A polymerizable fluorine compound or the like disclosed in Japanese Laid-opened Patent Application Publication No. 2001-166510 may be further added. A resin that is soluble in an alcohol may also be added.

When a coating solution is prepared by causing the reaction of the components described above, the components may be simply mixed and dissolved, but may be heated to a temperature of room temperature (20° C.) or higher and 100° C. or lower and preferably 30° C. or higher and 80° C. or lower for 10 minutes or longer and 100 hours or shorter and preferably 1 hour or longer and 50 hours or shorter. Herein, an ultrasonic wave may be applied.

A deterioration preventing agent may be added to the charge transport layer 2B-2. A hindered phenol-based or hindered amine-based deterioration preventing agent is preferably used. Publicly known antioxidants such as an organic sulfur-based antioxidant, a phosphite-based antioxidant, a dithiocarbamate-based antioxidant, a thiourea-based antioxidant, and a benzimidazole-based antioxidant may be used as the deterioration preventing agent. The amount of the deterioration preventing agent added is preferably 20% or less and more preferably 10% or less by mass.

Examples of the hindered phenol-based antioxidant include IRGANOX 1076, IRGANOX 1010, IRGANOX 1098, IRGANOX 245, IRGANOX 1330, IRGANOX 3114, and IRGANOX 1076 (products of Ciba Japan KK), and 3,5-di-t-butyl-4-hydroxybiphenyl.

Examples of the hindered amine-based antioxidant include SANOL LS2626, SANOL LS765, SANOL LS770, and SANOL LS744 (products of Sankyo Lifetech Co., Ltd.), TINUVIN 144 and TINUVIN 622LD (products of Ciba Japan KK), and MARK LA57, MARK LA67, MARK LA62, MARK LA68, and MARK LA63 (products of Adeka Corporation). Examples of the thioether-based antioxidant include Sumilizer TPS and Sumilizer TP-D (products of Sumitomo Chemical Co., Ltd.). Examples of the phosphite-based antioxidant include MARK 2112, MARK PEP-8, MARK PEP-24G, MARK PEP-36, MARK 329K, and MARK HP-10 (products of Adeka Corporation).

Conductive particles, organic particles, or inorganic particles may be further added to the charge transport layer 2B-2. An example of the particles is silicon-containing particles. Silicon-containing particles are particles containing silicon as a constitutional element. Specifically, colloidal silica and silicone particles are exemplified. Colloidal silica used as silicon-containing particles is selected from those prepared by dispersing silica having an average particle size of 1 nm or more and 100 nm or less and preferably 10 nm or more and 30 nm or less in an acidic or alkaline aqueous solvent or an organic solvent such as alcohol, ketone, or ester, and commercially available colloidal silica is generally used.

The solid content of the colloidal silica is not particularly limited, but is 0.1% or more and 50% or less and preferably 0.1% or more and 30% or less by mass relative to the total solid content.

The silicone particles used as the silicon-containing particles are selected from silicone resin particles, silicone rubber particles, and silicone surface-treated silica particles, and commercially available silicone particles are generally used. These silicone particles may be spherical with an average particle size of 1 nm or more and 500 nm or less and preferably 10 nm or more and 100 nm or less.

In view of mechanical strength, the content of the silicone particles is preferably 0.1% or more and 30% or less and more preferably 0.5% or more and 10% or less by mass relative to the total solid content.

Other examples of the particles include fluorine particles such as ethylene tetrafluoride, ethylene trifluoride, propylene hexafluoride, vinyl fluoride, and vinylidene fluoride particles; particles composed of a copolymer resin obtained by copolymerizing a fluorocarbon resin and a monomer having a hydroxyl group, the copolymer resin being described in "8th Polymer Material Forum, Lecture abstract, p. 89"; and semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO.

Oil such as silicone oil may also be added. Examples of the silicone oil include silicone oil such as dimethylpolysiloxane, diphenylpolysiloxane, and phenylmethylsiloxane; polymerizable silicone oil such as amino-modified polysiloxane, epoxy-modified polysiloxane, carboxyl-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenyloyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as 3-(3,3,3-trifluoropropyl)methylcyclotrisiloxane; hydrosilyl-containing cyclosiloxanes such as methylhydrosiloxane mixtures, pentamethylcyclopentasiloxane, and phenylhydrocyclosiloxane; and vinyl-containing cyclosiloxanes such as pentavinylpentamethylcyclopentasiloxane.

A metal, metal oxide, carbon black, or the like may also be added. Examples of the metal include aluminum, zinc, copper, chromium, nickel, silver, and stainless steel and those metals vapor-deposited on surfaces of plastic particles. Examples of the metal oxide include zinc oxide, titanium oxide, tin oxide, antimony oxide, indium oxide, bismuth oxide, tin-doped indium oxide, antimony- or tantalum-doped tin oxide, and antimony-doped zirconium oxide. These may be used alone or in combination. When two or more of these materials are used in combination, the materials may be simply mixed, or used in the form of a solid solution or a fused body. In view of transparency, the average particle size of the conductive particles is 0.3 μm or less and preferably 0.1 μm or less.

A reactive monomer may be further added in addition to the copolymer and the binder resin, and cured on a base. The reactive monomer used herein is, for example, the above-described reactive monomer having charge transport property or the above-described reactive monomer having no charge transport property.

The reactive monomer may be polymerized by any one of photopolymerization, thermal polymerization, and electron beam polymerization.

Examples of the method used to apply a coating solution for forming the charge transport layer 2B-2 include a blade coating method, a Meyer bar coating method, a spray coating method, a dip coating method, a bead coating method, an air knife coating method, a curtain coating method, and an ink jet method.

To ensure the mechanical strength of the outermost surface layer and achieve good electrical characteristics, the thickness of the charge transport layer 2B-2 is preferably 2 μm or more and 60 μm or less and more preferably 5 μm or more and 50 μm or less.

Charge Transport Layer 2B-1

The charge transport layer 2B-1 according to the first exemplary embodiment is composed of a material used for the above-described charge transport layer 2B-2. The charge transport layer 2B-1, which is not an outermost surface layer in the first exemplary embodiment, is not necessarily a photosensitive layer including the copolymer and the binder resin that constitute the charge transport layer 2B-2, which is an outermost surface layer. That is, the charge transport layer 2B-I may include a publicly known charge transport material and binder resin, for example.

Base

A conductive base is used as the base 1. Examples of the base 1 include metal plates, metal drums, and metal belts containing metals such as aluminum, copper, zinc, stainless steel, chromium, nickel, molybdenum, vanadium, indium, gold, and platinum or alloys thereof; and paper, plastic films, and belts on which a conductive polymer, a conductive compound such as indium oxide, a metal such as aluminum, palladium, or gold, or an alloy is applied, vapor-deposited, or laminated. Herein, "conductive" means that the volume resistivity is less than $10^{13}$ Ωcm.

In the case where the photoconductor according to this exemplary embodiment is used for a laser printer, the surface of the base 1 is preferably made rough so as to have a center-line surface roughness Ra of 0.04 μm or more and 0.5 μm or less. Herein, if incoherent light is used as a light source, the surface roughening is not necessarily performed.

The surface roughening may be performed by a wet honing in which an abrasive suspended in water is sprayed onto a support that is to be a base, by centerless polishing in which a support is brought into contact with a rotating grindstone and polishing is continuously performed, or by anodization.

Another example of a method for roughening the surface is as follows. Instead of roughening the surface of the base 1, conductive or semiconductive powder is dispersed in a resin and a layer is formed on a surface of a support. The surface of the support is made rough due to the particles dispersed in the layer.

In the roughening by anodization, an oxide layer is formed on an aluminum surface by oxidizing an aluminum anode in an electrolytic solution. Examples of the electrolytic solution include a sulfuric acid solution and an oxalic acid solution. However, since the porous anodic oxide layer itself formed by anodization is chemically active, the pores of the anodic oxide layer may be sealed by volume expansion caused by a hydration reaction using compressed water vapor or boiling water (a metal salt such as nickel may also be added) so that the anodic oxide layer turns into a more stable hydrated oxide (pore-sealing treatment). The thickness of the anodic oxide layer may be 0.3 μm or more and 15 μm or less.

The base 1 may be treated with an acidic aqueous solution or subjected to a boehmite treatment.

The treatment using an acidic treatment solution composed of phosphoric acid, chromic acid, and hydrofluoric acid is performed as follows. First, an acidic treatment solution is prepared. The contents of phosphoric acid, chromic acid, and hydrofluoric acid blended are adjusted so that phosphoric acid is 10% or more and 11% or less by mass, chromic acid is 3% or more and 5% or less by mass, and hydrofluoric acid is 0.5% or more and 2% or less by mass. The total concentration of these acids may be 13.5% or more and 18% or less by mass. The treatment temperature may be 42° C. or higher and 48° C. or lower. The thickness of the film may be 0.3 μm or more and 15 μm or less.

The boehmite treatment is performed by dipping the base 1 in pure water at 90° C. or higher and 100° C. or lower for 5 minutes or longer and 60 minutes or shorter, or by bringing the base 1 in contact with heated steam of 90° C. or higher and 120° C. or lower for 5 minutes or longer and 60 minutes or shorter. The thickness of the film may be 0.1 μm or more and 5 μm or less. The resulting film may be further anodized by using an electrolytic solution having lower film dissolving property than others, such as adipic acid, boric acid, borate, phosphate, phthalate, maleate, benzoate, tartrate, and citrate.

Undercoat Layer

The undercoat layer 4 may be, for example, a layer formed by incorporating inorganic particles in a binder resin.

Inorganic particles having a powder resistance (volume resistivity) of $10^2$ Ω·cm or more and $10^{11}$ Ω·cm or less may be used as the inorganic particles.

Among the inorganic particles having the above-described resistance value, inorganic particles (conductive metal oxide) of tin oxide, titanium oxide, zinc oxide, zirconium oxide, or the like are preferred, and zinc oxide is particularly preferred.

The inorganic particles may be subjected to a surface treatment. A mixture of two types or more of inorganic particles subjected to different surface treatments or having different particle sizes may also be used. The volume-average particle size of the inorganic particles is preferably 50 nm or more and 2000 nm or less and more preferably 60 nm or more and 1000 nm or less.

Inorganic particles having a BET specific surface of 10 $m^2/g$ or more may be used as the inorganic particles.

In addition to the inorganic particles, an acceptor compound may be added. Any acceptor compound may be used, but the acceptor compound is preferably an electron transport substance such as quinone compounds, e.g., chloranil and bromanil, tetracyanoquinodimethane compounds, fluorene compounds, e.g., 2,4,7-trinitrofluorenone and 2,4,5,7-tetranitro-9-fluorenone, oxadiazole compounds, e.g., 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone compounds, thiophene compounds, and diphenoquinone compounds, e.g., 3,3',5,5'-tetra-t-butyldiphenoquinone. In particular, compounds having an anthraquinone structure are preferred. Preferred examples of the acceptor compound having an anthraquinone structure include hydroxyanthraquinone compounds, aminoanthraquinone compounds, and aminohydroxyanthraquinone compounds. Specific examples thereof include anthraquinone, alizarin, quinizarin, anthrarufin, and purpurin.

The content of the acceptor compound is freely set, but is preferably 0.01% or more and 20% or less and more preferably 0.05% or more and 10% or less by mass relative to the amount of inorganic particles.

The acceptor compound may be added when the undercoat layer 4 is applied or may be attached to the surfaces of the inorganic particles in advance. The acceptor compound is imparted to the surfaces of the inorganic particles by a dry method or a wet method.

When the surface treatment is performed by a dry method, the acceptor compound as is or dissolved in an organic solvent is added dropwise and sprayed together with dry air or nitrogen gas toward the inorganic particles being stirred in a mixer or the like having a large shear force. The addition or spraying may be performed at a temperature lower than the boiling point of the solvent. After the addition or spraying, baking may be further performed at a temperature of 100° C. or higher. The temperature and time of the baking is freely set.

A wet method is performed as follows. Inorganic particles are stirred in a solvent and dispersed using an ultrasonic wave, a sand mill, an attritor, a ball mill, or the like. The acceptor compound is added to the dispersed inorganic particles, stirred, and dispersed. The solvent is then removed from the mixture by filtration or distillation. After the removal of the solvent, baking may be further performed at a temperature of 100° C. or higher. The temperature and time of the baking is freely set. In the wet method, moisture contained in the inorganic particles may be removed before the surface treating agent is added. For example, the moisture may be removed by stirring the inorganic particles in a solvent used for surface treatment under heating or by using azeotrope with a solvent.

The inorganic particles may be surface-treated before the acceptor compound is added. The surface treating agent is selected from any publicly known materials, such as silane coupling agents, titanate coupling agents, aluminum coupling agents, and surfactants. In particular, silane coupling agents are preferably used, and silane coupling agents having an amino group are more preferably used.

Any silane coupling agent having an amino group may be used. Examples of the silane coupling agent include γ-aminopropyltriethoxysilane, N-β-(aminoethyl)-γ-aminopropyltrimethoxysilane, N-β-(aminoethyl)-γ-aminopropylmethylmethoxysilane, and N,N-bis(β-hydroxyethyl)-γ-aminopropyltriethoxysilane. However, the silane coupling agent is not limited thereto.

These silane coupling agents may be used in combination. Examples of the silane coupling agent used together with the silane coupling agent having an amino group include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane. However, the silane coupling agent is not limited thereto.

Any publicly known surface-treating method may be used. For example, a wet method or a dry method may be used. The addition of the acceptor compound and the surface-treatment with a coupling agent and the like may be performed simultaneously.

The amount of the silane coupling agent relative to that of the inorganic particles in the undercoat layer 4 is freely set, but is preferably 0.5% or more and 10% or less by mass.

The binder resin contained in the undercoat layer 4 may be any binder resin used for publicly known undercoat layers. Examples of the binder resin include publicly known polymer resin compounds such as acetal resin, e.g., polyvinyl butyral, polyvinyl alcohol resin, casein, polyamide resin, cellulose resin, gelatin, polyurethane resin, polyester resin, methacrylate resin, acrylate resin, polyvinyl chloride resin, polyvinyl acetate resin, vinyl chloride-vinyl acetate-maleic anhydride resin, silicone resin, silicone-alkyd resin, phenol resin, phenol-formaldehyde resin, melamine resin, and urethane resin; electron transport resins having an electron transport group; and conductive resins such as polyaniline. Among these, resins insoluble in a coating solvent of the upper layer are preferable, and phenol resins, phenol-formaldehyde resins, melamine resins, urethane resins, epoxy resins, and the like are particularly preferable. When two or more of these materials are used in combination, the mixing ratio is set according to need.

The ratio of the metal oxide to which acceptor property has been imparted to the binder resin in the coating solution for forming an undercoat layer or the ratio of the inorganic particles to the binder resin is freely set.

Various additives may be contained in the undercoat layer 4. Publicly known materials are used as the additives, and examples of the additives include polycyclic based ring type electron transport pigments, azo type electron transport pigments, zirconium chelate compounds, titanium chelate compounds, aluminum chelate compounds, titanium alkoxide compounds, organic titanium compounds, and silane coupling agents. Although a silane coupling agent is used for surface treatment of the metal oxide, it may also be added as an additive to the coating solution. Examples of the silane coupling agent used herein include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxy titanium stearate.

Examples of the aluminum chelate compounds include aluminum isopropylate, monobutoxy aluminum diisopropylate, aluminum butyrate, ethyl acetoacetate aluminum diisopropylate, and aluminum tris(ethyl acetoacetate).

These compounds may be used alone or as a mixture or a polycondensate of two or more.

The solvent for preparing the coating solution for forming the undercoat layer is selected from publicly known organic solvents, such as alcohol-based, aromatic-based, halogenated hydrocarbon-based, ketone-based, ketone alcohol-based, ether-based, and ester-based organic solvents. Examples of the organic solvent include methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

These solvents used for dispersion may be used alone or in combination. When the solvents are used in a mixed manner, any solvent may be used as long as the solvent dissolves a binder resin as a mixed solvent.

For the dispersion method, a publicly known method that uses a roll mill, a ball mill, a vibrating ball mill, an attritor, a sand mill, a colloid mill, or a paint shaker is employed.

The undercoat layer 4 is formed on the base 1 by using the thus-obtained coating solution for forming the undercoating layer. Examples of the method used to form the undercoat layer 4 include usual methods such as a blade coating method, a wire bar coating method, a spray coating method, a dip coating method, a bead coating method, an air knife coating method, and a curtain coating method.

The Vickers hardness of the undercoat layer 4 may be 35 or more.

The thickness of the undercoat layer 4 may be freely set, but is preferably 15 μm or more and more preferably 15 or more and 50 μm or less.

The surface roughness (ten-point average roughness) of the undercoat layer 4 is adjusted to ¼n (n is a refractive index of the upper layer) to ½λ of the exposure laser wavelength λ to prevent moire patterns. Particles such as resin particles may be added to the undercoat layer 4 to adjust the surface roughness. Examples of the resin particles include silicone resin particles and cross-linked polymethyl methacrylate resin particles.

The undercoat layer 4 may be polished to adjust the surface roughness. Examples of the polishing method include buff polishing, sand blasting, wet horning, and grinding.

The applied coating solution is dried to obtain an undercoat layer. Drying is normally performed at a temperature at which the solvent is evaporated and a film is formed.

Charge Generation Layer

The charge generation layer 2A is particularly a layer that contains at least a charge generation material and a binder resin.

Examples of the charge generation material include azo pigments such as bisazo and trisazo, polycyclic aromatic pigments such as dibromoanthanthrone, perylene pigments, pyrrolopyrrole pigments, phthalocyanine pigments, zinc oxide, and trigonal selenium. Among these, metal or metal-free phthalocyanine pigments are preferred for the laser exposure to near infrared. In particular, hydroxygallium phthalocyanine disclosed in, for example, Japanese Unexamined Patent Application Publication Nos. 5-263007 and 5-279591, chlorogallium phthalocyanine disclosed in, for example, Japanese Unexamined Patent Application Publication No. 5-98181, dichlorotin phthalocyanine disclosed in, for example, Japanese Unexamined Patent Application Publication Nos. 5-140472 and 5-140473, and titanyl phthalocyanine disclosed in Japanese Unexamined Patent Application Publication Nos. 4-189873 and 5-43823 are more preferable. For the laser exposure to near ultraviolet, polycyclic aromatic pigments such as dibromoanthanthrone, thioindigo pigments, porphyrazine compounds, zinc oxide, and trigonal selenium are more preferable. When a light source having an exposure wavelength of 380 nm or more and 500 nm or less is used, an inorganic pigment may be used as the charge generation material. When a light source having an exposure wavelength of 700 nm or more and 800 nm or less is used, a metal or metal-free phthalocyanine pigment may be used as the charge generation material.

A hydroxygallium phthalocyanine pigment having a maximum peak wavelength in a range of 810 to 839 nm, which is measured by spectrometry in a wavelength region of 600 to 900 nm, may be used as the charge generation material. The hydroxygallium phthalocyanine pigment is different from a known Type V hydroxygallium phthalocyanine pigment. The maximum peak wavelength measured by spectrometry is shifted to shorter wavelengths compared with the known Type V hydroxygallium phthalocyanine pigment.

The hydroxygallium phthalocyanine pigment having a maximum peak wavelength in a range of 810 to 839 nm has an average particle size within a certain range and has a BET specific surface within a certain range. Specifically, the average particle size is preferably 0.20 μm or less and more preferably 0.01 μm or more and 0.15 μm or less. The BET specific surface is preferably 45 $m^2/g$ or more, and more preferably 50 $m^2/g$ or more, and particularly preferably 55 $m^2/g$ or more and 120 $m^2/g$ or less. The average particle size is a volume-average particle size (d50 average particle size) measured using a laser diffraction/scattering particle size distribution analyzer (LA-700 manufactured by HORIBA, Ltd.). The BET specific surface is measured by a nitrogen adsorption method using a BET specific surface analyzer (FlowSorb II2300 manufactured by SHIMADZU CORPORATION).

The maximum particle size (the maximum value of primary particle size) of the hydroxygallium phthalocyanine pigment is preferably 1.2 μm or less, more preferably 1.0 μm or less, and particularly preferably 0.3 μm or less.

Furthermore, the hydroxygallium phthalocyanine pigment preferably has an average particle size of 0.2 μm or less, a maximum particle size of 1.2 μm or less, and a specific surface of 45 $m^2/g$ or more.

The hydroxygallium phthalocyanine pigment has diffraction peaks at Bragg angles (2θ±0.2°) of 7.5°, 9.9°, 12.5°, 16.3°, 18.6°, 25.1°, and 28.3° in the X-ray diffraction spectrum measured using a CuKα characteristic X-ray.

The decline rate of the weight of the hydroxygallium phthalocyanine pigment measured when the temperature is increased from 25° C. to 400° C. is preferably 2.0% or more and 4.0% or less and more preferably 2.5% or more and 3.8% or less.

The binder resin used for the charge generation layer 2A is selected from a wide range of insulating resins, and may be selected from organic photoconductive polymers such as poly-N-vinylcarbazole, polyvinyl anthracene, polyvinyl pyrene, and polysilane. Examples of the binder resin include polyvinyl butyral resin, polyarylate resin (e.g., polycondensate of a bisphenol and an aromatic divalent carboxylic acid), polycarbonate resin, polyester resin, phenoxy resin, vinyl chloride-vinyl acetate copolymer, polyamide resin, acrylate resin, polyacrylamide resin, polyvinylpyridine resin, cellulose resin, urethane resin, epoxy resin, casein, polyvinyl alcohol resin, and polyvinylpyrrolidone resin. These binder resins are used alone or in combination.

The blend ratio of the charge generation material to the binder resin may be in a range of 10:1 to 1:10 by mass. Herein, "insulating" means that the volume resistivity is $10^{13}$ Ωcm or more.

The charge generation layer 2A is formed, for example, by using a coating solution prepared by dispersing the charge generation material and the binder resin in a solvent.

Examples of the solvent used for dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used alone or in combination.

Examples of a method for dispersing the charge generation material and the binder resin in the solvent include usual methods such as a ball mill dispersion method, an attritor dispersion method, and a sand mill dispersion method. In this dispersion, it is effective that the average particle size of the charge generation material is adjusted to be 0.5 μm or less, preferably 0.3 μm or less, and more preferably 0.15 μm or less.

The charge generation layer 2A is formed by a usual method such as a blade coating method, a Meyer bar coating method, a spray coating method, a dip coating method, a bead coating method, an air knife coating method, and a curtain coating method.

The thickness of the thus-obtained charge generation layer 2A is preferably 0.1 μm or more and 5.0 μm or less and more preferably 0.2 μm or more and 2.0 μm or less.

(Second Exemplary Embodiment: Outermost Surface Layer=Charge Transport Layer 2B)

As shown in FIG. 2, the photoconductor according to the second exemplary embodiment, which is an example in this exemplary embodiment, has a layer structure in which the undercoat layer 4, the charge generation layer 2A, and the charge transport layer 2B are layered on the base 1 in that order. The charge transport layer 2B is an outermost surface layer.

The base 1, the undercoat layer 4, and the charge generation layer 2A in the second exemplary embodiment respectively correspond to the base 1, the undercoat layer 4, and the charge generation layer 2A in the first exemplary embodiment shown in FIG. 1.

The charge transport layer 2B in the second exemplary embodiment corresponds to the charge transport layer 2B-2 in the first exemplary embodiment. That is, the charge transport layer 2B that is to be an outermost surface layer in the second exemplary embodiment contains a copolymer (a) derived from a reactive monomer having charge transport property and a reactive monomer having no charge transport property and a binder resin (b), the copolymer having a side chain with 4 or more carbon atoms in a constitutional unit derived from the reactive monomer having no charge transport property.

(Third Exemplary Embodiment: Outermost Surface Layer=Function-Integrated Photosensitive Layer 6)

As shown in FIG. 3, the photoconductor according to the third exemplary embodiment, which is an example in this exemplary embodiment, has a layer structure in which the undercoat layer 4 and the function-integrated photosensitive layer 6 are layered on the base 1 in that order. The function-integrated photosensitive layer 6 is an outermost surface layer.

The base 1 and the undercoat layer 4 in the third exemplary embodiment respectively correspond to the base 1 and the undercoat layer 4 in the first exemplary embodiment shown in FIG. 1.

Function-Integrated Photosensitive Layer 6

In the photoconductor according to the third exemplary embodiment, the function-integrated photosensitive layer 6 is an outermost surface layer. The photosensitive layer 6 that is to be an outermost surface layer in the third exemplary embodiment contains a copolymer (a) derived from a reactive monomer having charge transport property and a reactive monomer having no charge transport property and a binder resin (b), the copolymer having a side chain with 4 or more carbon atoms in a constitutional unit derived from the reactive monomer having no charge transport property.

In this exemplary embodiment, the content of the charge generation material in the photosensitive layer 6 may be 20% or more and 50% or less by mass.

<Method for Producing Electrophotographic Photoconductor>

A method for producing an electrophotographic photoconductor according to this exemplary embodiment is not particularly limited, but includes a base preparation step of preparing a base, and an outermost surface layer formation step of forming an outermost surface layer by applying a coating solution containing a binder resin and a copolymer derived from a reactive monomer having charge transport property and a reactive monomer having no charge transport property, the copolymer having a side chain with 4 or more carbon atoms in a constitutional unit derived from the reactive monomer having no charge transport property, directly to the surface of the base or to another layer such as an undercoat layer formed on the base and then by drying the coating solution. The temperature during the drying may be 100° C. or higher and 180° C. or lower.

<Process Cartridge and Image Forming Apparatus>

A process cartridge and an image forming apparatus that use the electrophotographic photoconductor of this exemplary embodiment will now be described.

The process cartridge of this exemplary embodiment includes at least the above-described electrophotographic photoconductor according to this exemplary embodiment. The process cartridge is detachably mountable to an image forming apparatus that forms an image on a recording medium by transferring a toner image, which has been obtained by developing an electrostatic latent image on a surface of the photoconductor, onto the recording medium.

The image forming apparatus of this exemplary embodiment includes the above-described electrophotographic photoconductor according to the exemplary embodiment, a charging device that charges the electrophotographic photoconductor, a latent image forming device that forms an electrostatic latent image on a surface of the charged electrophotographic photoconductor, a developing device that develops, with a toner, the electrostatic latent image formed on the surface of the electrophotographic photoconductor to form a toner image, and a transfer device that transfers the toner image formed on the surface of the electrophotographic photoconductor onto a recording medium. The image forming apparatus of this exemplary embodiment may be a tandem machine that includes two or more photoconductors corresponding to toners of different colors. In this case, each photoconductor may be the electrophotographic photoconductor of this exemplary embodiment. The transfer of the toner image may be performed through an intermediate transfer system that uses an intermediate transfer member.

Figure 4:
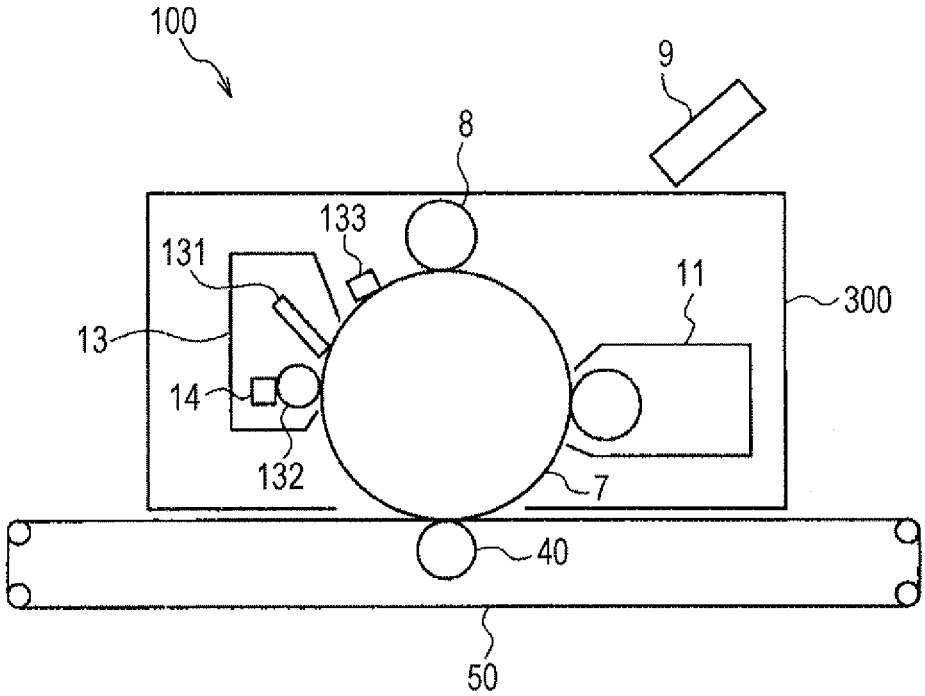
FIG. 4 is a schematic view showing an example of a structure of an image forming apparatus (process cartridge) according to this exemplary embodiment.

FIG. 4 schematically shows an example of an image forming apparatus according to this exemplary embodiment. As shown in FIG. 4, an image forming apparatus 100 includes a process cartridge 300 equipped with an electrophotographic photoconductor 7, an exposure device 9, a transfer device 40, and an intermediate transfer member 50. The exposure device 9 is located at a position that allows the exposure device 9 to expose the electrophotographic photoconductor 7 through an opening in the process cartridge 300. The transfer device 40 is located so as to face the electrophotographic photoconductor 7 with the intermediate transfer member 50 therebetween. The intermediate transfer member 50 is partly in contact with the electrophotographic photoconductor 7.

The process cartridge 300 in FIG. 4 includes the electrophotographic photoconductor 7, a charging device 8, a developing device 11, and a cleaning device 13 in a housing in an integrated manner. The cleaning device 13 includes a cleaning blade (cleaning member) 131 disposed so as to be in contact with the surface of the electrophotographic photoconductor 7.

Although an example is described in which a fibrous member 132 (roll-shaped) that supplies a lubricant 14 onto the surface of the photoconductor 7 and a fibrous member 133 (flat brush) that assists cleaning are provided, these components may be used or not used.

An Example of the charging device 8 includes a contact-type charger that uses a conductive or semiconductive charging roller, charging brush, charging film, charging rubber blade, charging tube, or the like. Other publicly known chargers such as non-contact-type roller chargers, scorotron and corotron chargers that utilize corona discharge, and the like may also be used.

Although not shown in the drawing, a photoconductor heating member for increasing the temperature of the electrophotographic photoconductor 7 to reduce the relative temperature may be disposed in the vicinity of the electrophotographic photoconductor 7.

An example of the exposure device 9 includes an optical device that exposes the surface of the photoconductor 7 to light such as semiconductor laser light, LED light, or liquid crystal shutter light to form a certain image. The wavelength of the light source is in the spectral sensitivity range of the photoconductor. The mainstream of the wavelength of the semiconductor lasers is near infrared that has an emission wavelength near 780 nm. However, the wavelength is not limited thereto. For example, lasers having emission wavelengths on the order of 600 nm and blue lasers having emission wavelengths near the range of 400 nm to 450 nm may also be used. Moreover, in order to form color images, it is also effective to use surface-emission laser light sources that output multibeam.

The developing device 11 may be a typical developing device that develops images using a magnetic or non-magnetic one-component developer or two-component developer or the like in a contact or non-contact manner. No limitation is imposed on the developing device as long as the functions described above are achieved, and a developing device is selected depending on the purpose. For example, the developing device is a publicly known developing device that causes a one-component developer or a two-component developer to adhere on the photoconductor 7 using a brush, a roller, or the like. In particular, a developing device that uses a developing roller whose surface supports a developer may be used.

The toner used in the developing device 11 will now be described.

The toner used in the image forming apparatus of this exemplary embodiment preferably has an average shape coefficient ($(ML^2/A)\times(\pi/4)\times100$, where ML represents the maximum length of a particle and A represents the projected area of the particle) of 100 or more and 150 or less, more preferably 105 or more and 145 or less, and most preferably 110 or more and 140 or less. The toner preferably has a volume-average particle size of 3 μm or more and 12 μm or less and more preferably 3.5 μm or more and 9 μm or less, A method for producing the toner is not particularly limited. Examples of the method for producing the toner include a kneading and pulverizing method in which a binder resin, a coloring agent, a release agent, a charge controlling agent, and the like are kneaded, and the mixture is pulverized and classified; a method in which the shape of particles prepared by a kneading and pulverizing method is changed by applying mechanical impact or thermal energy; an emulsion polymerization/aggregation method in which a polymerizable monomer of a binder resin is emulsified, the dispersion is mixed with a dispersion of a coloring agent, a release agent, a charge controlling agent, and the like, and the mixture is aggregated and thermally coalesced to obtain toner particles; a suspension polymerization method in which a polymerizable monomer for obtaining a binder resin and a solution of a coloring agent, a release agent, a charge controlling agent, and the like are suspended in an aqueous solvent to perform polymerization; and a dissolution suspension method in which particles are formed by suspending a binder resin and a solution of a coloring agent, a release agent, a charge controlling agent, and the like in an aqueous solvent.

Alternatively, a publicly known method is also provided in which the toner obtained by the above-described method is used as a core, the aggregated particles are made to adhere to the toner, and heating and coalescence are performed to provide a core-shell structure. The toner is preferably produced by a suspension polymerization method, an emulsion polymerization/aggregation method, or a dissolution suspension method that uses an aqueous solvent and more preferably by an emulsion polymerization/aggregation method in view of the control of the shape and the particle size distribution.

Toner mother particles may contain a binder resin, a coloring agent, and a release agent and may further contain silica and a charge controlling agent.

Examples of the binder resin used for the toner mother particles include homopolymers and copolymers of styrenes such as styrene and chlorostyrene, monoolefins such as ethylene, propylene, butylene, and isoprene, vinyl esters such as vinyl acetate, vinyl propionate, vinyl benzoate, and vinyl butyrate, a-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate, vinyl ethers such as vinyl methyl ether, vinyl ethyl ether, and vinyl butyl ether, vinyl ketones such as vinyl methyl ketone, vinyl hexyl ketone, and vinyl isopropenyl ketone; and polyester resins obtained by copolymerizing dicarboxylic acids and diols.

Representative examples of the binder resin include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene, polyester resin, polyurethane, epoxy resin, silicone resin, polyamide, modified rosin, and paraffin wax.

Representative examples of the coloring agent include magnetic powder such as magnetite and ferrite, carbon black, aniline blue, Calco Oil Blue, chrome yellow, ultramarine blue, Du Pont oil red, quinoline yellow, methylene blue chloride, phthalocyanine blue, malachite green oxalate, lamp black, rose bengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, and C. I. Pigment Blue 15:3.

Representative examples of the release agent include low-molecular polyethylene, low-molecular polypropylene, Fischer-Tropsch wax, montan wax, carnauba wax, rice wax, and candelilla wax.

A publicly known charge controlling agent is used as the charge controlling agent. For example, an azo-based metal complex compound, a metal complex compound of salicylic acid, or a resin-type charge controlling agent having a polar group is used. In the case where the toner is produced by a wet method, a material that is not easily dissolved in water may be used. The toner may be a magnetic toner that contains a magnetic material or a non-magnetic toner that does not contain a magnetic material.

The toner used in the developing device 11 is produced by mixing the toner mother particles and the external additives using a Henschel mixer, a V blender, or the like. In the case where the toner mother particles are produced by a wet method, external additives may be added by a wet method.

Lubricating particles may be added to the toner used in the developing device 11. Examples of the lubricating particles include solid lubricants such as graphite, molybdenum disulfide, talc, fatty acids, and fatty acid metal salts; low-molecular-weight polyolefins such as polypropylene, polyethylene, and polybutene; silicones having a softening point by heating; aliphatic amides such as amide oleate, amide erucate, amide ricinoleate, and amide stearate; vegetable wax such as carnauba wax, rice wax, candelilla wax, Japan wax, and jojoba oil; animal wax such as beeswax; mineral and petroleum wax such as montan wax, ozokerite, ceresine, paraffin wax, microcrystalline wax, and Fischer-Tropsch wax; and modified products of the foregoing. These may be used alone or in combination. The average particle size may be in a range of 0.1 μm or more and 10 μm or less. The particles having the above-described chemical structure may be pulverized to make the particle size uniform. The amount of the lubricating particles added to the toner is preferably 0.05% or more and 2.0% or less and more preferably 0.1% or more and 1.5% or less by mass.

Inorganic particles, organic particles, composite particles including organic particles and inorganic particles attached to the organic particles may be added to the toner used in the developing device 11.

Examples of the inorganic particles include various inorganic oxides, nitrides, and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

The inorganic particles described above may be treated with a titanium coupling agent such as tetrabutyl titanate, tetraoctyl titanate, isopropyltriisostearoyl titanate, isopropyltridecylbenzenesulfonyl titanate, and bis(dioctylpyrophosphate)oxyacetate titanate; or a silane coupling agent such as γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, and p-methylphenyltrimethoxysilane. The inorganic particles hydrophobized with a higher fatty acid metal salt such as silicone oil, aluminum stearate, zinc stearate, or calcium stearate may also be used.

Examples of the organic particles include styrene resin particles, styrene acrylic resin particles, polyester resin particles, and urethane resin particles.

The number-average particle size of the organic particles is preferably 5 nm or more and 1000 nm or less, more preferably 5 nm or more and 800 nm or less, and most preferably 5 nm or more and 700 nm or less. The sum of the amounts of the above-mentioned particles and lubricating particles may be 0.6% or more by mass.

An inorganic oxide having a small particle size, such as a primary particle size of 40 nm or less, may be used as another inorganic oxide added to the toner, and an inorganic oxide having a larger particle size may be further added. The inorganic oxide particles may be publicly known particles. Silica and titanium oxide may be used in combination.

The inorganic particles having a small particle size may be surface-treated. A carbonate such as calcium carbonate or magnesium carbonate or an inorganic mineral such as hydrotalcite may be further added.

The electrophotographic color toner is used by being mixed with a carrier. Examples of the carrier include iron powder, glass beads, ferrite powder, and nickel powder coated or uncoated with a resin. The mixing ratio of the carrier is set according to need.

An example of the transfer device 40 is a publicly known transfer charger including a contact-type transfer charger that uses a belt, a roller, a film, or a rubber blade, and a scorotron transfer charger or a corotron transfer charger that utilizes corona discharge.

An example of the intermediate transfer member 50 includes a semiconductive belt (intermediate transfer belt) composed of polyimide, polyamide-imide, polycarbonate, polyarylate, polyester, rubber, or the like. The intermediate transfer member 50 may be in the form of a drum instead of a belt.

The image forming apparatus 100 may include a charge erase lamp that optically erase the charges of the photoconductor 7, in addition to the above-described devices.

Figure 5:
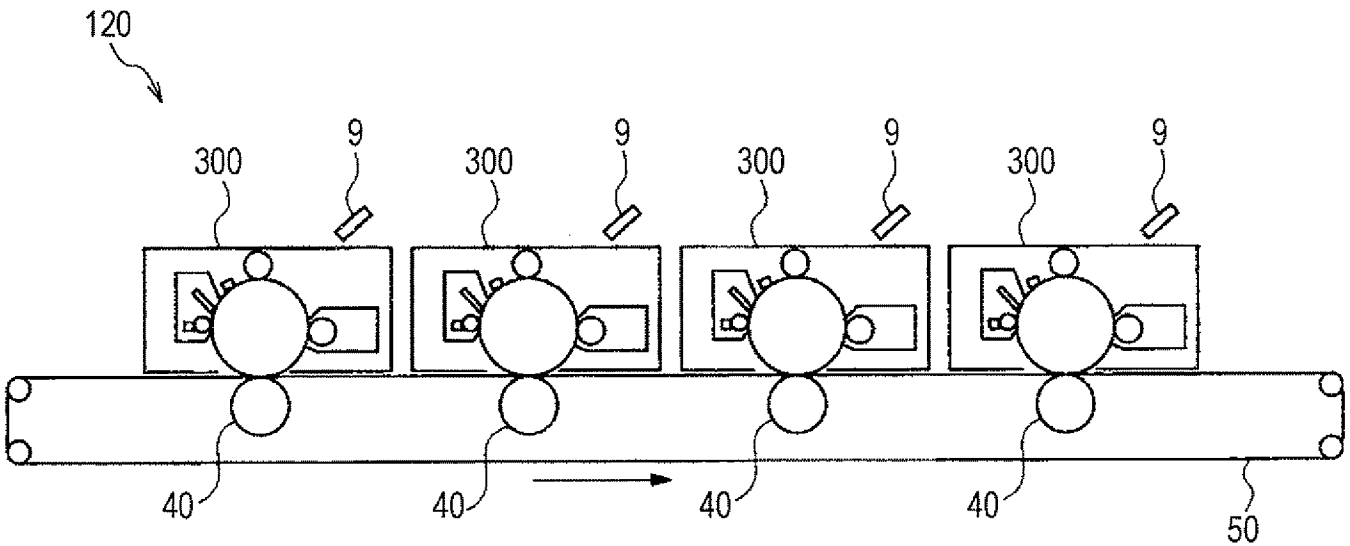
FIG. 5 is a schematic view showing an example of a structure of a tandem-type image forming apparatus according to this exemplary embodiment.

FIG. 5 schematically shows an example of an image forming apparatus according to another exemplary embodiment. As shown in FIG. 5, an image forming apparatus 120 is a full-color image forming apparatus with a tandem system equipped with four process cartridges 300. The image forming apparatus 120 includes four process cartridges 300 arranged side by side on the intermediate transfer member 50. One electrophotographic photoconductor is used for one color. The image forming apparatus 120 has the same structure as that of the image forming apparatus 100, except that it has a tandem system.

In the image forming apparatus and the process cartridge according to this exemplary embodiment, the developing device may include a developing roller which serves as a developer holding member that is moved (rotated) in a direction opposite to the moving direction (rotational direction) of the electrophotographic photoconductor. The developing roller has a cylindrical developing sleeve that supports a developer on the surface of the developing roller. The developing device may be equipped with a regulating member for regulating the amount of the developer supplied to the developing sleeve. By moving (rotating) the developing roller of the developing device in a direction opposite to the rotational direction of the electrophotographic photoconductor, the surface of the electrophotographic photoconductor is rubbed with the toner remaining between the developing roller and the electrophotographic photoconductor.

In the image forming apparatus of this exemplary embodiment, the gap between the developing sleeve and the photoconductor is preferably 200 μm or more and 600 μm or less and more preferably 300 μm or more and 500 μm or less. Furthermore, the gap between the developing sleeve and a regulating blade, which is the regulating member for regulating the amount of the developer, is preferably 300 μm or more and 1000 μm or less and more preferably 400 μm or more and 750 μm or less.

The absolute value of the moving rate of the surface of the developing roller is preferably 1.5 to 2.5 times and more preferably 1.7 to 2.0 times the absolute value (process speed) of the moving rate of the surface of the photoconductor.

In the image forming apparatus (process cartridge) according to this exemplary embodiment, the developing device may include a developer holding member having a magnetic body and may be configured to develop an electrostatic latent image using a two-component developer containing a magnetic carrier and a toner.

EXAMPLES

The present invention will now be more specifically described based on Examples, but is not limited thereto. Hereinafter, "parts" refer to parts by mass unless otherwise specified.

Synthetic Example 1

Synthesis of Compound i-26

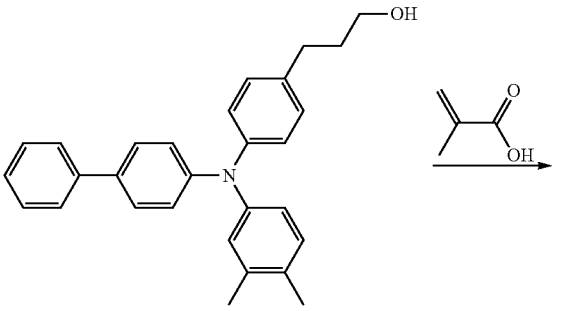

(1)

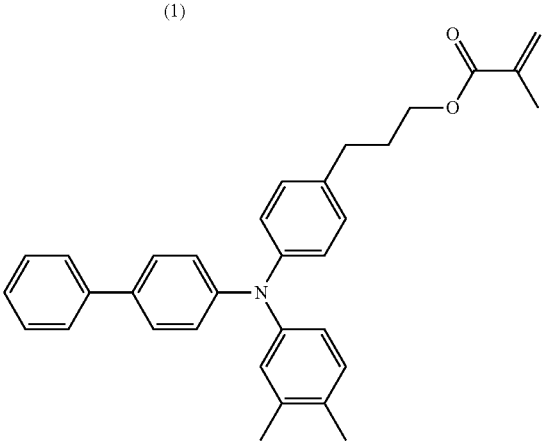

i-26

Figure 7:
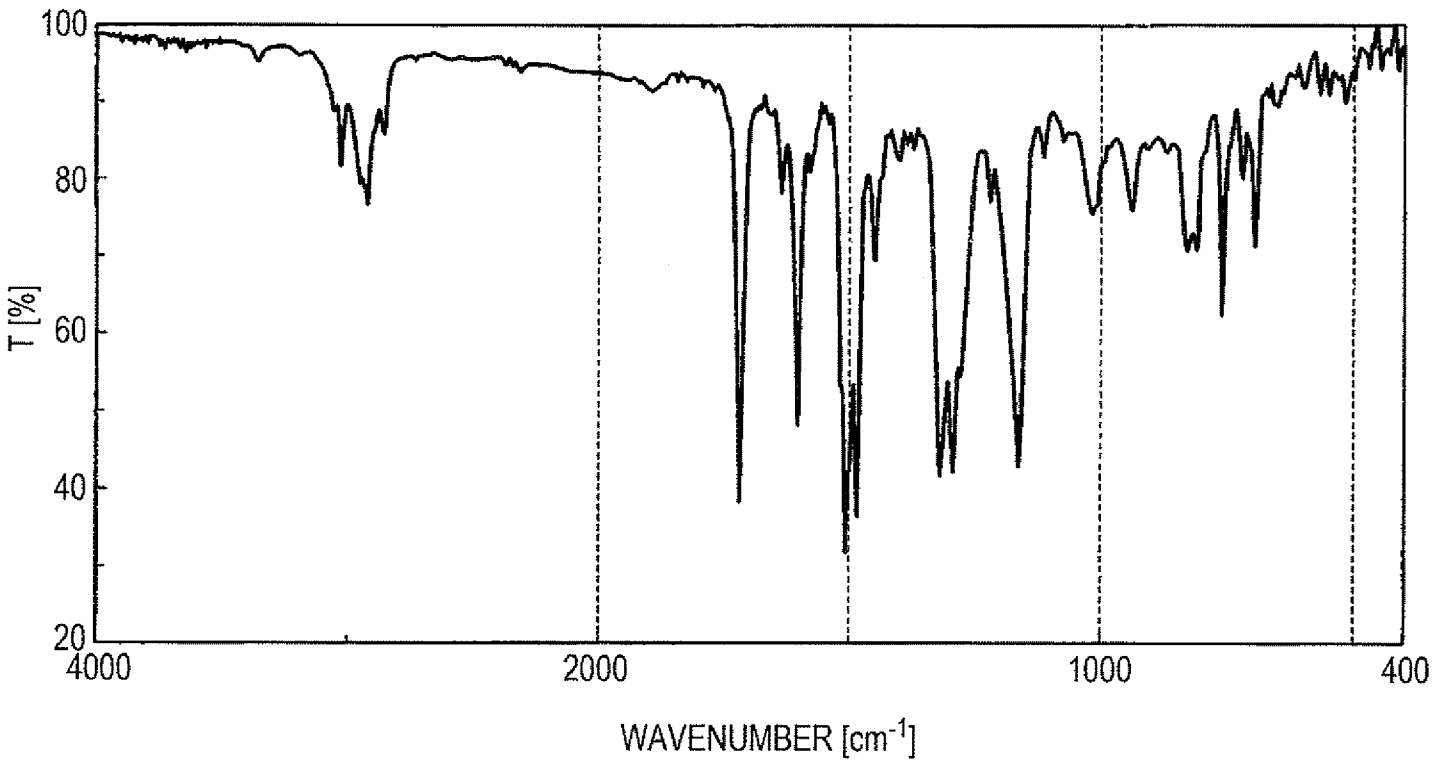
FIG. 7 is an IR spectrum of a compound (i-26) synthesized in Examples.

Into a 1000 ml flask, 100 g of a compound (1) above, 107 g of methacrylic acid, 300 ml of toluene, and 2 g of p-toluene sulfonic acid are added and the mixture is refluxed under heating for 10 hours. After the completion of the reaction, the mixture is cooled and poured into 2000 ml of water for washing, and is further washed with water. The toluene layer is dried using anhydrous sodium sulfate and purified by silica gel column chromatography to obtain 35 g of a compound (i-26) above. FIG. 7 shows the IR spectrum of the compound (i-26).

Synthetic Example 2

Synthesis of Copolymer

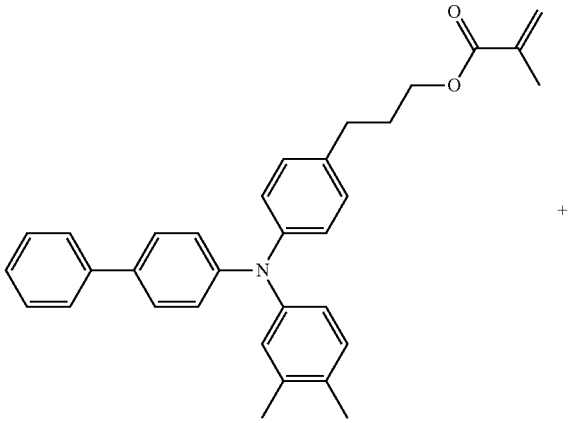

I-26

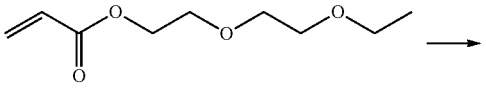

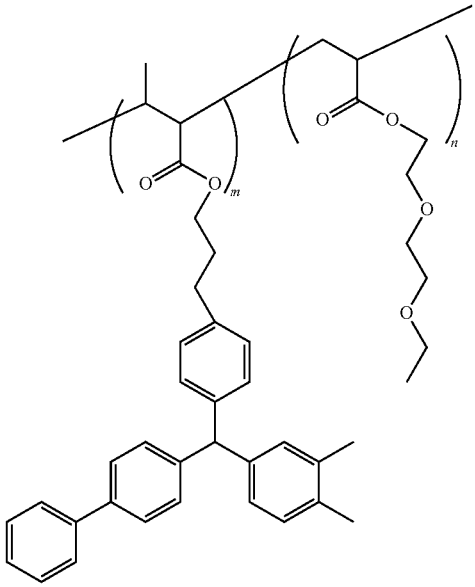

Compound (2)

Into a 500 ml flask, 20 g of the compound (i-26) above, 5 g of 2-(2-ethoxyethoxy)ethyl acrylate, 150 g of toluene, and 0.5 g of polymerization initiator (V601) are added. After the flask is purged with nitrogen, the mixture is refluxed under heating at 90° C. for 3 hours. The mixture is cooled to room temperature, and 25 ml of tetrahydrofuran is added to the mixture. The resulting solution is added dropwise to 1000 ml of methanol to obtain a solid component. By performing reprecipitation twice, 20 g of a compound (2) above is obtained.

Example 1

(Formation of Undercoat Layer 4)

One hundred parts of zinc oxide (manufactured by TAYCA CORPORATION, average particle size: 70 nm, specific surface: 15 $m^2/g$) and 500 parts of toluene are mixed and stirred. Subsequently, 1.3 parts of a silane coupling agent (KBM503 manufactured by Shin-Etsu Chemical Co., Ltd.) is added to the resulting solution, and stirred for 2 hours. Toluene is then removed by reduced-pressure distillation, and baking is performed at 120° C. for 3 hours to obtain zinc oxide surface-treated with the silane coupling agent.

After 110 parts of the zinc oxide surface-treated with the silane coupling agent and 500 parts of tetrahydrofuran are mixed and stirred, a solution obtained by dissolving 0.6 parts of alizarin in 50 parts of tetrahydrofuran is added thereto, and the resulting mixture is stirred at 50° C. for 5 hours. The zinc oxide to which alizarin is added is separated by filtration under reduced pressure and dried under reduced pressure at 60° C. to obtain alizarin-added zinc oxide.

Thirty eight parts of a solution obtained by dissolving 60 parts of the alizarin-added zinc oxide, 13.5 parts of curing agent (block isocyanate, Sumidur 3175 manufactured by Sumitomo Bayer Urethane Co., Ltd.), and 15 parts of butyral resin (S-LEC BM-1 manufactured by Sekisui Chemical Co., Ltd.) in 85 parts of methyl ethyl ketone is mixed with 25 parts of methyl ethyl ketone. The resulting mixture is dispersed in a sand mill using glass beads having a diameter of 1 mmϕ for 2 hours.

Next, 0.005 parts of dioctyltin dilaurate as a catalyst and 40 parts of silicone resin particles (Tospearl 145 manufactured by GE Toshiba Silicones Co., Ltd.) are added to the dispersion to obtain a coating solution for forming an undercoat layer. The coating solution for forming an undercoat layer is applied on an aluminum base having a diameter of 30 mm, a length of 340 mm, and a thickness of 1 mm by dip coating, and dried and cured at 170° C. for 40 minutes to obtain an undercoat layer having a thickness of (Formation of Charge Generation Layer 2A)

A mixture of 15 parts of hydroxygallium phthalocyanine as a charge generation substance and having diffraction peaks at Bragg angles (2θ±0.2°) of at least 7.3°, 16.0°, 24.9° , and 28.0° in the X-ray diffraction spectrum measured using a CuKα characteristic X-ray, 10 parts of vinyl chloride-vinyl acetate copolymer resin as a binder resin (VMCH manufactured by Nippon Unicar Company Limited), and 200 parts of n-butyl acetate is dispersed in a sand mill using glass beads having a diameter of 1 mmϕ for 4 hours. To the dispersion, 175 parts of n-butyl acetate and 180 parts of methyl ethyl ketone are added. The mixture is stirred to obtain a coating solution for forming a charge generation layer. The coating solution for forming a charge generation layer is applied on the undercoat layer by dip coating and dried at normal temperature (23° C.) to form a charge generation layer having a thickness of 0.2 μm.

(Formation of Charge Transport Layer 2B (Outermost Surface Layer))

Charge transport material (compound (2)) 16 parts
Bisphenol Z polycarbonate resin (viscosity-average molecular weight: about 40000) 4 parts
Tetrahydrofuran (THF) 20 parts
Toluene 20 parts
3,5-di-t-butyl-4-hydroxytoluene (BHT) 1 part By mixing the above-described materials, a coating solution for forming a charge transport layer is prepared. The coating solution is applied on the charge generation layer by dip coating and air-dried at room temperature (23° C.) for 5 minutes. Next, heating at 145° C. is performed for 40 minutes to obtain a photoconductor having a charge transport layer 2B. The thickness of the charge transport layer 2B is 25 μm Example 2

An undercoat layer 4 and a charge generation layer 2A are formed on an aluminum base in the same manner as in Example 1.

(Formation of Charge Transport Layer 2B-1)

Charge transport material (CTM-1: N,N'-diphenyl-N,N'-bis(3-methylphenyl)-[1,1']biphenyl-4,4'-diamine) 3.5 parts
Charge transport material (CTM-2: N,N'-bis(3,4-dimethylphenyl)-biphenyl-4-amine) 1.5 parts
Bisphenol Z polycarbonate resin (viscosity-average molecular weight: about 40000) 5.0 parts The above-described materials are dissolved in 40 parts of chlorobenzene to prepare a coating solution for forming a charge transport layer. The coating solution is applied on the charge generation layer 2A by dip coating and dried at 130° C. for 45 minutes. The thickness of the non-cross-linked charge transport layer 2B-1 is 20 μm.

(Formation of Charge Transport Layer 2B-2 (Outermost Surface Layer))

Charge transport material (refer to Table 1) 15 parts
Bisphenol Z polycarbonate resin (viscosity-average molecular weight: about 40000) 5 parts
Tetrahydrofuran (THF) 20 parts
Toluene 20 parts
3,5-di-t-butyl-4-hydroxytoluene (BHT) 1 part By mixing the above-described materials, a coating solution for forming a charge transport layer is prepared. The coating solution is applied on the non-cross-linked charge transport layer 2B-1 by ink jet coating and air-dried at room temperature (23° C.) for 10 minutes. Next, heating at 135° C. is performed for 60 minutes to form a charge transport layer 2B-2. The thickness of the entire photosensitive layer obtained is 32 μm.

Examples 3 to 9

Photoconductors are produced in the same manner as in Example 1, except that the "charge transport material", "binder resin", and "other additives" and the contents thereof used to form the charge transport layer 2B, which is an outermost surface layer of Example 1, are changed to those shown in Tables 1 and 2 below.

In Tables 1 and 2, "PC" refers to bisphenol Z polycarbonate (viscosity-average molecular weight: about 40000); "PC/PS" refers to a mixture (the ratio in Tables is on a mass basis) of bisphenol Z polycarbonate (viscosity-average molecular weight: about 40000) and polystyrene (Melt Index 7.5); "BM-1" refers to a polyvinyl butyral resin (S-LEC BM-1 manufactured by Sekisui Chemical Co., Ltd., average molecular weight: about 40000); "BDETPM" refers to bis(4-diethylamino-2-methylphenyl)phenylmethane; and "KL600" refers to a fluorine-containing acrylic polymer (Polyflow KL-600 manufactured by Kyoei Kagaku Kogyo).

Comparative Examples 1 to 4

Photoconductors are produced in the same manner as in Example 1, except that the "charge transport material", "binder resin", and "other additives" and the contents thereof used to form the charge transport layer 2B, which is an outermost surface layer of Example 1, are changed to those shown in Table 3 below.

In Table 3, "PC" refers to bisphenol Z polycarbonate (viscosity-average molecular weight: about 40000).

TABLE 1
| | (a) Polymeric electron transport material | | | | (a) Polymeric electron transport material |
|---|---|---|---|---|---|
| | Reactive monomer having charge transport property | | Reactive monomer having no charge transport property | | |
| | Structure | % by mass | Structure | % by mass | (parts by mass) |
| Ex. 1 | 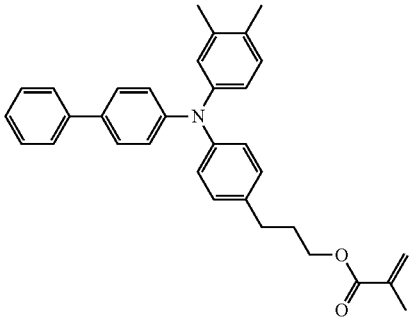 | 75 | 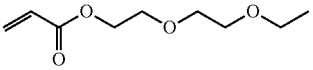 | 25 | 16 |
| Ex. 2 | 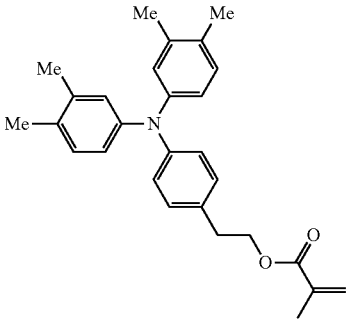 | 75 | 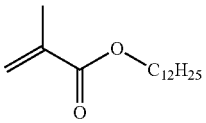 | 25 | 15 |
| Ex. 3 | 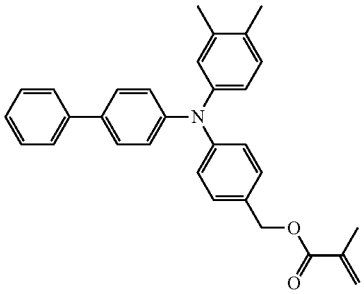 | 50 | 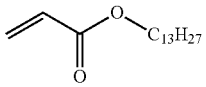 | 50 | 18 |
| Ex. 4 | 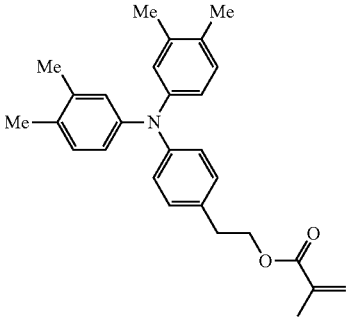 | 90 | 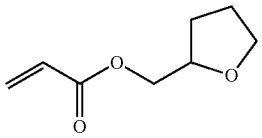 | 10 | 12.5 |
| | (b) Binder resin | | Other additives | |
|---|---|---|---|---|
| | Type | Parts by mass | (% by mass) | |
| Ex. 1 | PC | 4 | BHT 1% | — |
| Ex. 2 | PC | 5 | BHT 1% | KL600 1% |

TABLE 1-continued
| | | | | |
|---|---|---|---|---|
| Ex. 3 | PC | 2 | BDETPM 1% | — |
| Ex. 4 | PC/PS = 75:25 | 7.5 | BHT 1.5% | — |
Ex.: Example
TABLE 2
| | (a) Polymeric electron transport material | | | |
|---|---|---|---|---|
| | Reactive monomer having charge transport property | | Reactive monomer having no charge transport property | |
| | Structure | % by mass | Structure | % by mass |
| Ex. 5 | 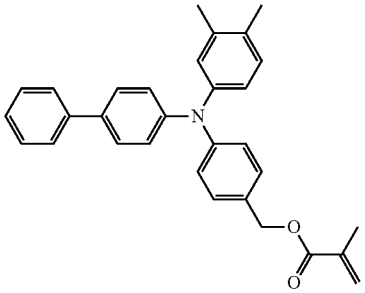 | 90 | 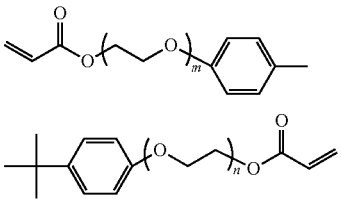 m + n = 3 | 10 |
| Ex. 6 | 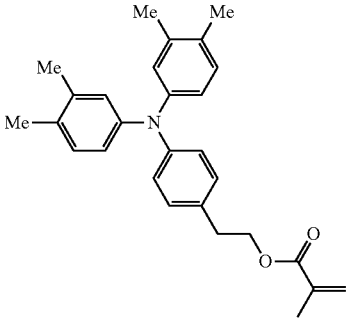 | 80 | 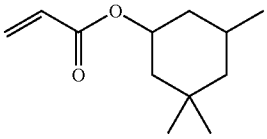 | 20 |
| Ex. 7 | 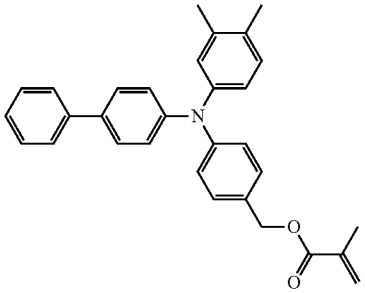 | 95 | 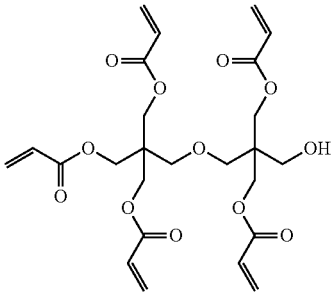 | 5 |
| Ex. 8 | 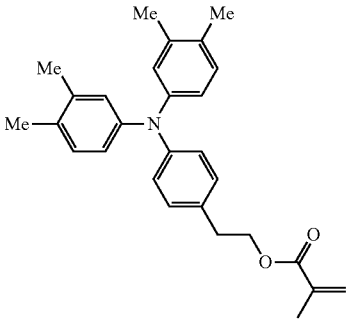 | 92.5 | 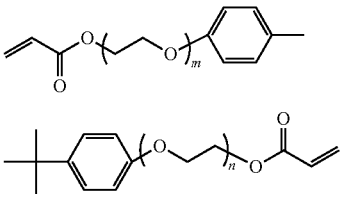 m + n = 2 | 7.5 |

TABLE 2-continued

| | | | | |
|---|---|---|---|---|
| Ex. 9 | 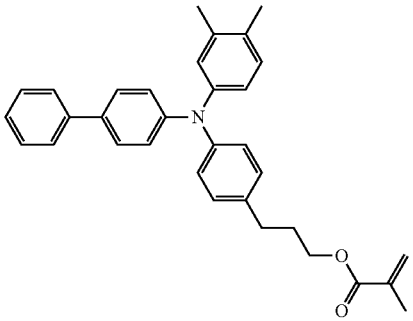 | 80 | 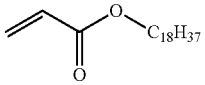 | 20 |

| | (a) Polymeric electron transport material (parts by mass | (b) Binder resin Type | Parts by mass | Other additives (% by mass) | |
|---|---|---|---|---|---|
| Ex. 5 | 32 | PC | 8 | BHT 5% | — |
| Ex. 6 | 30 | BM-1 | 10 | — | — |
| Ex. 7 | 15 | PC | 5 | BHT 1.5% | — |
| Ex. 8 | 16 | PC | 4 | BHT 2.5% | — |
| Ex. 9 | 32 | PC | 8 | BHT 1.5% | — |

Ex.: Example

TABLE 3

| | (a) Polymeric electron transport material: Reactive monomer having charge transport property Structure | % by mass | Reactive monomer having no charge transport property Structure | % by mass | (a) Polymeric electron transport material (parts by mass) | (b) Binder resin Type | Parts by mass | Other additives (% by mass) | |
|---|---|---|---|---|---|---|---|---|---|
| C.E. 1 | 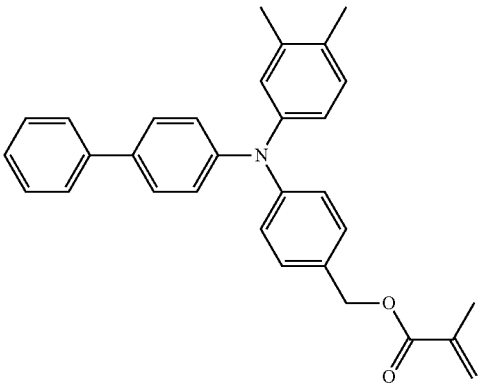 | 100 | — | 0 | 16 | PC | 4 | BHT 2% | — |

TABLE 3-continued

| | (a) Polymeric electron transport material | | | | (a) Polymeric electron transport material | (b) Binder resin | | |
|---|---|---|---|---|---|---|---|---|
| | Reactive monomer having charge transport property | | Reactive monomer having no charge transport property | | | | | |
| | Structure | % by mass | Structure | % by mass | (parts by mass) | Type | Parts by mass | Other additives (% by mass) |
| C.E. 2 | 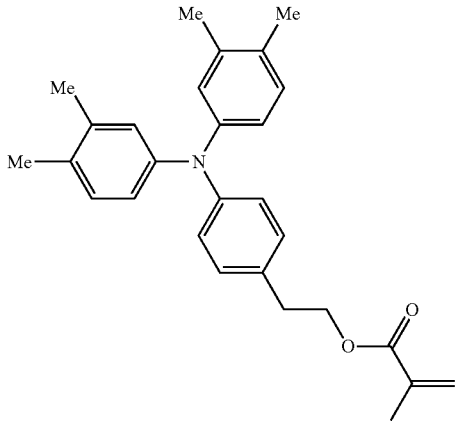 | 80 | 2-ethyl acrylate | 20 | 18 | PC | 2 | BHT 1.5% — |
| C.E. 3 | 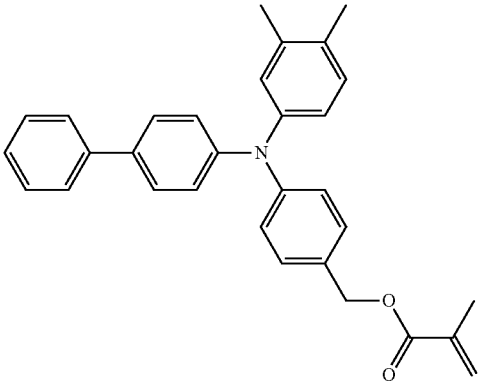 | 60 | 2-ethyl methacrylate | 40 | 25 | PC | 15 | BHT 3% — |
| C.E. 4 | 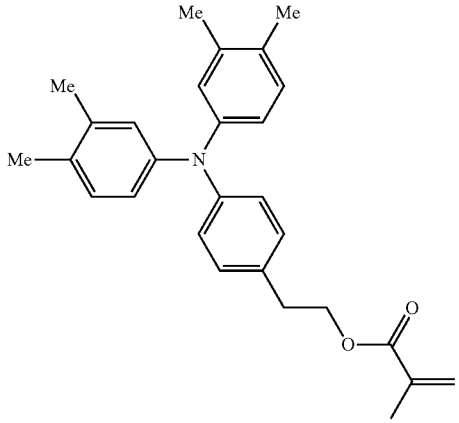 | 90 | 2-hydroxyethyl methacrylate | 10 | 30 | PC | 10 | BHT 1% — |

C.E.: Comparative Example

[Evaluation Method of Photoconductor]

—Printing Evaluation Using Photoconductors—

Printing evaluation is performed by mounting the electrophotographic photoconductors prepared in Examples and Comparative Examples onto DocuCentre Color 400CP (manufactured by Fuji Xerox Co., Ltd.).

Figure 6:
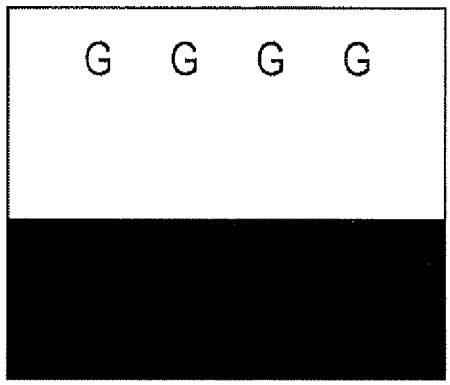
FIG. 6 illustrates a pattern for image evaluation regarding image deletion and white streaks.

First, an image evaluation pattern shown in FIG. 6 is output at low temperature and humidity (20° C., 30% RH) and the output is assumed to be "evaluation image 1". Subsequently, after a black solid pattern is continuously output on 10000 sheets, the image evaluation pattern is output and the output is assumed to be "evaluation image 2". After the electrophotographic photoconductors are left in a low-temperature, low-humidity (20° C., 30% RH) environment for 24 hours, the image evaluation pattern is output and the output is assumed to be "evaluation image 3". Subsequently, after a black solid pattern is output on 5000 sheets in a high humidity (28° C., 60% RH) environment, the image evaluation pattern is output and the output is assumed to be "evaluation image 4". After the electrophotographic photoconductors are left in a high humidity (28° C., 60% RH) environment for 24 hours, the image evaluation pattern is output and the output is assumed to be "evaluation image 5". The electrophotographic photoconductors are returned to a low-temperature, low-humidity (20° C., 30% RH) environment, a black solid pattern is continuously output on 20000 sheets, and the image evaluation pattern is output and the output is assumed to be "evaluation image 6".

<Long-Term Image Stability>

Evaluation of long-term image stability is performed by comparing "evaluation image 6" with "evaluation image 1" and observing the deterioration of the image quality through visual inspection.

A+: Excellent

A: Good (no change is observed through visual inspection, but changes are observed in enlarged images)

B: Deterioration of image quality is observed, but the image quality is still allowable C: Image quality is deteriorated to a level that would cause a problem <Evaluation Regarding Image Deletion and White Streaks>

Evaluation regarding image deletion and white streaks is performed by respectively comparing "evaluation image 3" and "evaluation image 5" with "evaluation image 2" and "evaluation image 4" and observing the deterioration of the image quality through visual inspection.

A+: Good

A: Good, but image deletion and/or white streaks are slightly observed

B: Image deletion and/or white streaks are noticeable to some extent

C: Image deletion and/or white streaks are clearly noticeable

<Electrical Characteristics>

The photoconductor is negatively charged with a scorotron charger while applying 700 V to a grid in a low-temperature, low-humidity (10° C., 15% RH) environment and the charged photoconductor is subjected to flash exposure at a radiant exposure of 10 mJ/m$^2$ using a 780 nm semiconductor laser. Ten seconds after the exposure, the potential (V) at the surface of the photoconductor is measured and the observed value is employed as a value of the rest potential.

A+: −100 V or more

A: −200 V or more and less than −100 V

B: −300 V or more and less than −200 V

C: less than −300 V

<Mechanical Strength>

The extent of occurrence of scratches on the surface of the photoconductor after the runs is judged through visual inspection.

A: Scratches are not visually observed

B: Scratches are caused on part of the surface

C: Scratches are caused on the entire surface

Table 4 shows the thus-obtained evaluation results.

TABLE 4

| | Long-term image stability | Image deletion and white streaks | Electrical characteristics | Mechanical strength |
|---|---|---|---|---|
| Ex. 1 | A | A | A | A |
| Ex. 2 | A+ | A+ | A+ | A |
| Ex. 3 | A+ | A+ | A+ | A |
| Ex. 4 | A | A | A | A |
| Ex. 5 | A | A | A | A+ |
| Ex. 6 | A | A | A+ | A |
| Ex. 7 | A | A | A | A+ |
| Ex. 8 | A+ | A+ | A+ | A+ |
| Ex. 9 | A+ | A+ | A+ | A |
| C.E. 1 | C | B | C | C |
| C.E. 2 | B | B | B | C |
| C.E. 3 | B | B | C | C |
| C.E. 4 | C | B | C | B |

Ex.: Example
C.E.: Comparative Example

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoconductor comprising:

a conductive substrate; and an outermost surface layer formed on the conductive substrate and containing a binder resin and a copolymer derived from a reactive monomer having charge transport property and a reactive monomer having no charge transport property, the copolymer having a side chain with 4 or more carbon atoms in a constitutional unit derived from the reactive monomer having no charge transport property, wherein the reactive monomer having no charge transport property has a bisphenol skeleton, and the copolymer contains a constitutional unit represented by general formula (1-1) below and derived from the reactive monomer having charge transport property and a constitutional unit represented by general formula (1-2) below and derived from the reactive monomer having no charge transport property, General formula (1-1)

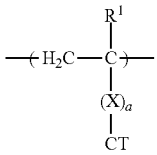

-continued

General formula (1-2)

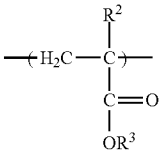

where in general formulas (1-1) and (1-2), $R^1$ and $R^2$ each independently represent hydrogen or an alkyl group having 1 to 4 carbon atoms, $R^3$ represents an organic group having 4 or more carbon atoms and no charge transport property, X represents a divalent organic group having 1 to 10 carbon atoms, a is 0 or 1, and CT represents an organic group having a charge transport skeleton.

2. The electrophotographic photoconductor according to claim 1, wherein the side chain has 12 to 20 carbon atoms.

3. The electrophotographic photoconductor according to claim 1, wherein the reactive monomer having no charge transport property has an alkylene oxide group.

4. The electrophotographic photoconductor according to claim 1, wherein the reactive monomer having no charge transport property has a hydroxyl group.

5. The electrophotographic photoconductor according to claim 1, wherein the reactive monomer having charge transport property is a compound represented by general formula (2) below, General formula (2)

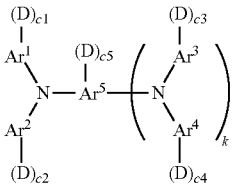

where in general formula (2), $Ar^1$ to $Ar^4$ may be the same or different and each independently represent a substituted or unsubstituted aryl group, $Ar^5$ represents a substituted or unsubstituted aryl group or a substituted or unsubstituted arylene group, D represents a side chain having a reactive group, c1 to c5 are each independently an integer of 0 to 2, k is 0or 1, and the total number of D is 1 to 6.

6. The electrophotographic photoconductor according to claim 1, wherein the blend ratio of the copolymer to the binder resin that constitute the outermost surface layer is about 10:1 to 1:5 by mass.

7. A process cartridge comprising:

an electrophotographic photoconductor according to claim 1, wherein the process cartridge is detachably mountable to an image forming apparatus.

8. The process cartridge according to claim 7, wherein the side chain in the electrophotographic photoconductor has 12 to 20 carbon atoms.

9. An image forming apparatus comprising:

an electrophotographic photoconductor according to claim 1;

a charging device that charges the electrophotographic photoconductor;

a latent image forming device that forms an electrostatic latent image on a surface of the charged electrophotographic photoconductor;

a developing device that develops, with a toner, the electrostatic latent image formed on the surface of the electrophotographic photoconductor to form a toner image; and a transfer device that transfers the toner image formed on the surface of the electrophotographic photoconductor onto a recording medium.

10. The image forming apparatus according to claim 9, wherein the side chain in the electrophotographic photoconductor has 12 to 20 carbon atoms.

11. The process cartridge according to claim 7, wherein the reactive monomer having charge transport property is a compound represented by general formula (2) below, General formula (2)

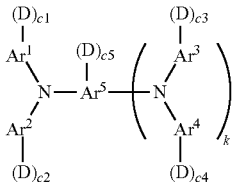

where in general formula (2), $Ar^1$ to $Ar^4$ may be the same or different and each independently represent a substituted or unsubstituted aryl group, $Ar^5$ represents a substituted or unsubstituted aryl group or a substituted or unsubstituted arylene group, D represents a side chain having a reactive group, c1 to c5 are each independently an integer of 0 to 2, k is 0or 1, and the total number of D is 1 to 6.

12. The image forming apparatus according to claim 9, wherein the reactive monomer having charge transport property is a compound represented by general formula (2) below, General formula (2)

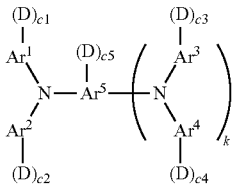

where in general formula (2), $Ar^1$ to $Ar^4$ may be the same or different and each independently represent a substituted or unsubstituted aryl group, $Ar^5$ represents a substituted or unsubstituted aryl group or a substituted or unsubstituted arylene group, D represents a side chain having a reactive group, c1 to c5 are each independently an integer of 0 to 2, k is 0or 1, and the total number of D is 1 to 6.

* * * * *